US010119667B1

(12) United States Patent
Rogers et al.

(10) Patent No.: US 10,119,667 B1
(45) **Date of Patent: *Nov. 6, 2018**

(54) LIGHT-REDIRECTING OPTICAL DAYLIGHTING SYSTEM

(71) Applicant: LightLouver LLC, Louisville, CO (US)

(72) Inventors: Zachary L. Rogers, Lafayette, CO (US); Michael J Holtz, Boudler, CO (US)

(73) Assignee: LightLouver LLC, Louisville, CO (US)

( * ) Notice: Subject to any disclaimer, the term of this patent is extended or adjusted under 35 U.S.C. 154(b) by 0 days.

This patent is subject to a terminal disclaimer.

(21) Appl. No.: 15/993,193

(22) Filed: May 30, 2018

Related U.S. Application Data

(63) Continuation of application No. 15/821,420, filed on Nov. 22, 2017, now Pat. No. 10,012,356.

(51) Int. Cl.
*F21S 11/00* (2006.01)
*E06B 9/24* (2006.01)

(52) U.S. Cl.
CPC ..... *F21S 11/007* (2013.01); *E06B 9/24* (2013.01); *F21S 11/002* (2013.01); *E06B 2009/2417* (2013.01)

(58) Field of Classification Search
CPC ..... F21S 11/007; F21S 11/002
See application file for complete search history.

(56) References Cited

U.S. PATENT DOCUMENTS 312,290 A 2/1885 Pennychuick
586,220 A 7/1897 Basquin
(Continued)

FOREIGN PATENT DOCUMENTS

AU 2012284194 B2 12/2015
CA 2598729 A1 2/2009
(Continued)

OTHER PUBLICATIONS

SGG Lumitop Technical Datasheet: Daylighting glazing which redirects light, Sep. 2006, Saint-Gobain Glass, East Riding of Yorkshire, United Kingdom.
(Continued)

*Primary Examiner* — Christopher E Mahoney
(74) *Attorney, Agent, or Firm* — Stone Creek Services LLC; Alan M Flum

(57) ABSTRACT

Light-redirecting optical system for building fenestrations, such as glass doors and windows, storefront glazing systems, and curtain walls, that can collect and redirect daylight into the interior of a building. The light-redirecting optical system includes an outward-facing light-redirecting optical surface and an inward-facing light-redirecting surface. The outward-facing light-redirecting optical surface collects and redirects daylight mostly upward toward the inward-facing light-redirecting surface. The inward-facing light-redirecting surface receives the redirected daylight and further redirects it into the interior environment at pre-determined angles; so that all specular rays of light are at or above the horizon for a wide range of incident angles of daylight striking the outward-facing light-redirecting optical surface. The light-redirecting optical surfaces can be fabricated on a film or flexible substrate that may be directly applied to glass, acrylic, or other glazing surfaces. Alternatively, the light-redirecting optical surfaces may be fabricated directly on the glazing surfaces.

17 Claims, 42 Drawing Sheets

(56) References Cited

U.S. PATENT DOCUMENTS

| | | | | |
|---|---|---|---|---|
| 586,221 | A | 7/1897 | Basquin | |
| 586,247 | A | 7/1897 | Soper | |
| 593,045 | A | 11/1897 | Cummings | |
| 637,145 | A | 11/1899 | Moffat et al. | |
| 665,170 | A | 1/1901 | Brown | |
| 720,386 | A | 2/1903 | Wadsworth | |
| 720,987 | A | 2/1903 | Wadsworth | |
| 721,256 | A | 2/1903 | Wadsworth | |
| 721,259 | A | 2/1903 | Wadsworth | |
| 737,979 | A | 9/1903 | Wadsworth | |
| 749,761 | A | 1/1904 | Wadsworth | |
| 752,429 | A | 2/1904 | Wadsworth | |
| 755,197 | A | 3/1904 | Wadsworth | |
| 2,812,691 | A | 11/1957 | Boyd | |
| 2,844,998 | A | 7/1958 | Vincent | |
| 3,096,684 | A | 7/1963 | Kegg et al. | |
| 4,557,565 | A | 12/1985 | Ruck et al. | |
| 5,880,886 | A | 3/1999 | Milner | |
| 6,239,910 | B1 | 5/2001 | Digert | |
| 6,435,683 | B1 * | 8/2002 | Milner | E06B 9/24 359/599 |
| 6,480,336 | B2 | 11/2002 | Digert et al. | |
| 6,580,559 | B2 | 6/2003 | Doll et al. | |
| 6,707,611 | B2 | 3/2004 | Gardiner et al. | |
| 6,714,352 | B2 | 3/2004 | Rogers et al. | |
| 7,121,709 | B2 | 10/2006 | Shinohara et al. | |
| 7,418,202 | B2 | 8/2008 | Biemath et al. | |
| 7,872,801 | B2 | 1/2011 | Kojima et al. | |
| 7,887,221 | B2 | 2/2011 | Lor et al. | |
| 7,957,082 | B2 | 6/2011 | Mi et al. | |
| 7,980,712 | B2 | 7/2011 | Horii et al. | |
| 8,040,610 | B2 | 10/2011 | Ko et al. | |
| 8,048,250 | B2 | 11/2011 | Raymond et al. | |
| 8,059,229 | B2 | 11/2011 | Shinkai et al. | |
| 8,092,068 | B2 | 1/2012 | Parker et al. | |
| 8,107,164 | B2 | 1/2012 | Tsai | |
| 8,303,122 | B2 | 11/2012 | Hughes | |
| 8,611,012 | B2 | 12/2013 | Hsu | |
| 8,665,521 | B2 | 3/2014 | Tsai et al. | |
| 8,845,176 | B2 | 9/2014 | Parker et al. | |
| 8,873,146 | B2 | 10/2014 | Gardiner | |
| 8,888,333 | B2 | 11/2014 | Yapel et al. | |
| 8,934,173 | B2 | 1/2015 | Vasylyev et al. | |
| 9,171,489 | B2 | 10/2015 | Aho | |
| 9,180,635 | B2 | 11/2015 | Suzuki et al. | |
| 9,244,206 | B2 | 1/2016 | Padiyath et al. | |
| 9,250,368 | B2 | 2/2016 | Padiyath et al. | |
| 9,341,333 | B2 | 5/2016 | Dai et al. | |
| 9,341,334 | B2 | 5/2016 | Fujioka | |
| 9,365,449 | B2 | 6/2016 | Ueda | |
| 9,366,403 | B2 | 6/2016 | Kashiwagi et al. | |
| 9,574,730 | B2 | 2/2017 | Padiyath et al. | |
| 9,625,640 | B2 | 4/2017 | Aronson et al. | |
| 2005/0254130 | A1 | 11/2005 | Graf et al. | |
| 2007/0103910 | A1 | 5/2007 | Brickley et al. | |
| 2007/0223249 | A1 | 9/2007 | Lee et al. | |
| 2009/0009870 | A1 | 1/2009 | Usami | |
| 2009/0219723 | A1 | 9/2009 | Liou | |
| 2010/0075069 | A1 | 5/2010 | Laney et al. | |
| 2012/0033302 | A1 * | 2/2012 | Suzuki | B29D 11/00605 359/597 |
| 2012/0327507 | A1 | 12/2012 | Padiyath | |
| 2013/0038928 | A1 | 2/2013 | Padiyath et al. | |
| 2013/0279009 | A1 * | 10/2013 | Hsu | G02B 19/0042 359/597 |
| 2014/0211331 | A1 | 7/2014 | Padiyath | |
| 2015/0085368 | A1 | 3/2015 | Vasylvev | |
| 2016/0097502 | A1 | 4/2016 | Padiyath et al. | |
| 2016/0153638 | A1 | 6/2016 | Yuan et al. | |
| 2016/0273724 | A1 | 9/2016 | Sakuragi et al. | |
| 2016/0333634 | A1 | 11/2016 | Free et al. | |
| 2017/0023197 | A1 | 1/2017 | Kabushiki | |
| 2017/0114590 | A1 | 4/2017 | Shinozaki et al. | |
| 2017/0130920 | A1 | 5/2017 | Tsujimoto | |
| 2018/0119486 | A1 * | 5/2018 | Kanno | E06B 9/386 |

FOREIGN PATENT DOCUMENTS

| | | | | |
|---|---|---|---|---|
| CA | 2842170 | A1 | 1/2013 | |
| CN | 102455459 | A | 5/2012 | |
| CN | 20322386 | U | 10/2013 | |
| CN | 203422489 | U | 2/2014 | |
| CN | 103688196 | A | 3/2014 | |
| CN | 106152055 | U | 11/2016 | |
| CN | 206020705 | U | 3/2017 | |
| DE | 3517610 | A1 | 11/1986 | |
| DE | 102008055857 | B4 | 4/2012 | |
| EP | 0800035 | B1 | 6/2002 | |
| EP | 3104200 | A1 | 12/2016 | |
| GB | 2328239 | B | 5/2000 | |
| JP | 2000226969 | A | 8/2000 | |
| JP | 2003157707 | A | 8/2000 | |
| JP | 2012256557 | A * | 12/2012 | F21S 11/007 |
| JP | 5123364 | B2 | 1/2013 | |
| JP | 2014521126 | A | 8/2014 | |
| JP | 5988770 | B2 | 9/2016 | |
| JP | 6092547 | B2 | 3/2017 | |
| KR | 20140054065 | A | 5/2014 | |
| TW | 201310083 | A | 3/2013 | |
| WO | 0047859 | A1 | 8/2000 | |
| WO | 2012107104 | A1 | 2/2011 | |
| WO | 201312858 | A2 | 1/2013 | |
| WO | 2015085060 | A1 | 6/2015 | |
| WO | 2015085061 | A1 | 6/2015 | |
| WO | 2016044462 | A1 | 3/2016 | |
| WO | 2016064595 | A1 | 4/2016 | |
| WO | 2016064621 | A1 | 4/2016 | |
| WO | 2016064667 | A1 | 4/2016 | |
| WO | 2016084752 | A1 | 6/2016 | |
| WO | 2016172428 | A1 | 10/2016 | |
| WO | 2016185684 | A1 | 11/2016 | |
| WO | 2017022792 | A1 | 2/2017 | |
| WO | 2016099600 | A1 | 6/2018 | |

OTHER PUBLICATIONS

SerraGlaze Daylight Redirecting Film: Harnessing the Power of Daylight, Mar. 2015, SerraLux Inc, Los Gatos, California United States.

Raghu Padiyath, Daylight Redirecting Window Films Case Studies, 5th Velux Daylight Symposium, Copenhagen, Denmark 2013, May 2013, 3M, St. Paul Minnesota, United States.

Daylighting Redirecting Film Brochure, Publication No. 98-0150-0902-4, May 2017, 3M, St. Paul Minnesota, United States.

Raghu Padiyath, Daylight Redirecting Window Films, ESTCP Project EW-201014, Sep. 2013, ESTCP, United States Department of Defense, Alexandria, Virginia, United States.

Technical Bulletin: 3M Daylight Redirecting Film (DRF) Frequently Asked Questions—Customers, Jul. 2016, 3M, St. Paul Minnesota, United States.

Stephan Klammt, Andreas Neyer, Helmut Muller, Redirection of Sunlight by Microstructured Components-Simulation, Fabrication and Experimental Results, Solar Energy, vol. 86, No. 5, May 31, 2012, pp. 1660-1666, Elsevier B.V., Amsterdam, Netherlands.

Anothai Thanachareonkit, Eleanor S. Lee, Andrew McNeil, Empirical assessment of a prismatic daylight-redirecting window film in a full-scale office testbed, Oct. 2013, IESNA 2013 Annual Conference, Huntington Beach, CA.

Andrew McNeil, Eleanor S. Lee, Jacob C. Jonsson, Daylight performance of a microstructured prismatic window film in deep open plan offices, Sep. 2013, Lawrence Berkeley National Laboratory, Berkeley, California, United States, downloaded from the Internet on May 31, 2017 from https://facades.lbl.gov/sites/all/files/daylight-summary.pdf.

Michael Holtz, Integrated Lighting System Performance Specifications, Mar. 2013, LightLouver LLC, Louisville, Colorado, United States.

DuPont Innovallight Silicon Inks, Publication No. K25759-1_Ltr, Feb. 2012, Innovalight Inc, Sunnyvale, California, United States.

M Rubin, R Powles, K Von Rottakay, Models for the Angle-Dependent Optical Properties of Coated Glazing Materials, Solar

(56) References Cited

OTHER PUBLICATIONS

Energy, Mar. 1998, vol. 66, pp. 267-276, Downloaded from the Internet from https://windows.bl.gov/publications/models-angle-dependent-optical-properties-coated-glazing-materials on Mar. 13, 2018.
R.A. Furler, Angular Dependence of Optical Properties of Homogeneous Glasses, Transactions ASHRAE, Jun. 1991, ASHRAE, Atlanta Georgia.
Jin Ho Kim, Patent Cooperation Treaty International Search Report, for PCT/US2018/035138 filed on May 30, 2018, dated Sep. 14, 2018, Korea Intellectual Property Office, Daejeon, Republic of Korea.
Jin Ho Kim, Patent Cooperation Treaty Written Opinion of the International Search Authority, for PCT/US2018/035138 filed on May 30, 2018, dated Sep. 14, 2018, Korea Intellectual Property Office, Daejeon, Republic of Korea.
Notification of Transmittal of the International Search Report and the Written Opinion of the International Search Authority, for PCT/US2018/035138 filed on May 30, 2018, dated Sep. 14, 2018, Korea Intellectual Property Office, Daejeon, Republic of Korea.
International Patent Application No. PCT/US2018/035138, Inventors: Zachary L Rogers et al., Assignee: LightLouver, LLC, Filed on May 30, 2018, Receiving Office: United States Patent and Trademark Office, Alexandria, VA.

* cited by examiner

LIGHT-REDIRECTING OPTICAL DAYLIGHTING SYSTEM

This application is a continuation of U.S. patent application Ser. No. 15/821,420 filed on Nov. 22, 2017. The entire contents of U.S. patent application Ser. No. 15/821,420 are hereby incorporated by reference.

BACKGROUND

This disclosure relates to structures for redirecting light. Particularly structures either applied to or built into glazing for redirecting daylight into building interior environments.

Daylighting is the purposeful use of direct, diffuse, and reflected sunlight to meet the illumination requirements of an architectural space. Illumination requirements include both the quantitative (for example, amount and distribution) and qualitative (for example, well-being, visual, comfort, and health) aspects of daylight.

Fenestration creates a visual connection between the building interior and the outside world. It can control the amount and quality of daylight entering an interior environment of a building. In a daylighting design, fenestration purposely designed to transmit daylight into interior environments is often referred to as "daylight windows." Their size, shape, placement, and optical characteristics can control the quantity and quality of daylight entering an interior environment. Fenestration glazing designed for daylighting can also include various treatment to control the quality, distribution, or redirection of daylight.

Fenestration glazing can include surface treatment that redirects how daylight comes into the interior environment. This may be particularly helpful in both commercial and residential interior environments where daylight does not reach all portions of the rooms; for example, in a deep interior environment with windows or a curtain wall on only one side of the space. Recently, micro-optical structures, typically using prismatic shaped structures, are being applied to fenestration glazing to redirect daylight into the interior environment. Some manufacturers apply the micro-optical surfaces to a flexible sheet or film that can be applied to the glazing by adhesive. Many of these solutions are focused on both the redirection of daylight to improve the quality of light in a space and energy efficiency, as daylighting can be effective energy saving strategy.

SUMMARY

The inventors set out to provide a daylighting system that promotes the well-being, comfort, health, and productivity of building occupants. They believe that these benefits are as or more important than the energy-related benefits, and are often neglected because they are not easily quantifiable in terms of cost/benefit. The inventors identified the following problems related to building occupant well-being. First, glare and high contrast ratios from direct rays of the sun can cause visual discomfort. Second, non-uniform or uneven distribution of daylight can cause portions of the interior environment to be over lit while other areas are under lit. Third, over dependence on electric light even when an abundance of daylight is available wastes energy.

To address these problems, the inventors developed a mini-optical light shelf daylighting system that is the subject of U.S. Pat. No. 6,714,352 assigned to the applicant. The mini-optical light shelf daylighting system consisted of a series of horizontal reflective slats spaced uniformly vertically apart and implemented as fixed horizontal blinds. The mini-optical light shelf daylighting system redirects most specular rays of the sun at an upward angle greatly reducing glare and more uniformly illuminating the interior environment by redirecting light at a shallow angle to reflect off the ceiling deep into the room.

The inventors recognized that the mini-optical light shelf daylighting system because it resides inboard of the fenestration glazing, would reflect away some of the sunlight when the sun is high in the sky. This effect, known as the incident angle modifier effect, results in less of the available daylight entering the interior environment. In addition, while the mini-optical light shelf daylighting system in the form of a fixed horizontal blind is often convenient, the inventors recognized that it may also be desirable for cost and performance reasons to apply an optical redirecting system directly to the glazing surfaces.

To address these problems, the inventors developed a light-redirecting optical system that includes an outward-facing light-redirecting optical surface and an inward-facing light-redirecting surface. The outward-facing light-redirecting optical surface, includes a series of repeating projections called a collection optic that project outward into the exterior environment. The collection optic gathers daylight and redirects it inward. The inward-facing light-redirecting optical surface includes projections called a distribution optic that project into the interior environment. The distribution optic receives daylight from the collection optic and redirects it into the interior environment within a pre-determined range of angles. The collection optic and distribution optic are so shaped and structured such that the outward-facing surface has an acceptance angle with respect to the horizon between 0° and just under vertical (i.e. greater than 89°) without specular back reflection, the inward-facing surface has an exitance angle of specular rays at or above the horizon independent of incidence angle.

The inventors found that the collection optic, could include an arcuate portion that faces convexly downward and an upward-facing portion projecting acutely upward from the arcuate projection toward the vertical surface of the glazing. The arcuate portion is transparent. The upward-facing portion includes a transparent portion and a translucent portion. The transparent portion projects directly away from the vertex of the arcuate portion at an acute angle. The translucent portion projects directly way from the transparent portion toward the vertical surface of the glazing. The transparent portion and the translucent portion can lie in the same plane or form either an acute or obtuse angle with respect to each other.

The distribution optic includes saw-toothed projections with an upper portion extending away from the vertical surface of the glazing and a lower portion extending at an acute angle from the vertex of the upper portion and back toward the vertical surface of the glazing. The upper portion of the saw-toothed projection is translucent. The lower portion of the saw-toothed projection is transparent.

The light-redirecting optical surfaces can be fabricated on a film or flexible substrate that may be directly applied to glass, acrylic, or other glazing surfaces. For example, the collection optic and distribution optic can be cut, etched, or otherwise formed in an acrylate lacquer coating on the surface of a polyethylene terephthalate (PET) or a poly methyl methacrylate (PMMA) substrate. The PET or PMMA substrate can be applied to a glass or acrylic glazing panel by an adhesive layer; for example, a pressure sensitive or water activated adhesive. Alternatively, the light-redirecting optical surfaces may be fabricated directly on the glazing surfaces. For example, the light-redirecting optical surfaces can be cut, etched, molded, cold cast, embossed, or otherwise formed in a glass or acrylic panel or into a coating directly applied to a glass or acrylic panel.

While running simulations on the light-redirecting optical daylight system, the inventors found the following unexpected results. First, the inventors assumed that to achieve optimal optical performance, the collection optical film microstructure pattern would need to be aligned with the distribution optical film microstructure pattern. However, through parametric sensitivity analysis using a detailed optical simulation model, the inventors learned that the positioning as well as scale of the collection film microstructure pattern can be random relative to the distribution optical film and vice versa. Second, the inventors assumed that a high and uniform amount of diffusion would be needed in the "roughened" surface portions of the microstructure optical daylight system. However, through detailed simulation the inventors learned that only about a 5° spread of uniform diffusion is sufficient to achieve/maintain the overall desired optical performance of the microstructure optical daylight system. Third, the inventors assumed a very high index of refraction would be necessary to achieve the overall high levels of optimized performance desired. However, lower levels of index of refraction proved to provide enough refractive power for good optical performance. Fourth, the inventors assumed that the distance and the number of intermediate transparent glazing layers between the collection optical film to the distribution optical film would make a difference in the overall optical performance of the microstructure optical daylight system. However, using parametric sensitivity analysis with a detailed optical simulation tool, the inventors found negligible impact of varying the distance between the two films and in the number and variability of intermediate transparent glazing layers.

This Summary introduces a selection of concepts in simplified form that are described the Description. The Summary is not intended to identify essential features or limit the scope of the claimed subject matter.

DRAWINGS

DESCRIPTION

Figure 1:
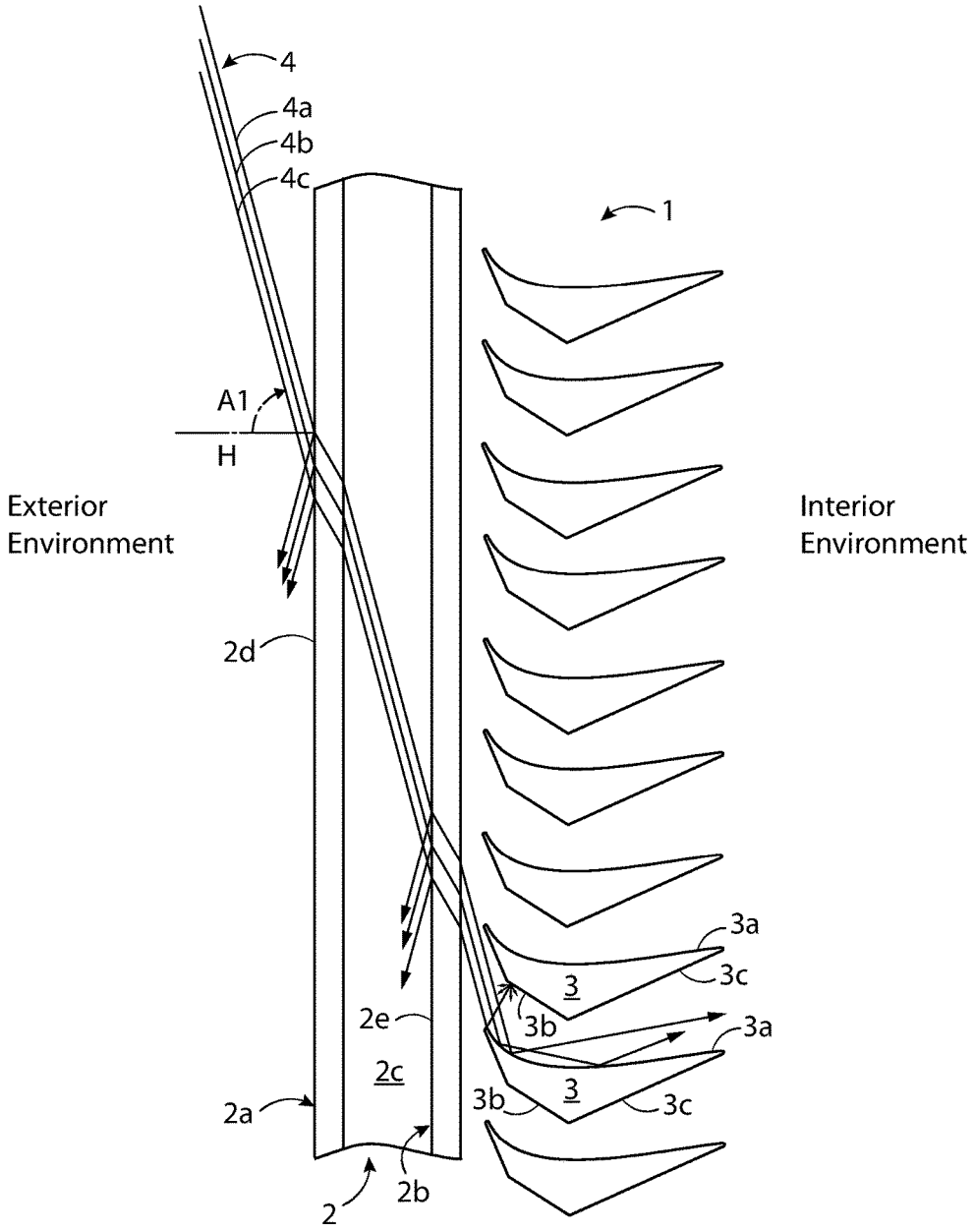
FIG. 1 PRIOR ART
FIG. 1 illustrates an interior-mounted mini-optical light shelf system in the prior art.

The terms "left," "right," "top, "bottom," "upper," "lower," "front," "back," and "side," are relative terms used throughout this disclosure to help the reader understand the figures. Unless otherwise indicated, these do not denote absolute direction or orientation and do not imply a particular preference. Specific dimensions are intended to help the reader understand the scale and advantage of the disclosed material. Dimensions given are typical and the claimed invention is not limited to the recited dimensions.

The following terms are used throughout this disclosure and are defined here for clarity and convenience.

Collection Optic: As defined in this disclosure, a collection optic is a surface or structure with substructures designed to redirect, in a controlled manner, incoming daylight.

Daylight: As defined in this disclosure, daylight refers to light that originates from the sun and arrives on the surface of the earth as either direct, diffuse, or reflected light.

Diffuse: As defined in this disclosure, diffuse refers to scattering or softening of light, i.e. a dispersed distribution of light.

Distribution Optic: As defined in this disclosure, a distribution optic is a surface or structure with substructures designed to redirect in a controlled manner light received from the collection optic into an interior environment.

Fenestration: As defined in this disclosure, fenestration refers to an opening in a building facade connecting the building interior with the outdoor environment. A fenestration can include, for example, a door, window, curtain wall, storefront window or clerestory window. A fenestration glazing can include glazing infill such as glass, acrylic or other transparent or translucent material.

Incidence Angle Modifier Effect: As defined in this disclosure, the incidence angle modifier effect refers to the effect of an increasing reflection off an otherwise transparent surface as the angle of incidence increases with respect to the horizon as described by Fresnel equations.

Insulated Glass Unit: As defined in this disclosure, an insulated glass unit (IGU) is a transparent infill structure that includes two or more panes of glass or other transparent material, separated by a spacer, with the interior environment between the panes filed with a gas, such as air or argon, or alternatively a vacuum, to provide thermal insulation.

Microstructure: As defined in this disclosure, a microstructure refers to a structure that is sized in the sub-millimeter range; for example, a collection optic with a projection depth in hundreds of micrometers (microns) or even less would be a microstructure.

Specular Light: As defined in this disclosure, specular light is light that represents either directly transmitted, refracted or reflected rays of light. In contrast, diffuse light is scattered light and not specular.

Translucency: As defined in this disclosure, translucency is the property where the light passing through a medium is scattered or diffused (i.e. light passing through the medium does not follow Snell's law).

Transparency: As defined in this disclosure, transparency is the property where daylight passing through the medium follows the Fresnel equations including Snell's law.

Throughout this disclosure, exitance photometric plots are used to demonstrate system performance, including those of the prior art. Each exitance photometric plot shows relative luminous intensity versus exitance angle with respect to the horizon for solar incidence angles with respect to the horizon either for angles between 5°-85° taken at 5° increments or for a specific angle (for example, 25°, 50°, or 75°) as indicated for each figure description. The 0° represents the horizon. The positive angles represent an upward direction. The negative angles represent a downward direction. The luminous intensity plots include a combination specular and diffuse light. The polar circles are scaled linearly. For example, in FIG. 17, a portion of luminous intensity plot 35*a* crossing the fourth circle 35*b* would have four times the luminous intensity as the portion of the luminous intensity plot crossing the first circle 35*c*. These plots as well as the more complex ray tracing diagrams are based on optical model simulations using the optical design software TracePro by Lamba Research Corporation.

The following description is made with reference to figures, where like numerals refer to like elements throughout the several views.

The inventors set out to develop a daylighting system that is focused on the well-being, visual comfort, health, and productivity of building occupants. They believe that these benefits can be as or more important than energy-related benefits, and are often neglected because they are not easily quantifiable in terms of cost/benefit. The inventors identified the following problems related to building occupant well-being. First, glare and high contrast ratios from direct rays of the sun can cause visual discomfort. Second, uneven distribution of daylight can cause non-uniform distribution of lighting levels. as a result, daylight can light portions of the building interior while leaving deep interior portions without daylight. Uneven daylight distribution can cause excessive hot spots of light and heavily contrasting shadows in an area within the building interior as the angle of the sunlight changes throughout the day. Third, over dependence on electric light can waste energy when an abundance of daylight is available.

To address these problems, the inventors developed a mini-optical light shelf daylighting system 1 illustrated in FIG. 1. This is the subject of U.S. Pat. No. 6,714,352 assigned to the applicant. FIG. 1 shows a ray-trace diagram of a version of the mini-optical light shelf daylighting system 1, as a fixed horizontal element as it is typically implemented, in combination with an IGU 2. The mini-optical light shelf daylighting system 1 is positioned vertically adjacent to the IGU 2 within the interior environment. The IGU 2 can include a first glass panel 2*a*, a second glass panel 2*b*, and an insulating space 2*c* between the first glass panel 2*a* and the second glass panel 2*b*. The insulating space 2*c* is typically filled with air or an inert gas, for example, argon or krypton. The mini-optical light shelf daylighting system 1 can include a series of reflective slats 3 that run horizontally and are spaced vertically apart. Each of the reflective slats 3 includes a reflecting curve 3*a*, a shading curve 3*b*, and a redirecting slope 3*c*. Incoming specular daylight 4 is illustrated in part as specular rays 4*a*, 4*b*, 4*c*. The reflecting curve 3*a* reflects and redirects specular daylight upward that has an incidence angle A1 above the horizon H. This is illustrated, by example, as specular rays 4*a*, 4*b*, 4*c*. The shading curve 3*b* is typically a light absorbing surface that is primarily designed to shade low altitude daylight by a combination of absorption and reflective diffusion. For example, the light absorbing surface can be designed to shade low altitude daylight with an incident angle A1 between 0° and approximately 35° above the horizon H. In FIG. 1, for example, the shading curve 3*b* absorbs and reflectively diffuses a portion of the specular ray 4*c* after being reflected by reflecting curve 3*a*. The redirecting slope 3*c* is positioned and sloped to redirect rays reflected from a reflecting curve 3*a* the reflective slat 3 positioned adjacently below. This helps to control the system exitance angle.

Figure 2:
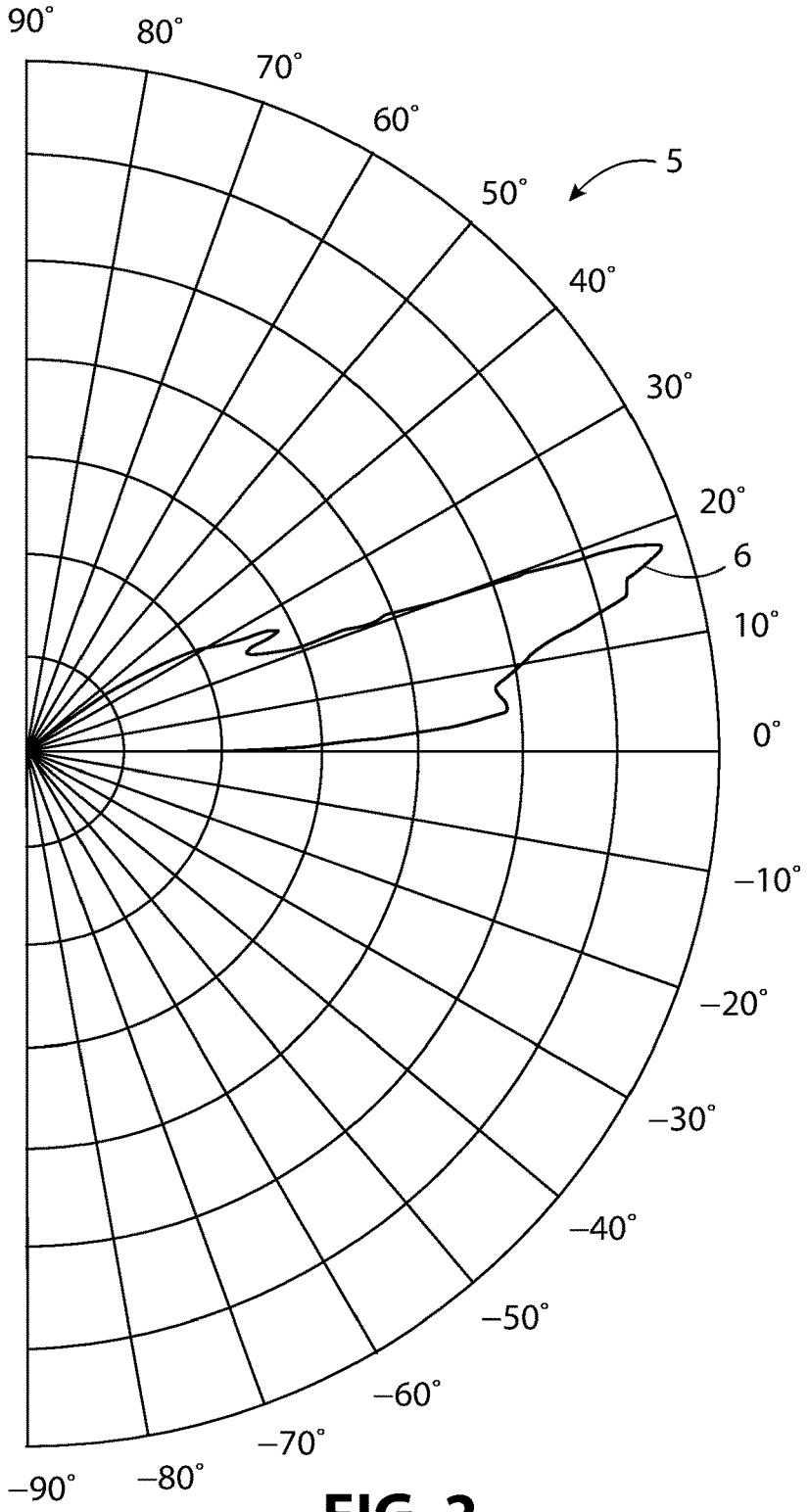
FIG. 2 PRIOR ART
FIG. 2 illustrates an exitance photometric plot of the mini-optical light shelf system of FIG. 1.

Thanks to the structural combination described above, the mini-optical light shelf daylighting system 1 of FIG. 1 directs most specular rays of the sun upward greatly reducing glare and more evenly illuminating the interior environment by bouncing light off the ceiling deep into the room. To help illustrate this, FIG. 2 shows an exitance photometric plot 5 of the mini-optical light shelf daylighting system 1 of FIG. 1. The exitance photometric plot 5 shows relative luminous intensity versus exitance angle with respect to the horizon H for solar incidence angles between 5°-85°. Referring to FIG. 2, the luminous intensity plot 6 shows all the light exiting the system between 0°-40° independent of incidence angle for incidence angles between 5°-85°.

Referring to FIG. 1, one of the challenges with the mini-optical light shelf daylighting system 1 is when the sun is high in the sky, some of the light that would otherwise enter the interior environment is reflected away from the outward-facing surfaces of the IGU 2. This results in less of the available daylight entering the interior environment. To illustrate this effect, in FIG. 1 the incident angle A1 is 75° with respect to the horizon H. Portions of specular rays 4*a*, 4*b*, 4*c* are shown reflecting away from the outside surface 2*d* of first glass panel 2*a*, and the inside surface 2*e* of the second glass panel 2*b* toward the exterior environment. As defined earlier in this disclosure, this effect of an increasing reflection off an otherwise transparent surface as the angle of incidence increases with respect to the horizon H and described by Fresnel equations is referred to as the incident angle modifier effect.

Figure 3:
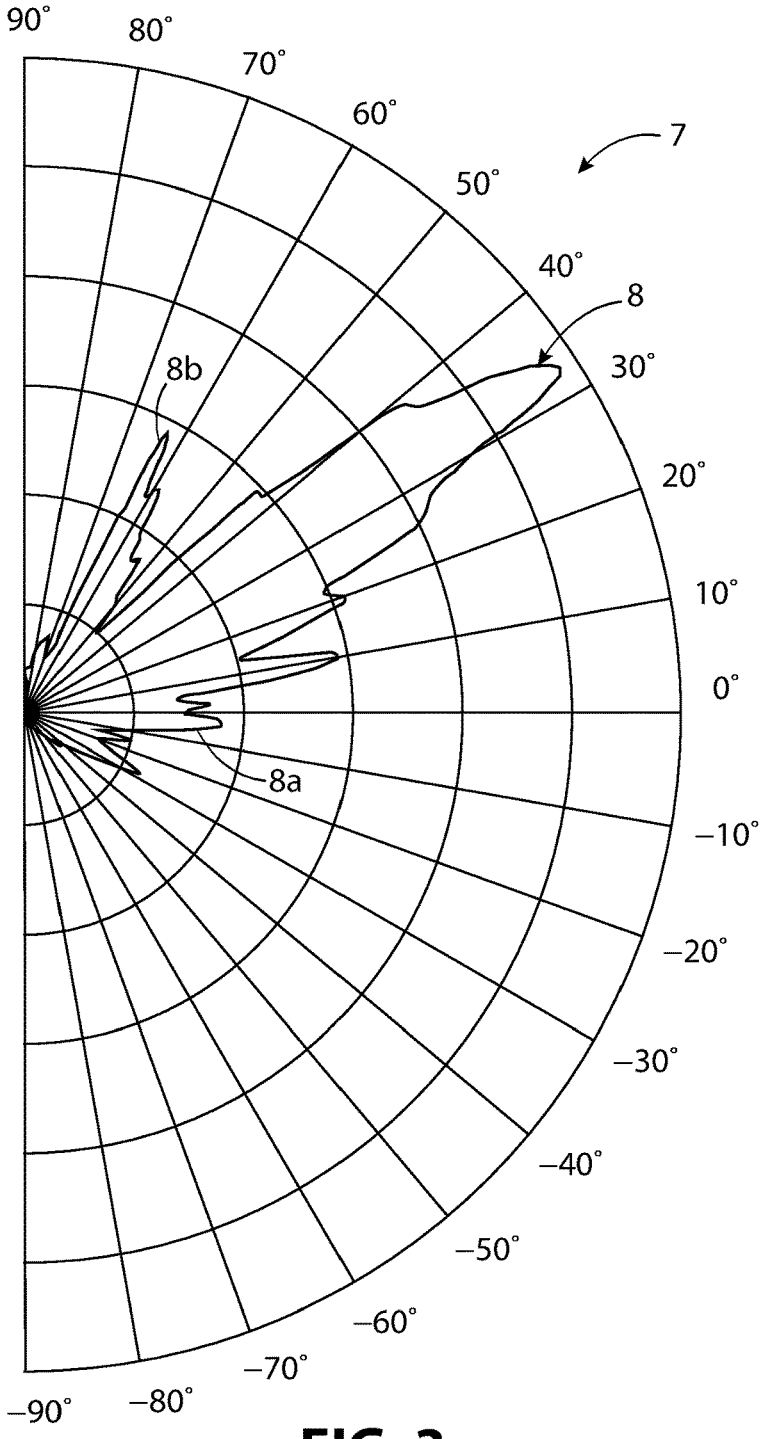
FIG. 3 PRIOR ART
FIG. 3 illustrates an exitance photometric plot of a typical light-redirecting optical film in the prior art.

While the mini-optical light shelf daylighting system 1 of FIG. 1, in the form of a fixed blind is often convenient, the inventors recognized that it may also be desirable to apply an optical redirecting system directly to the glazing surfaces. Microstructure optical redirecting systems exist in the art, however, from the inventors' vantage point, these systems do not solve the incident angle modifier problem, do not direct all the specular rays with an incident angle from 5°-85° to an exitance angle above the horizon, and do not direct a significant portion of the daylight deep into the interior environment. As an example, FIG. 3 shows a photometric plot 7 of relative luminous intensity vs. angle, of a micro-optic film structure in the prior art. Nearly all the luminous intensity of this system is from specular rays. The luminous intensity plot 8 shows that some of the light 8*a* exiting the system, which are mostly specular rays, projecting downward between 0°-50°. This can create glare on interior surfaces and directly in the eyes of the occupants within the building interior. In addition, some of the light 8*b* exiting the system projects upward at angles between 50°-80° which has the potential to create undesirable "hot spots" of light on the ceiling close to the fenestration. As shown in FIG. 13B, this microstructure optical system does not directly address the incidence angle modifier problem as the transmittance tapers off at the highest incidence angles.

To solve these problems, the inventors developed a light-redirecting optical system 10 represented in three instructive embodiments illustrated in ray-trace diagrams in FIGS. 18, 20, 22, 26, 28, 30, 32-34, 37, 39, and 41 and discussed in detail for FIGS. 4-46. In all three of these embodiments, all the specular rays exiting the system are at or above the horizon for incidence angles between 5°-85° with respect to the horizon. The first embodiment includes a collection optic 14 of FIG. 14 and a distribution optic 15 of FIG. 16. The second embodiment includes the collection optic 14 of FIG. 24 and the distribution optic 15 of FIG. 15. The third embodiment includes the collection optic 14 of FIG. 35 and the distribution optic 15 of FIG. 15. While these examples are instructive, the reader should not interpret the light-redirecting optical system 10 being limited to these embodiments. The inventors envision a wide range of variations that will become apparent to the reader by the examples and embodiments discussed in the remainder of this disclosure.

Figure 16:
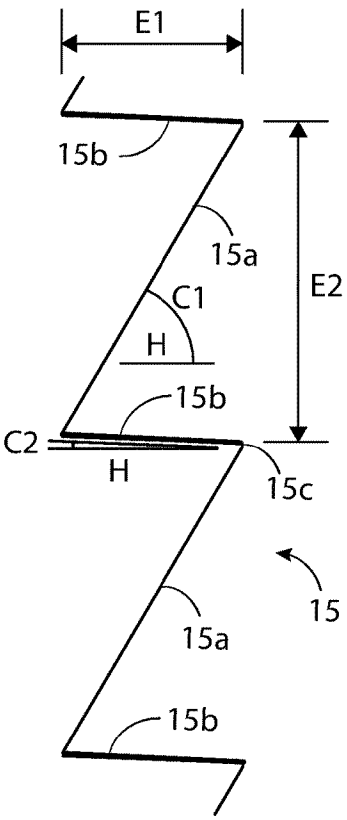
FIG. 16 illustrates the geometry a second example of a distribution optic.
Figure 17:
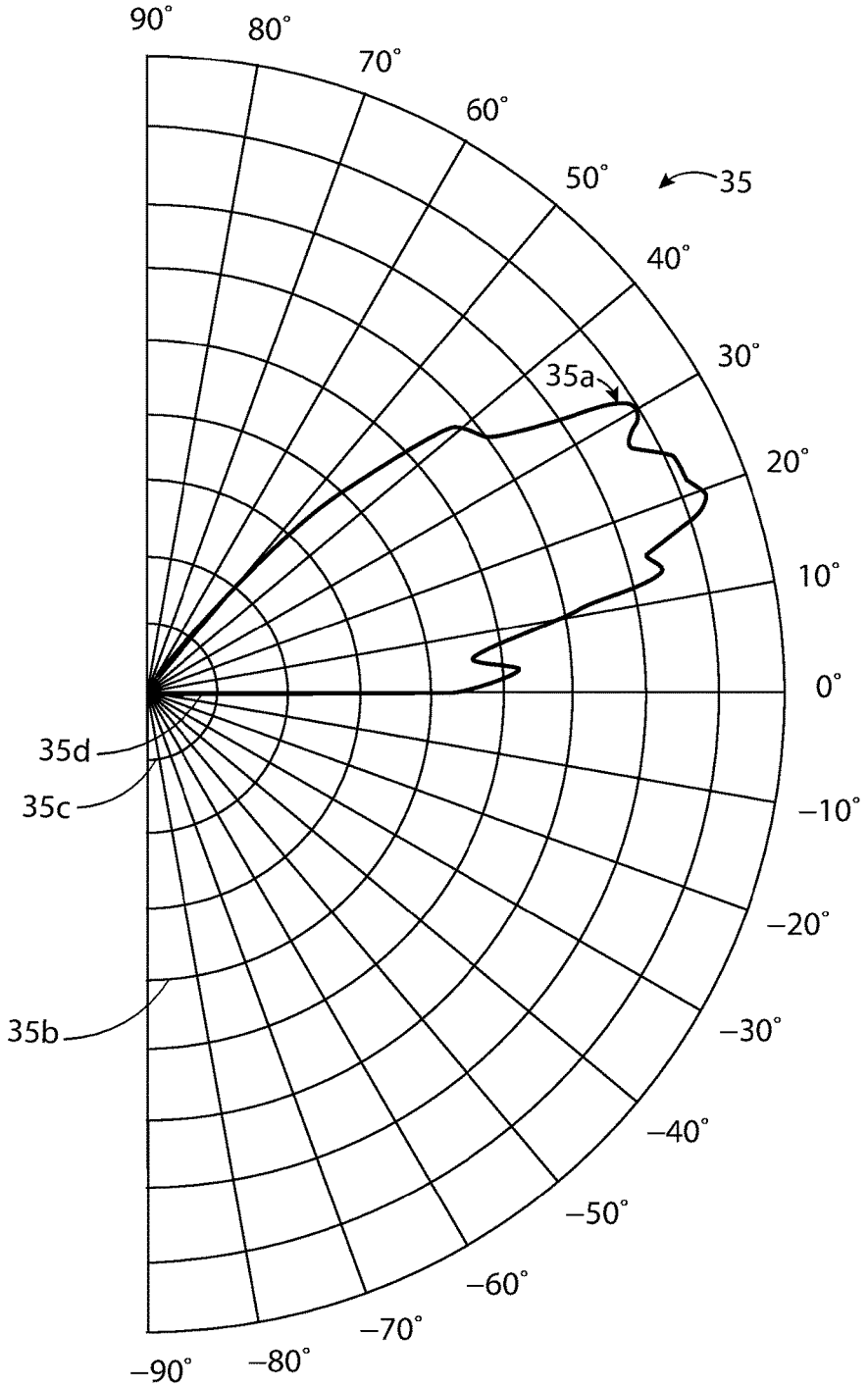
FIG. 17 illustrates a photometric plot of light exiting the distribution optic of FIG. 16 for incidence angles with respect to the horizon, of daylight striking the collection optic of FIG. 14 between 5°-85°.
Figure 18:
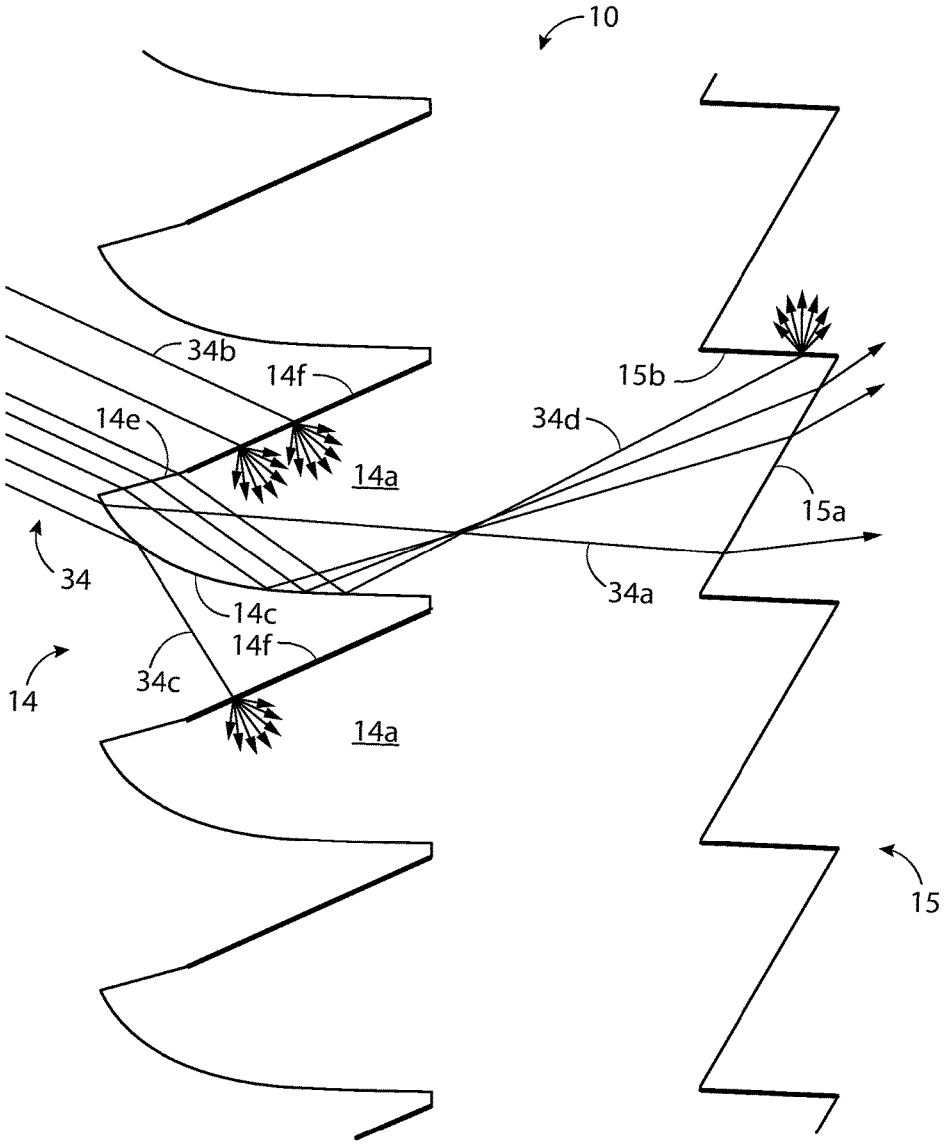
FIG. 18 illustrates a simplified ray-trace diagram of 25° incident light striking the collection optic of FIG. 14 and exiting through the distribution optic of FIG. 16.
Figure 19:
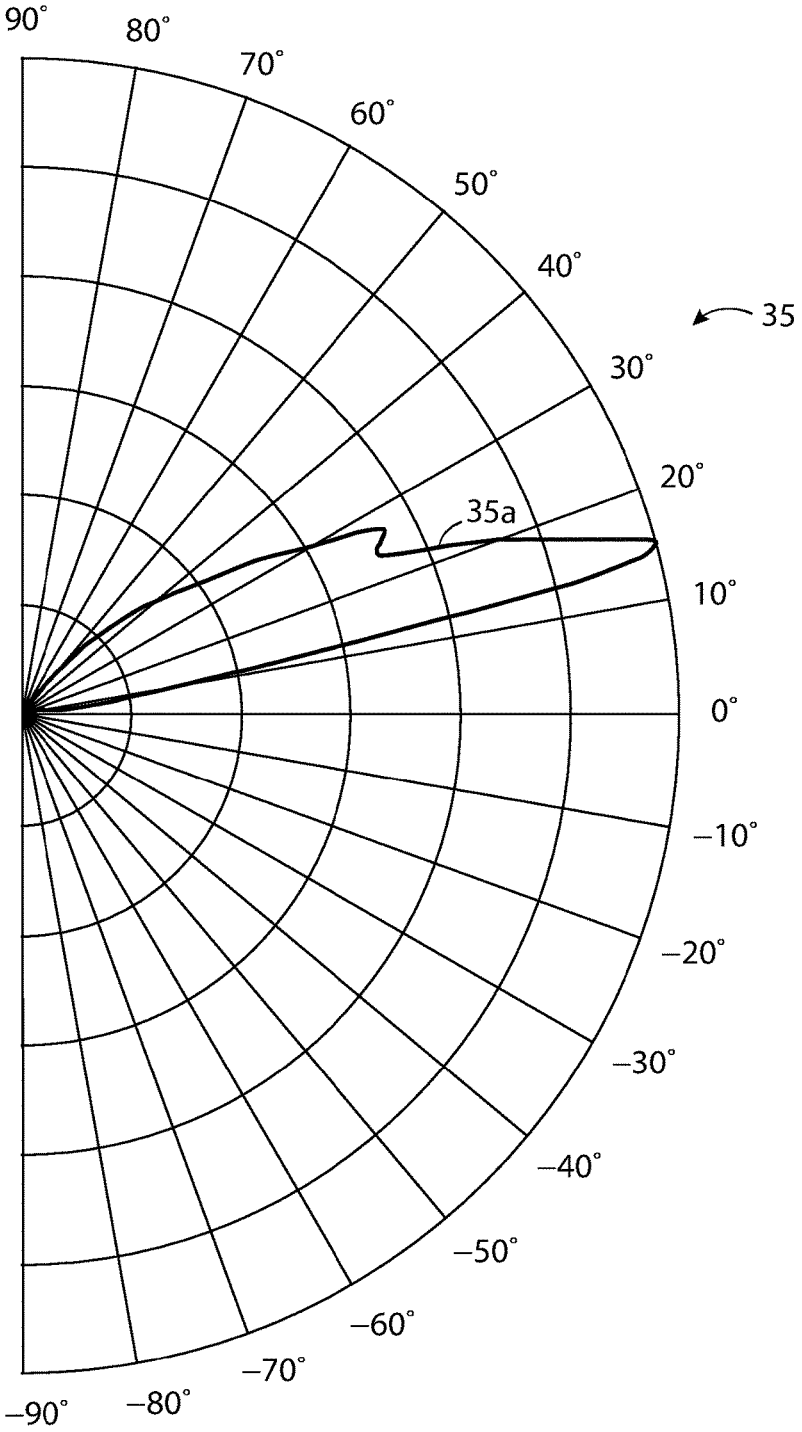
FIG. 19 illustrates a resulting exitance photometric plot for FIG. 18.
Figure 20:
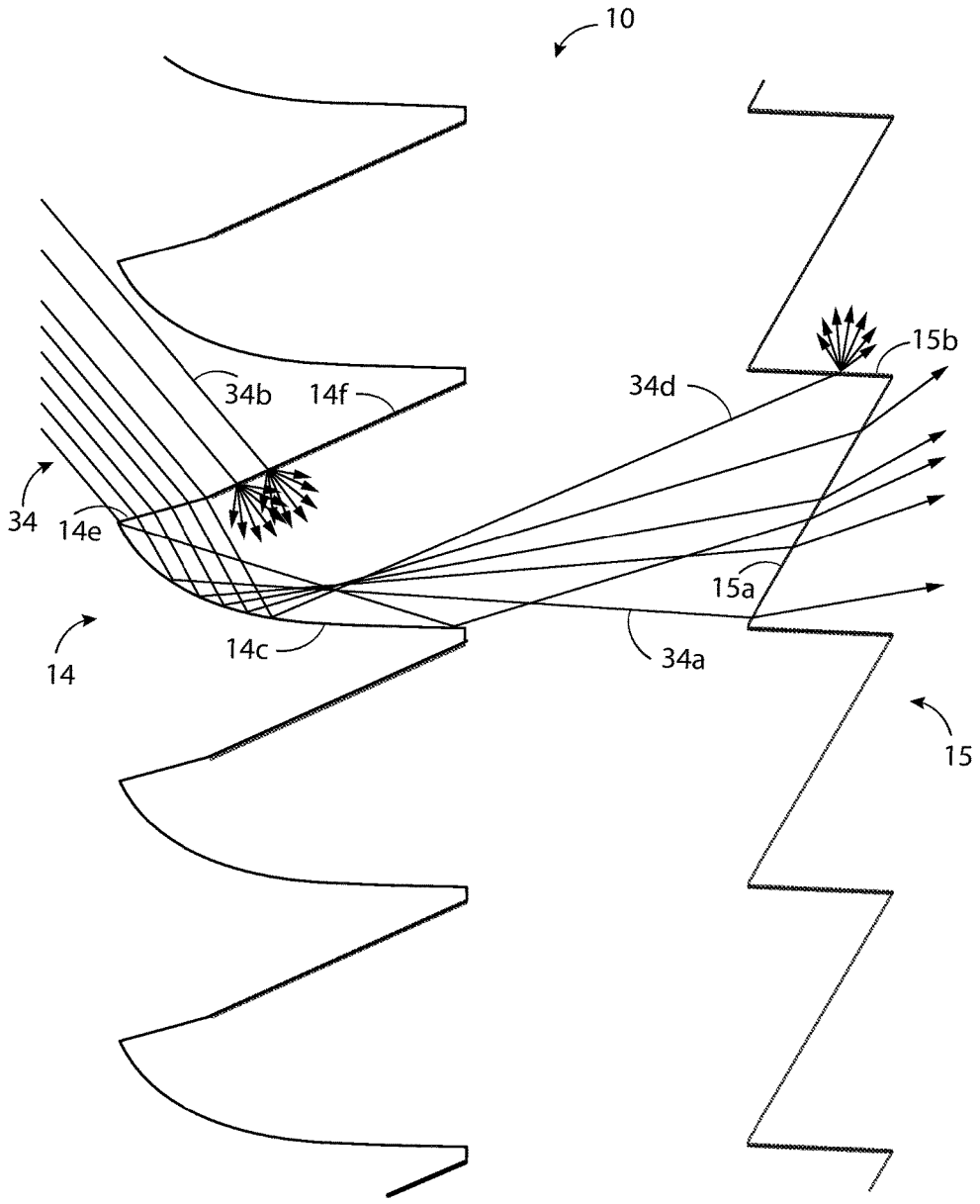
FIG. 20 illustrates a simplified ray-trace diagram of 50° incident light striking the collection optic of FIG. 14 and exiting through the distribution optic of FIG. 16.
Figure 21:
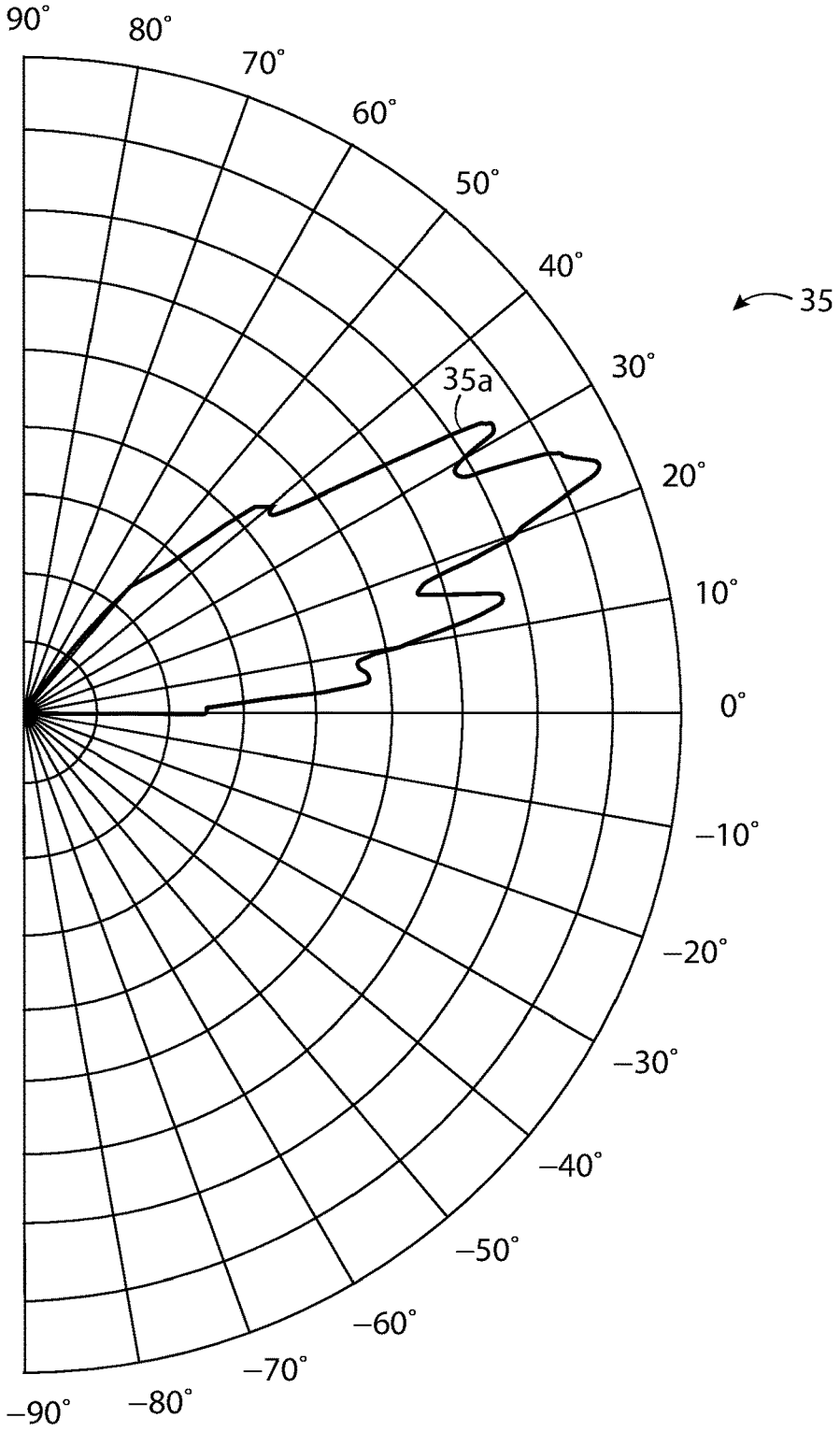
FIG. 21 illustrates a resulting exitance photometric plot for FIG. 20.
Figure 22:
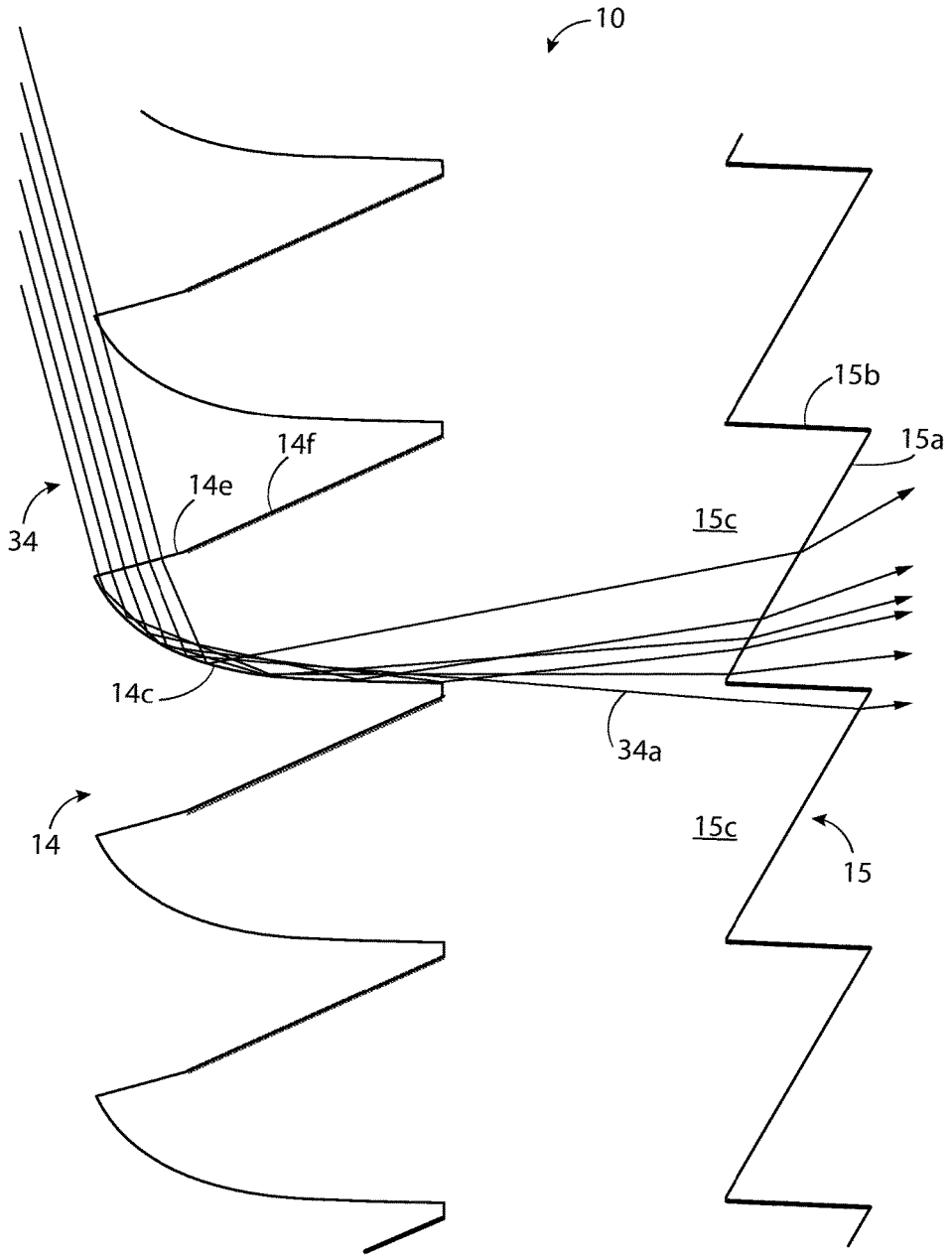
FIG. 22 illustrates a simplified ray-trace diagram of 75° incident light striking the collection optic of FIG. 14 and exiting through the distribution optic of FIG. 16.
Figure 23:
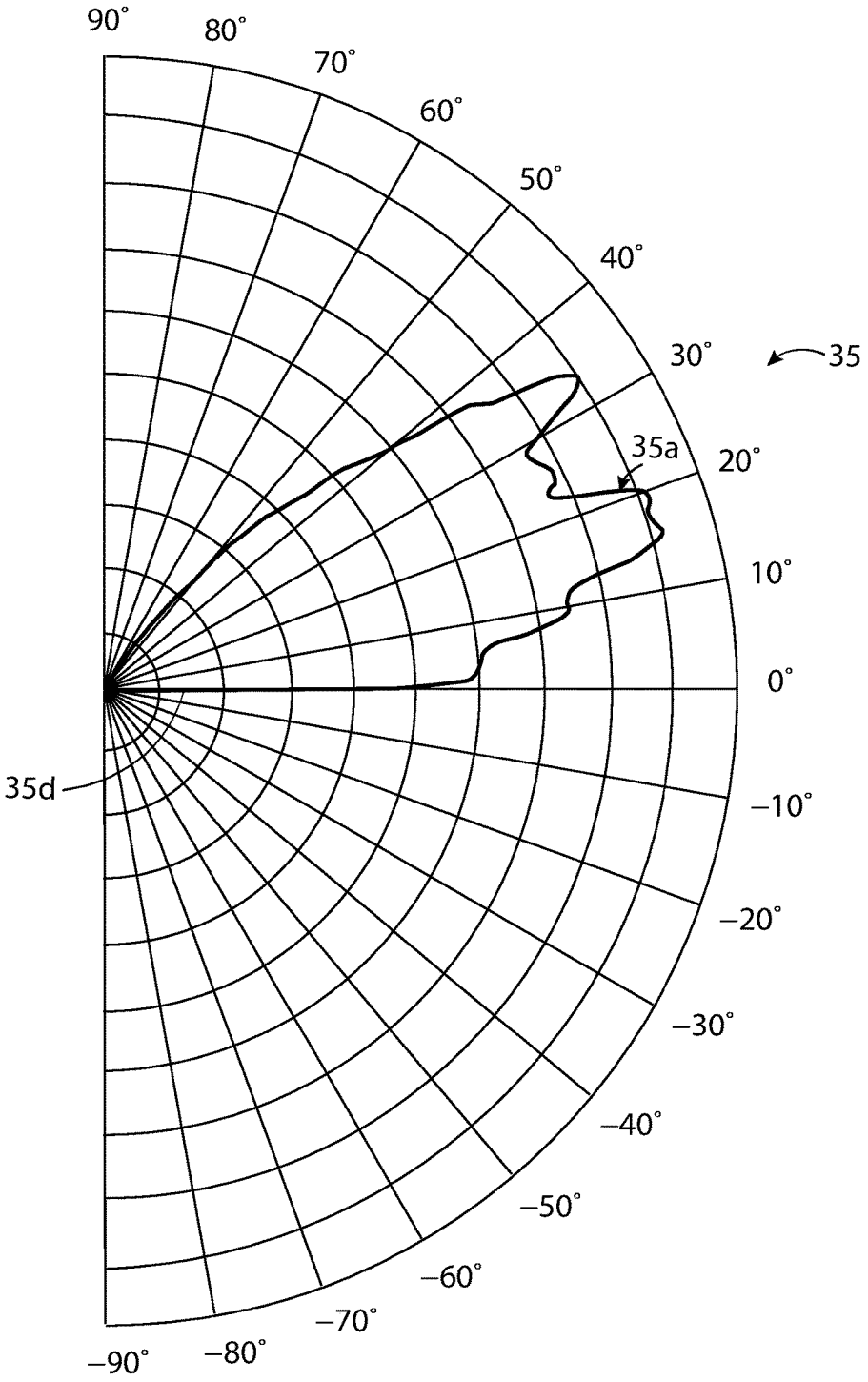
FIG. 23 illustrates a resulting exitance photometric plot for FIG. 22.

The construction of collection optic 14 of the first embodiment is illustrated in FIGS. 5, 14, 18, 20, and 22 and is discussed for FIGS. 14-22. The distribution optic 15 used in the first embodiment is discussed for FIG. 16. FIG. 17 shows an exitance photometric plot 35 representing incidence angles with respect to the horizon from 5°-85° for the combination of the collection optic 14 of FIG. 14 and the distribution optic 15 of FIG. 16 of the first embodiment. FIGS. 18, 20, and 22 illustrate simplified ray-trace diagrams with incidence angles with respect to the horizon of 25°, 50°, and 75° for the first embodiment. FIGS. 19, 21, and 23 are exitance photometric plots 35 corresponding to FIGS. 18, 20, and 22, respectively.

Figure 15:
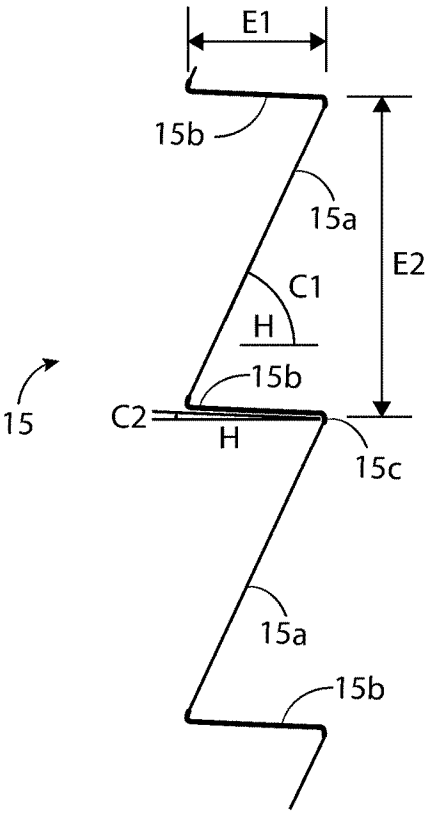
FIG. 15 illustrates the geometry of a typical distribution optic used in the light-redirecting optical system.
Figure 24:
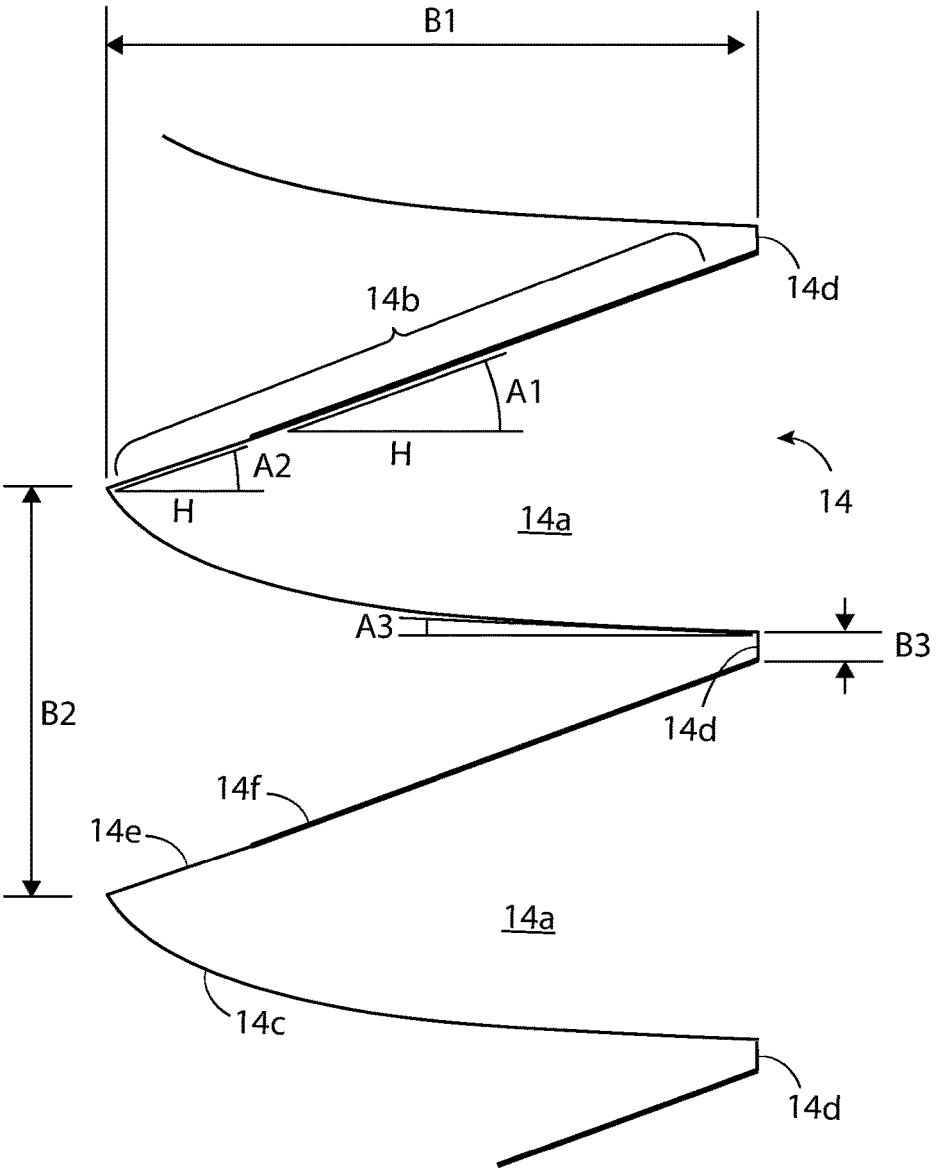
FIG. 24 illustrates the geometry of a second example of a collection optic.
Figure 25:
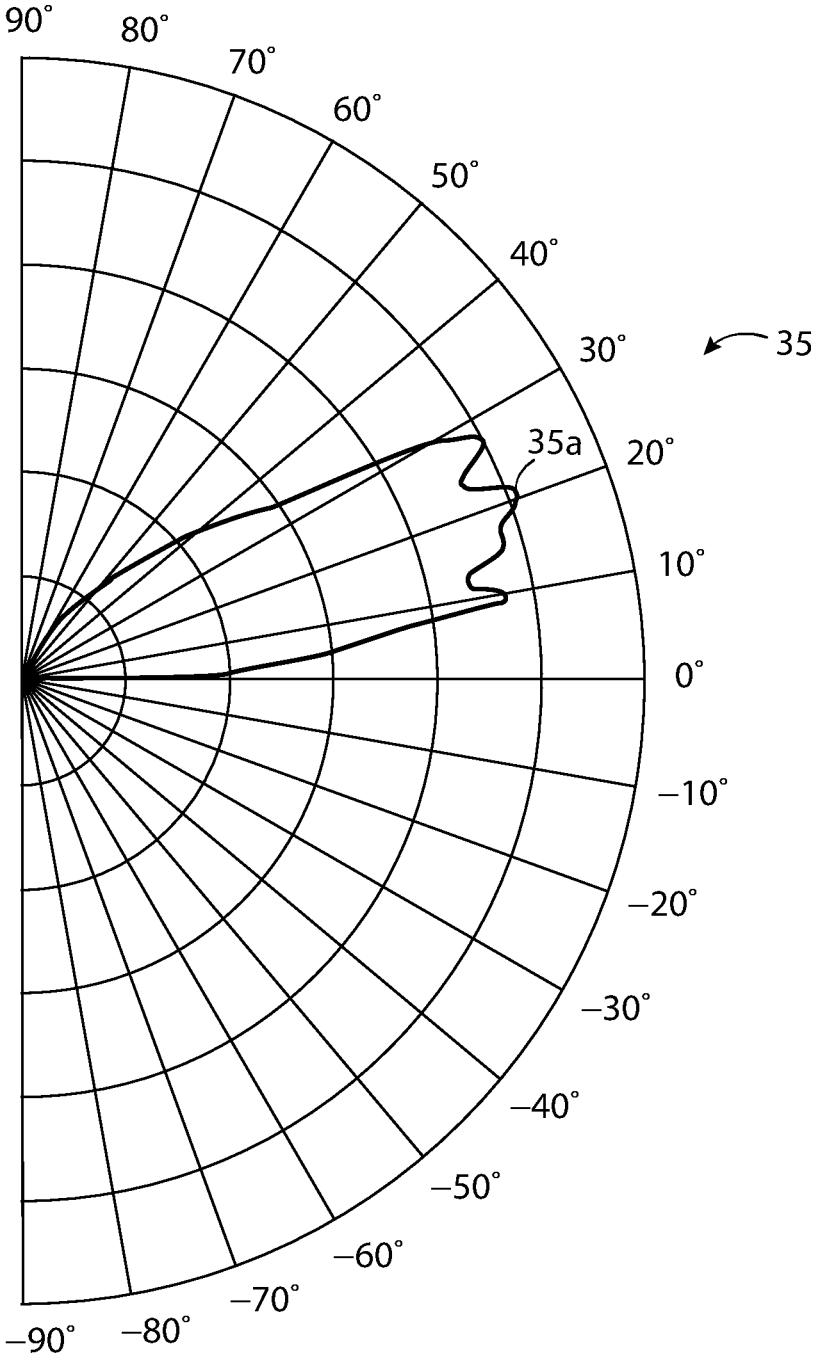
FIG. 25 illustrates a photometric plot of light exiting the distribution optic of FIG. 15 for incidence angles with respect to the horizon, of daylight striking the collection optic of FIG. 24 between 5°-85°.
Figure 26:
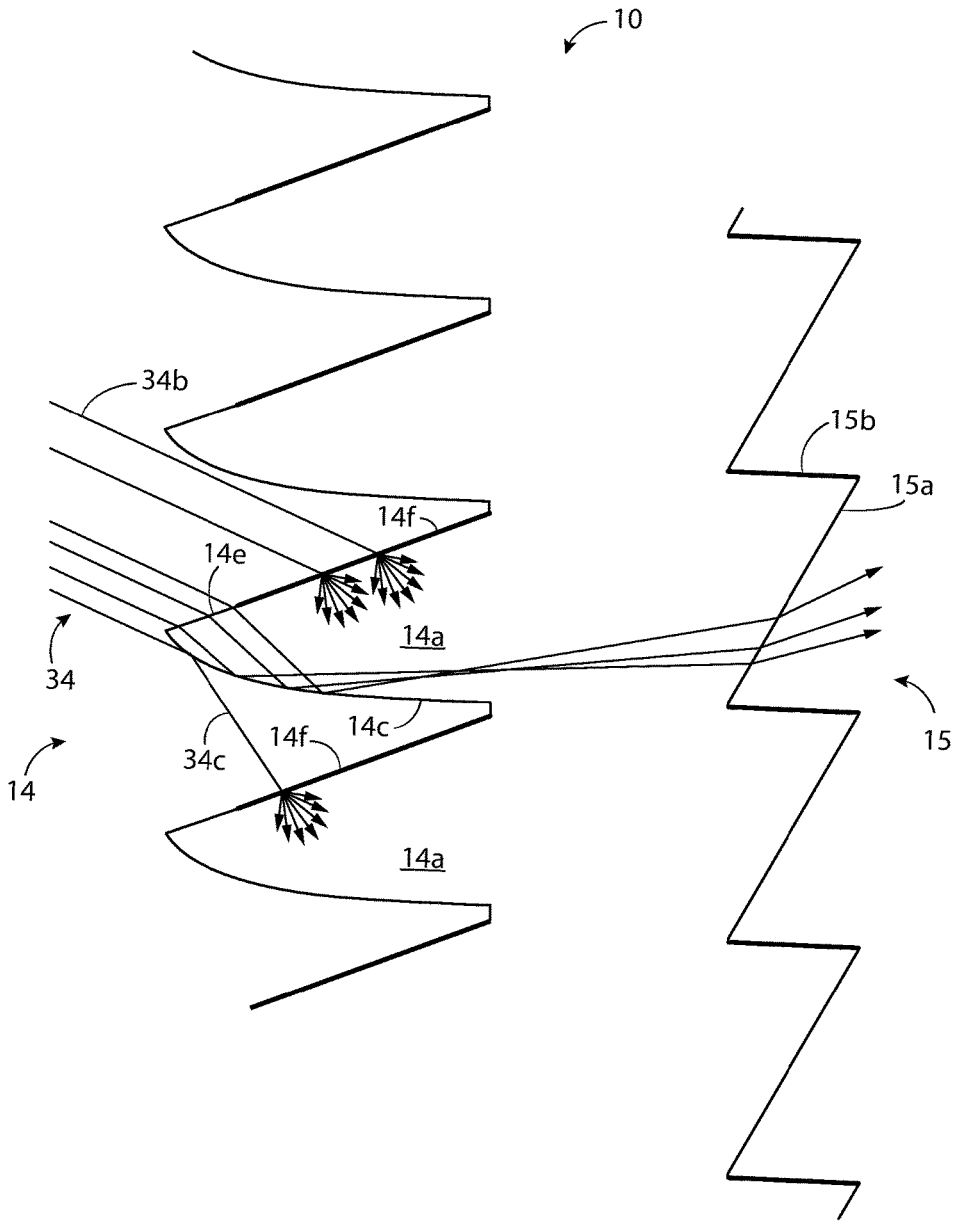
FIG. 26 illustrates a simplified ray-trace diagram of 25° incident light striking the collection optic of FIG. 24 and exiting through the distribution optic of FIG. 15.
Figure 27:
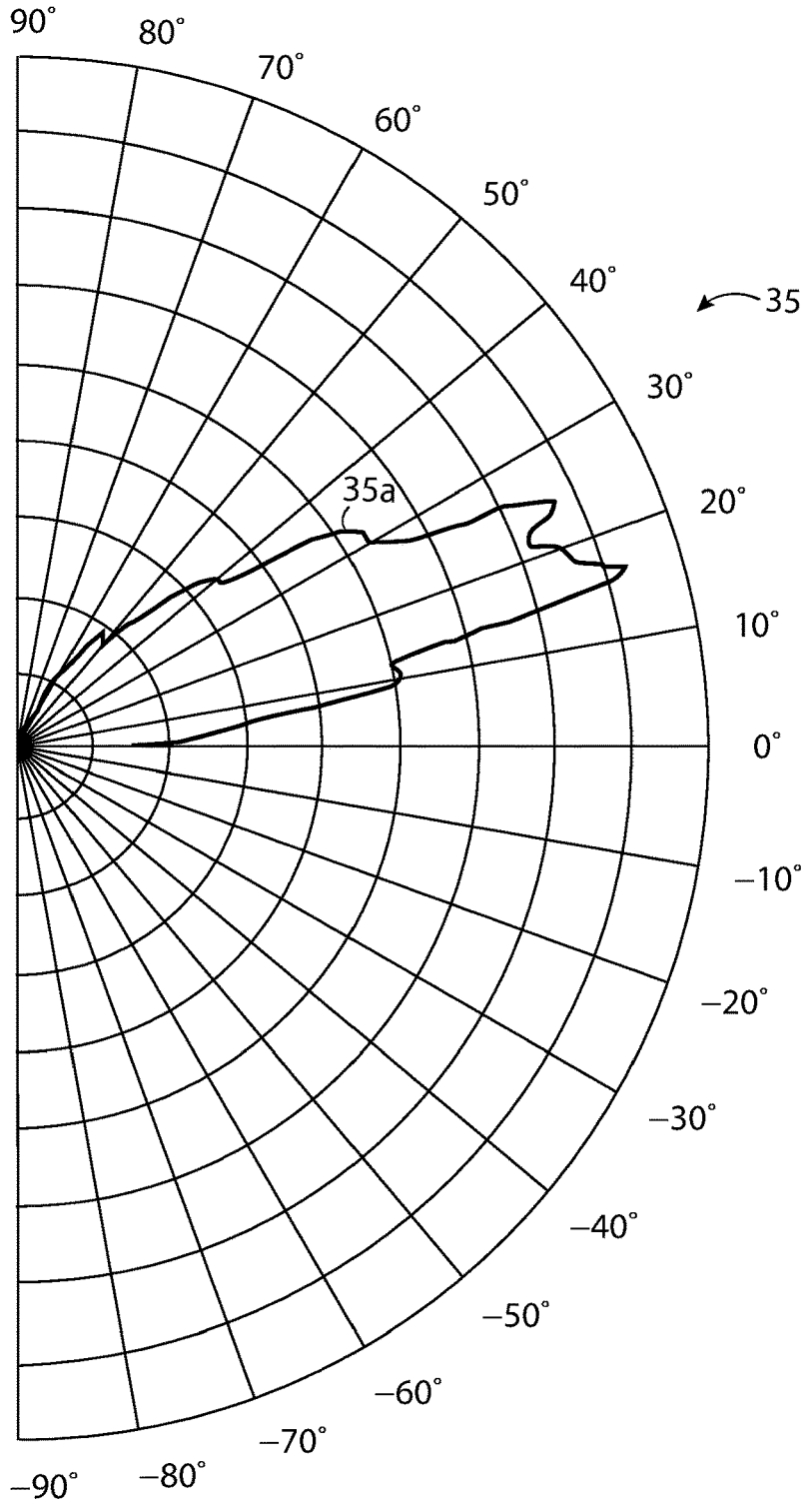
FIG. 27 illustrates a resulting exitance photometric plot for FIG. 26.
Figure 28:
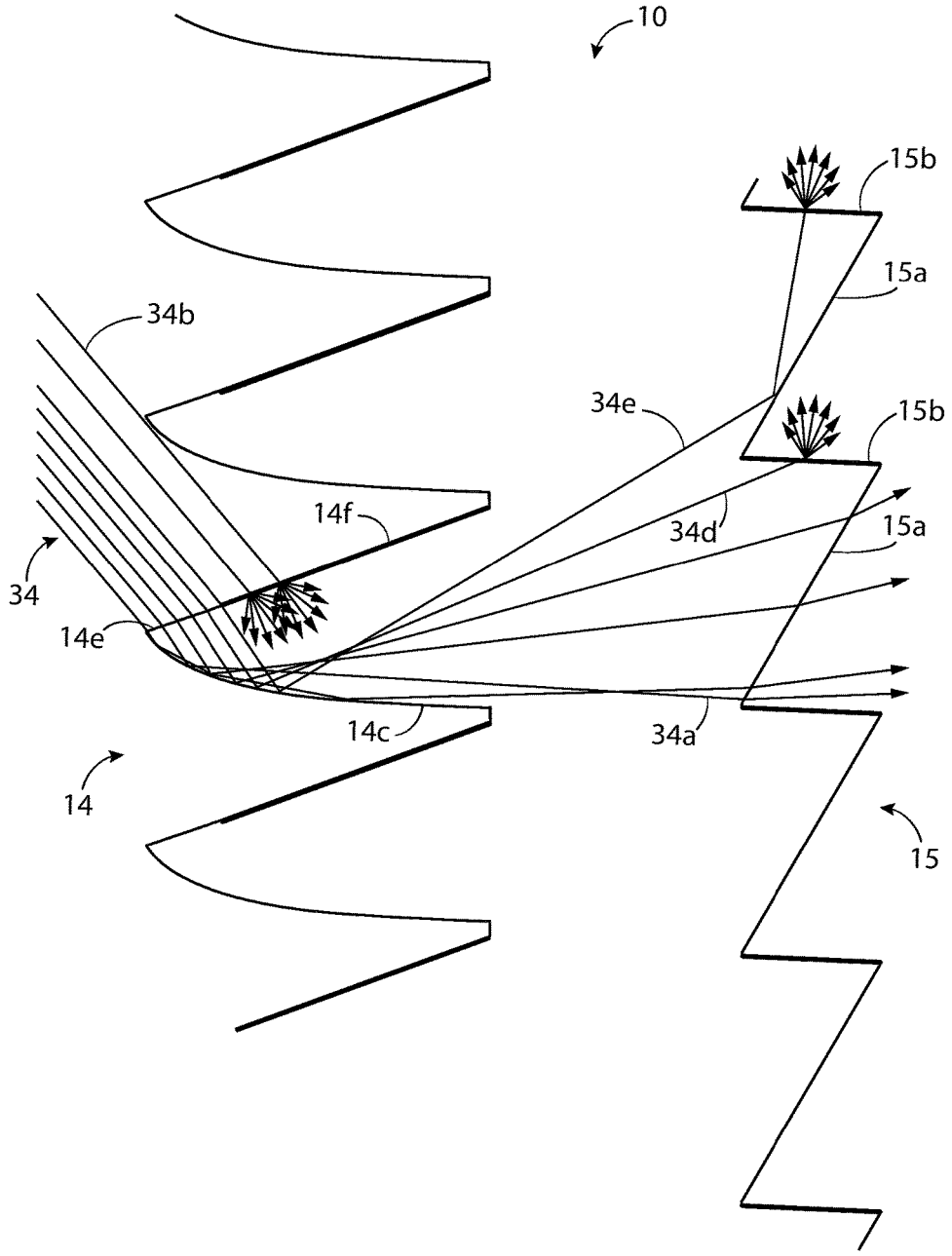
FIG. 28 illustrates a simplified ray-trace diagram of 50° incident light striking the collection optic of FIG. 24 and exiting through the distribution optic of FIG. 15.
Figure 29:
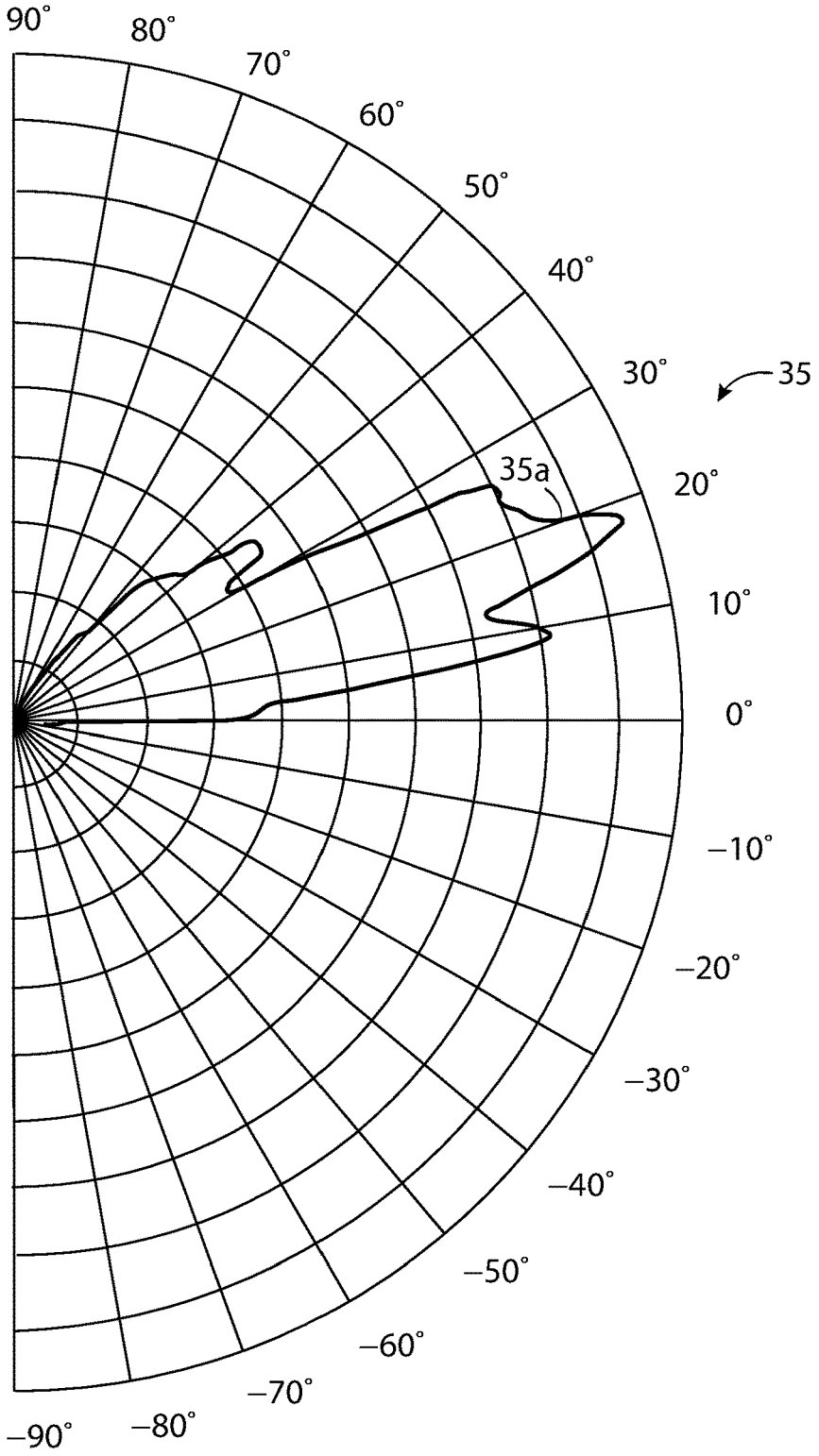
FIG. 29 illustrates a resulting exitance photometric plot for FIG. 28.
Figure 30:
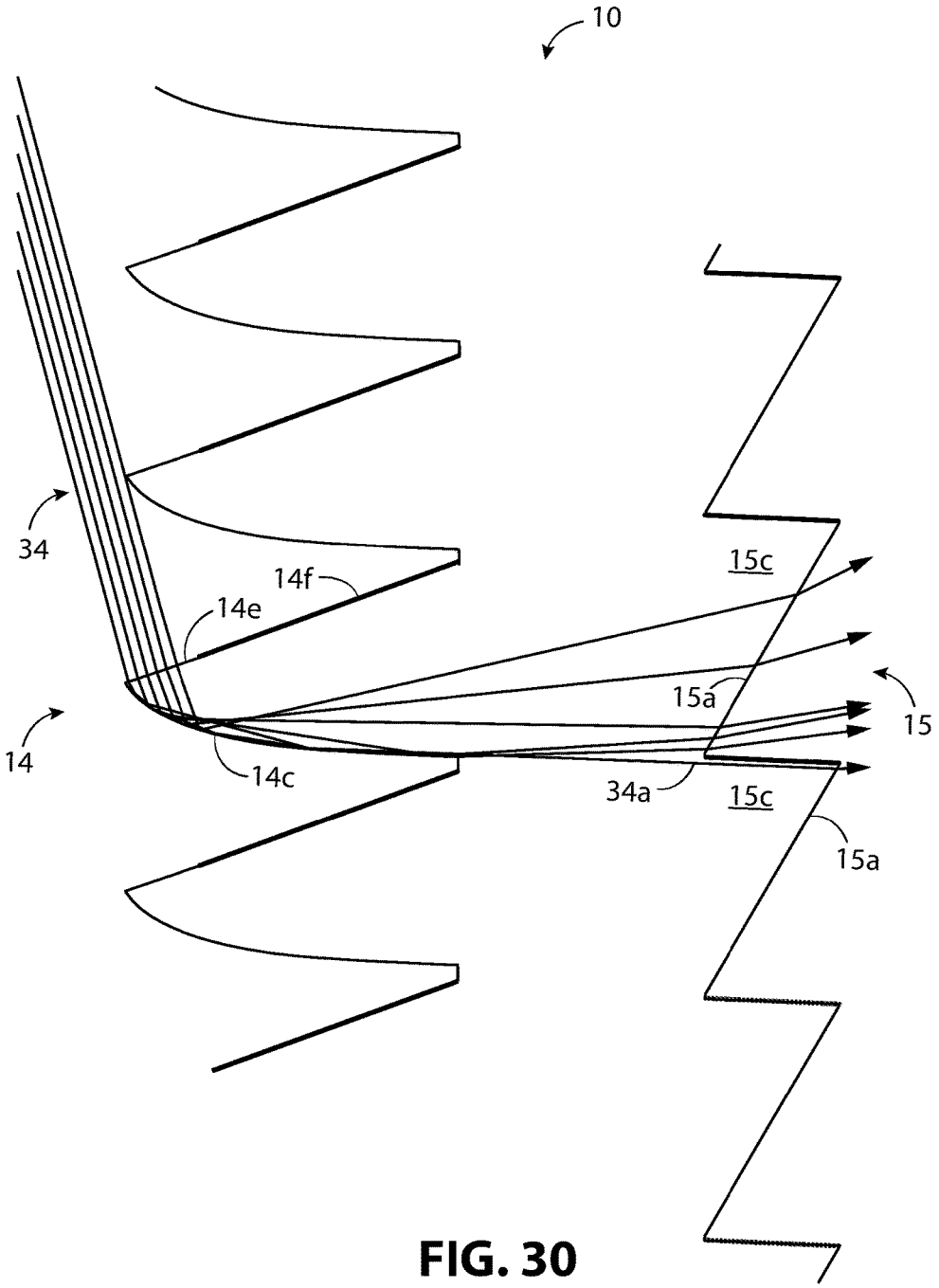
FIG. 30 illustrates a simplified ray-trace diagram of 75° incident light striking the collection optic of FIG. 24 and exiting through the distribution optic of FIG. 15.
Figure 31:
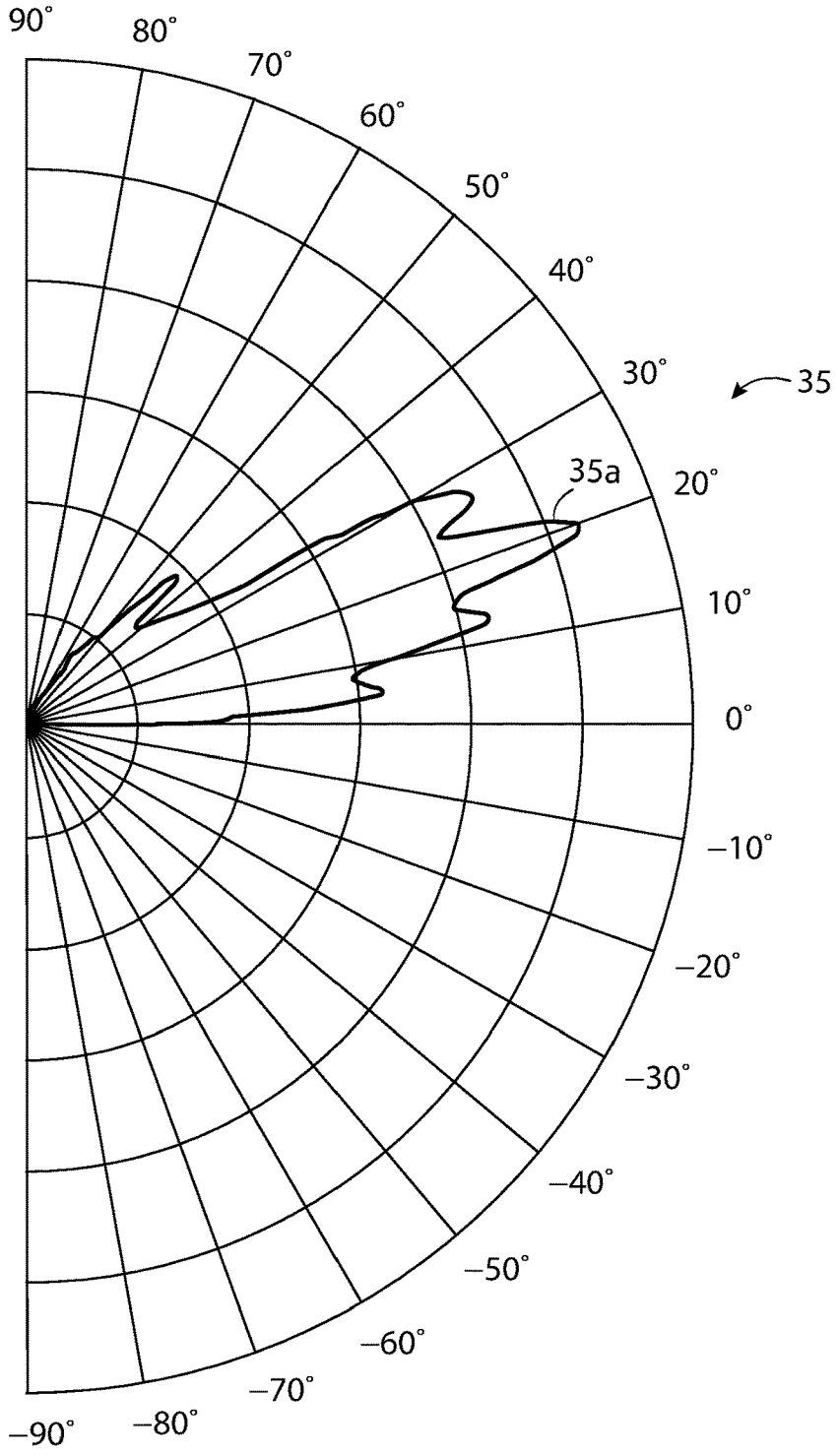
FIG. 31 illustrates a resulting exitance photometric plot for FIG. 30.
Figure 32:
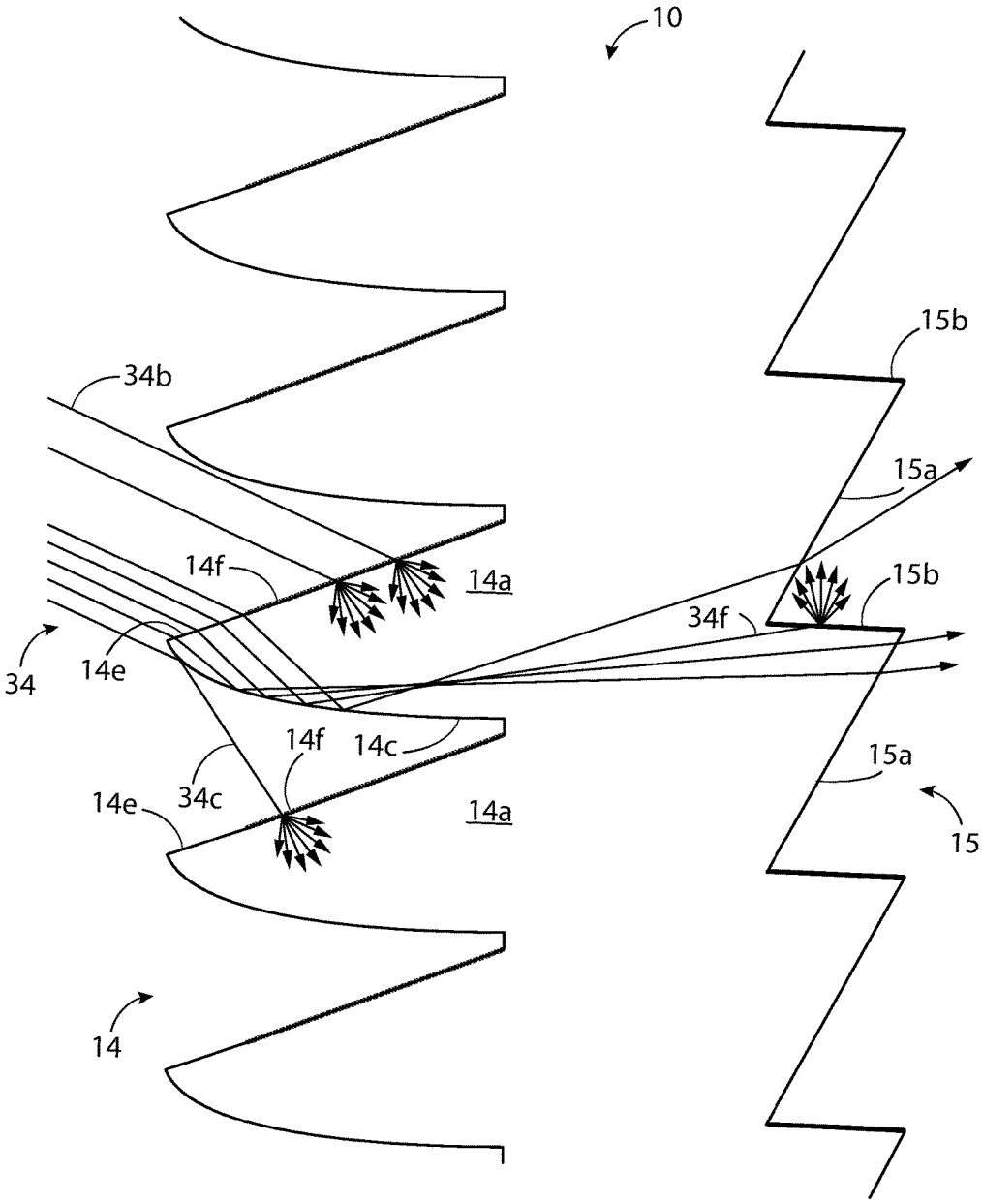
FIG. 32 illustrates a simplified ray-trace diagram of 25° incident light striking the collection optic of FIG. 24 and exiting through the distribution optic of FIG. 9 with the distribution optic vertically offset from its position in FIG. 26.
Figure 33:
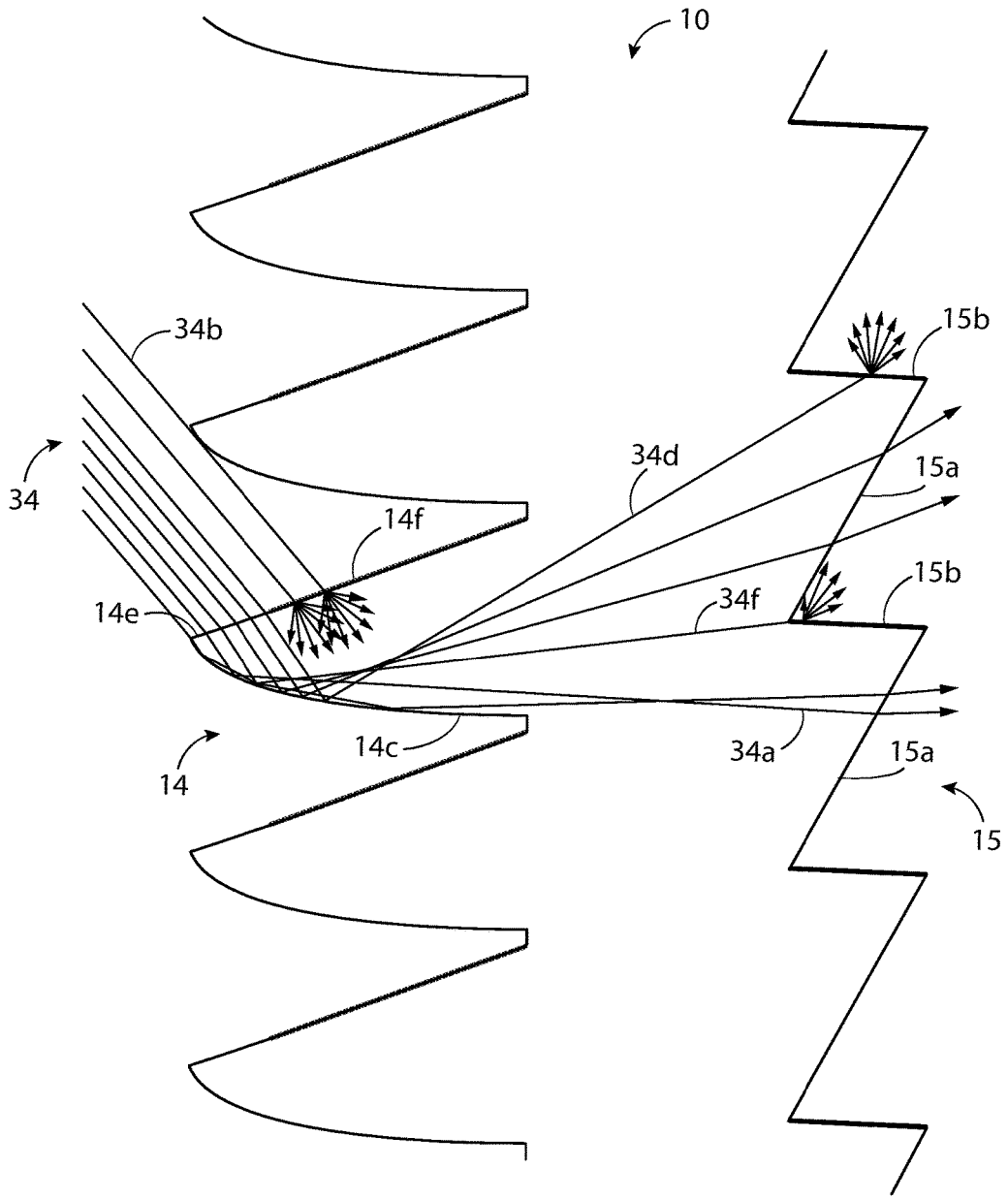
FIG. 33 illustrates a simplified ray-trace diagram of 50° incident light striking the collection optic of FIG. 24 and exiting through the distribution optic of FIG. 9 with the distribution optic vertically offset from its position in FIG. 28.
Figure 34:
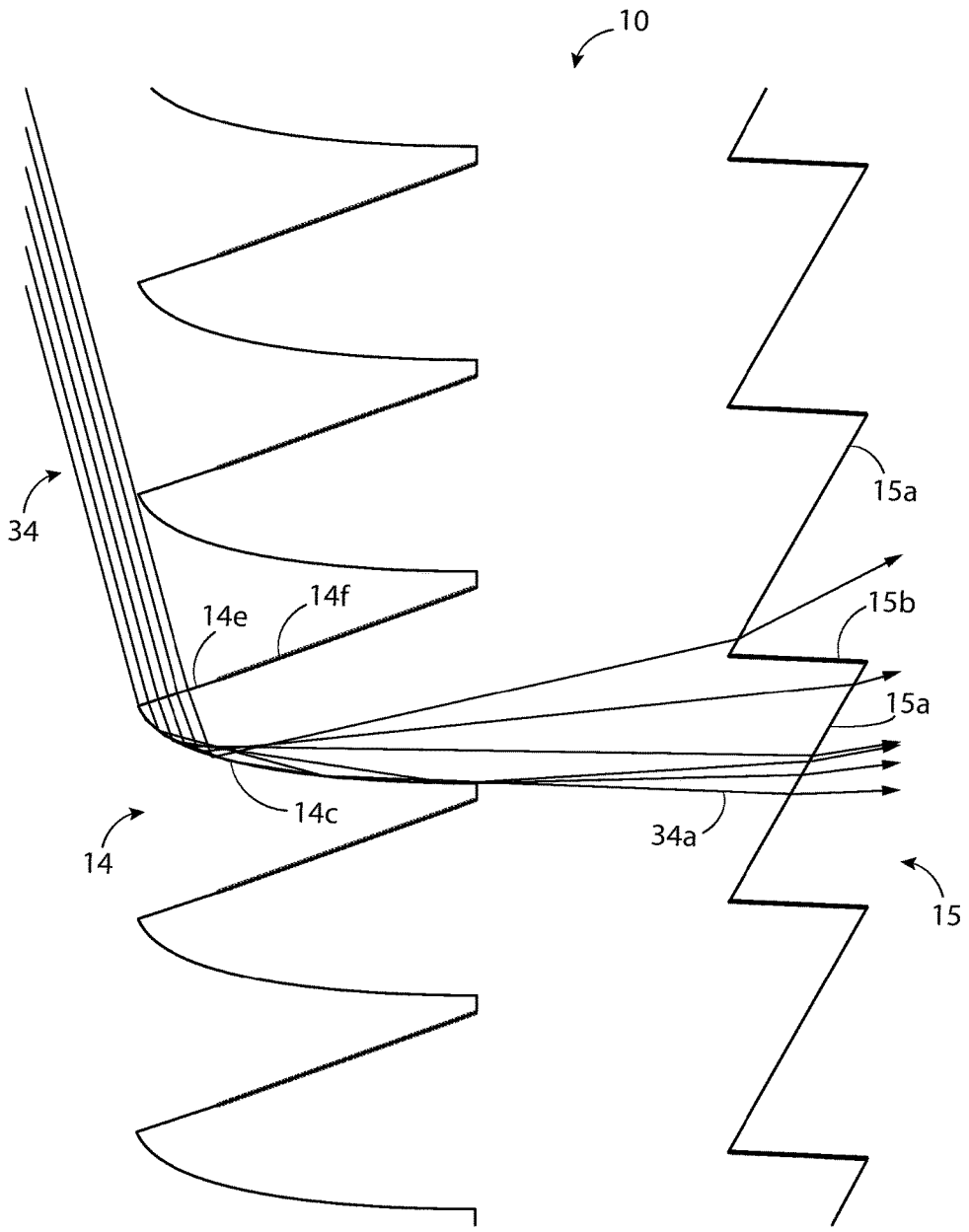
FIG. 34 illustrates a simplified ray-trace diagram of 75° incident light striking the collection optic of FIG. 12 and exiting through the distribution optic of FIG. 9 with the distribution optic vertically offset from its position in FIG. 30.

The construction of collection optic 14 of the second embodiment is discussed in FIGS. 24-34. FIG. 24 illustrates the collection optic 14. The corresponding distribution optic 15 is shown in FIG. 15. FIG. 25 shows an exitance photometric plot 35 representing incidence angles with respect to the horizon from 5°-85° for the second embodiment. FIGS. 26, 28, and 30 illustrate simplified ray-trace diagrams with incidence angles with respect to the horizon of 25°, 50°, and 75° respectively. FIGS. 27, 29, and 31 are exitance photometric plots 35 corresponding to FIGS. 26, 28, and 30, respectively One of the unexpected results and desirable benefits of the three illustrated embodiments of the light-redirecting optical system 10 is that collection optic and distribution optic can be vertically offset without significantly affecting performance. This is demonstrated in the 25°, 50°, and 75° ray-trace diagrams for the second embodiment in FIGS. 32, 33, and 34 respectively.

Figure 35:
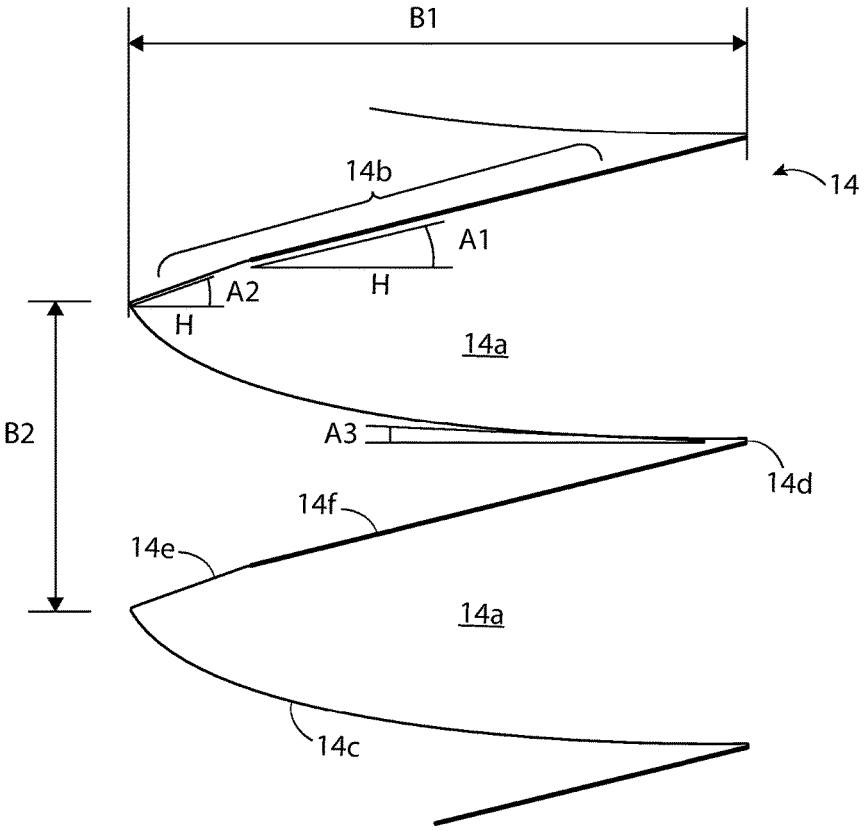
FIG. 35 illustrates the geometry of a third example of a collection optic.
Figure 36:
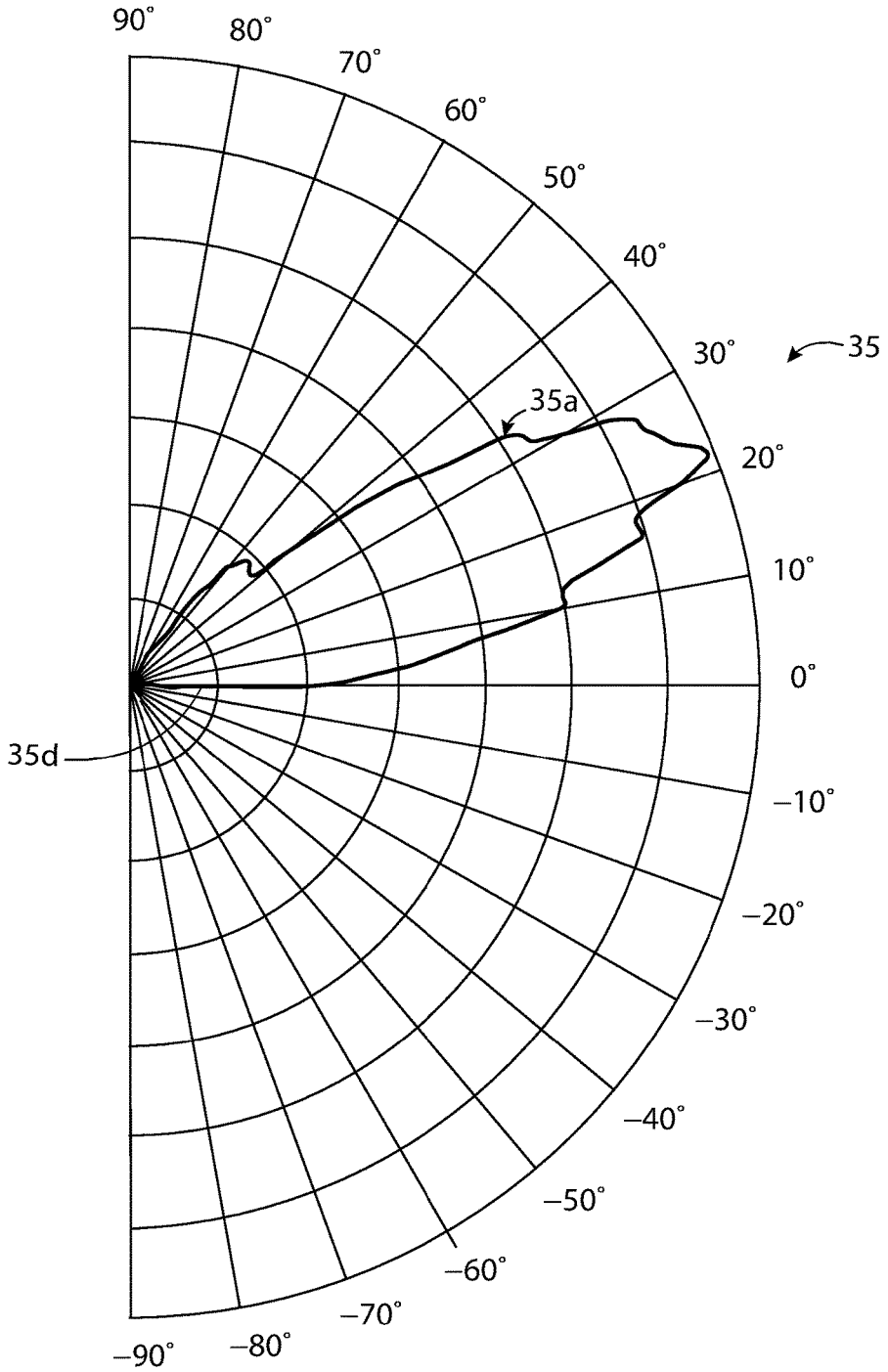
FIG. 36 illustrates a photometric plot of light exiting the distribution optic of FIG. 15 for incidence angles with respect to the horizon, of daylight striking the collection optic of FIG. 35 between 5°-85°.
Figure 37:
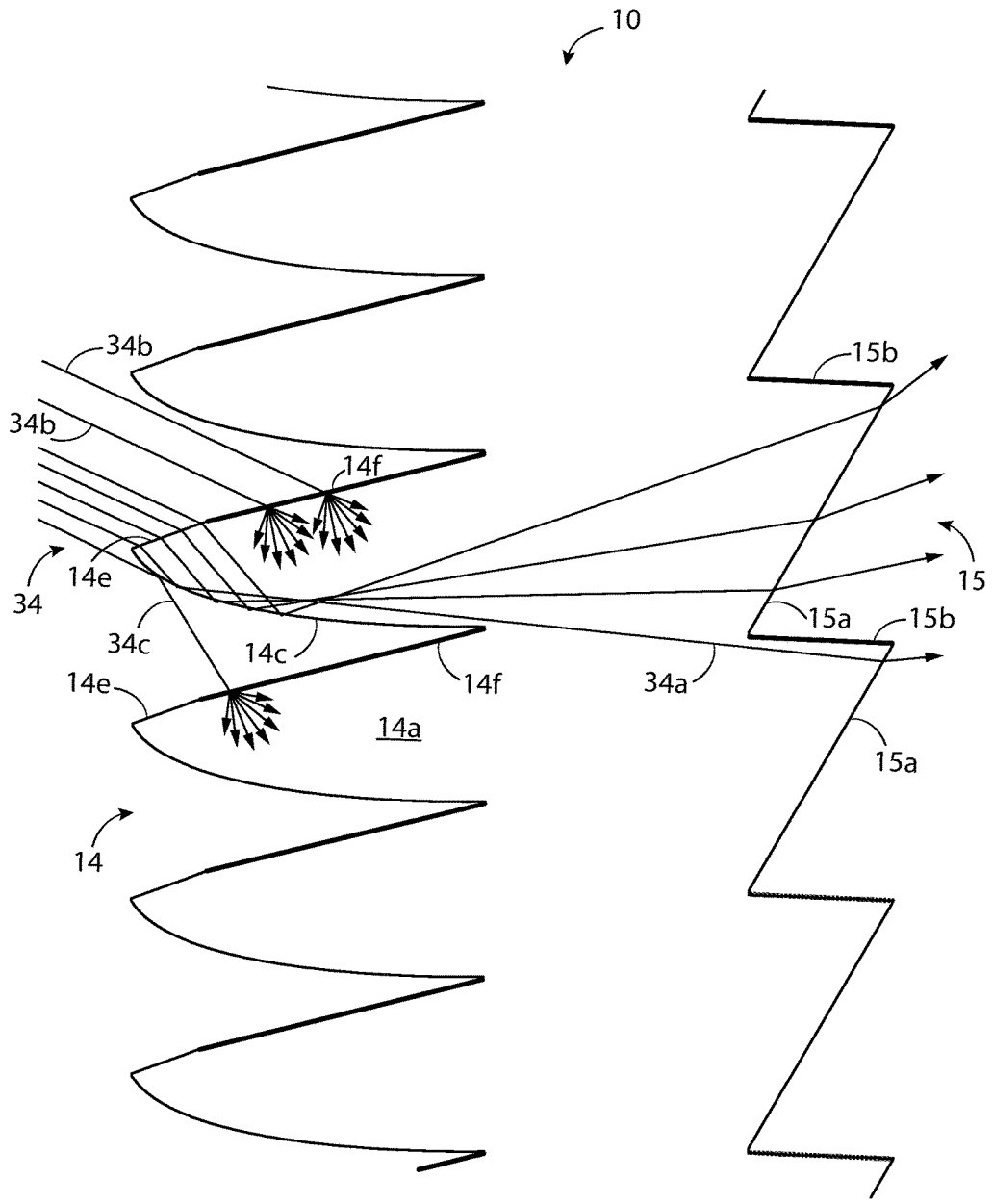
FIG. 37 illustrates a simplified ray-trace diagram of 25° incident light striking the collection optic of FIG. 36 and exiting through the distribution optic of FIG. 15.
Figure 38:
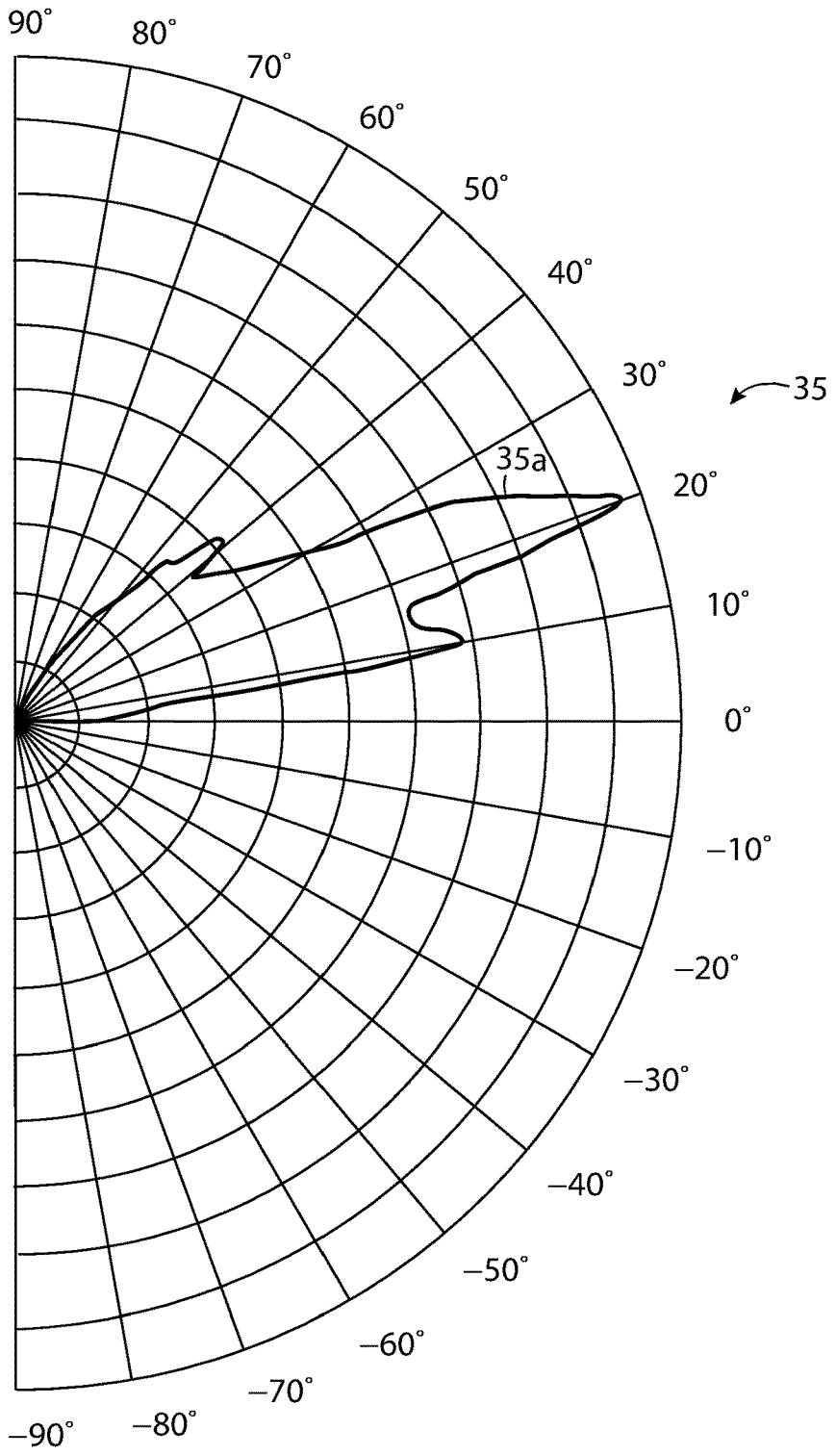
FIG. 38 illustrates a resulting exitance photometric plot for FIG. 37.
Figure 39:
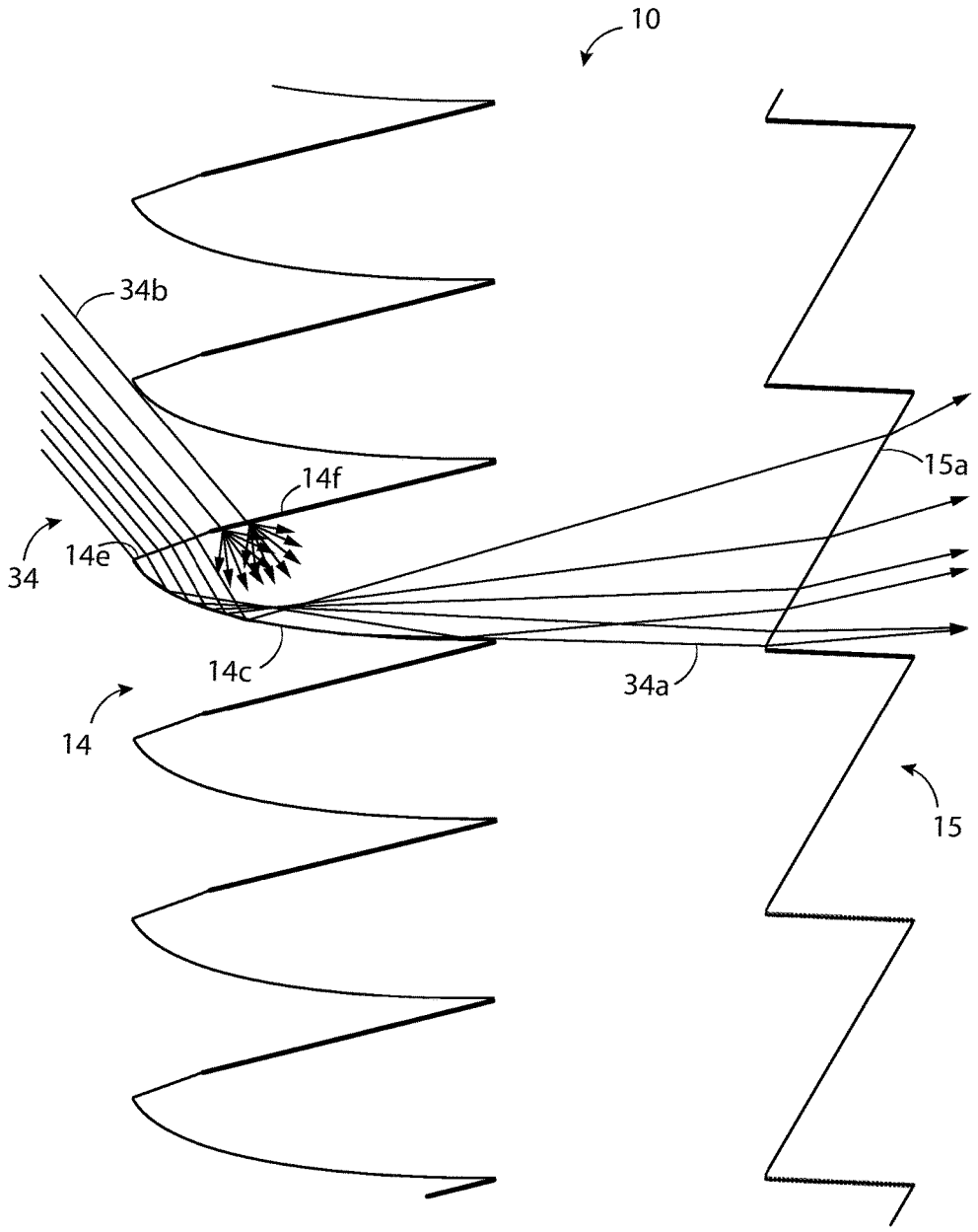
FIG. 39 illustrates a simplified ray-trace diagram of 50° incident light striking the collection optic of FIG. 36 and exiting through the distribution optic of FIG. 15.
Figure 40:
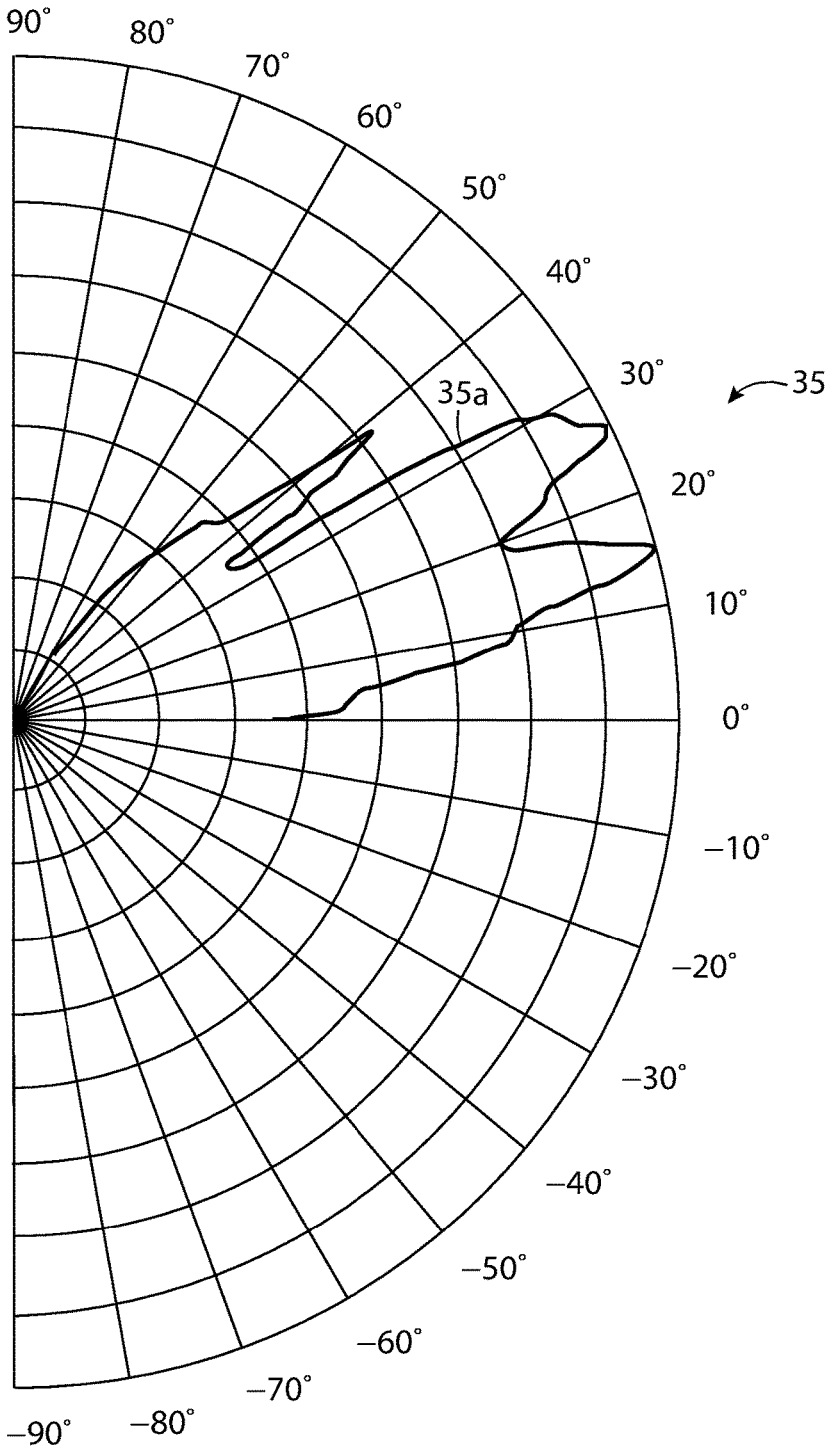
FIG. 40 illustrates a resulting exitance photometric plot for FIG. 39.
Figure 41:
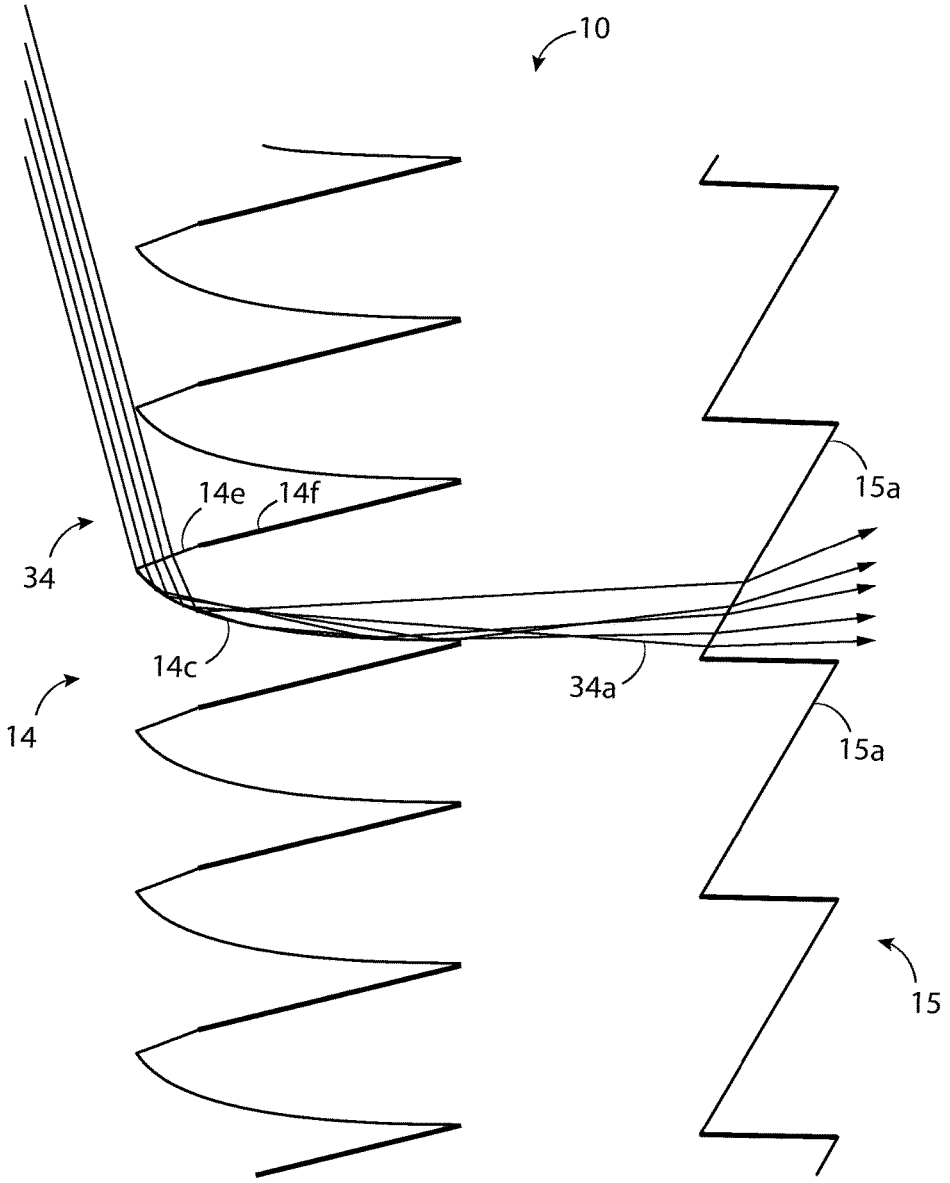
FIG. 41 illustrates a simplified ray-trace diagram of 75° incident light striking the collection optic of FIG. 36 and exiting through the distribution optic of FIG. 15.
Figure 42:
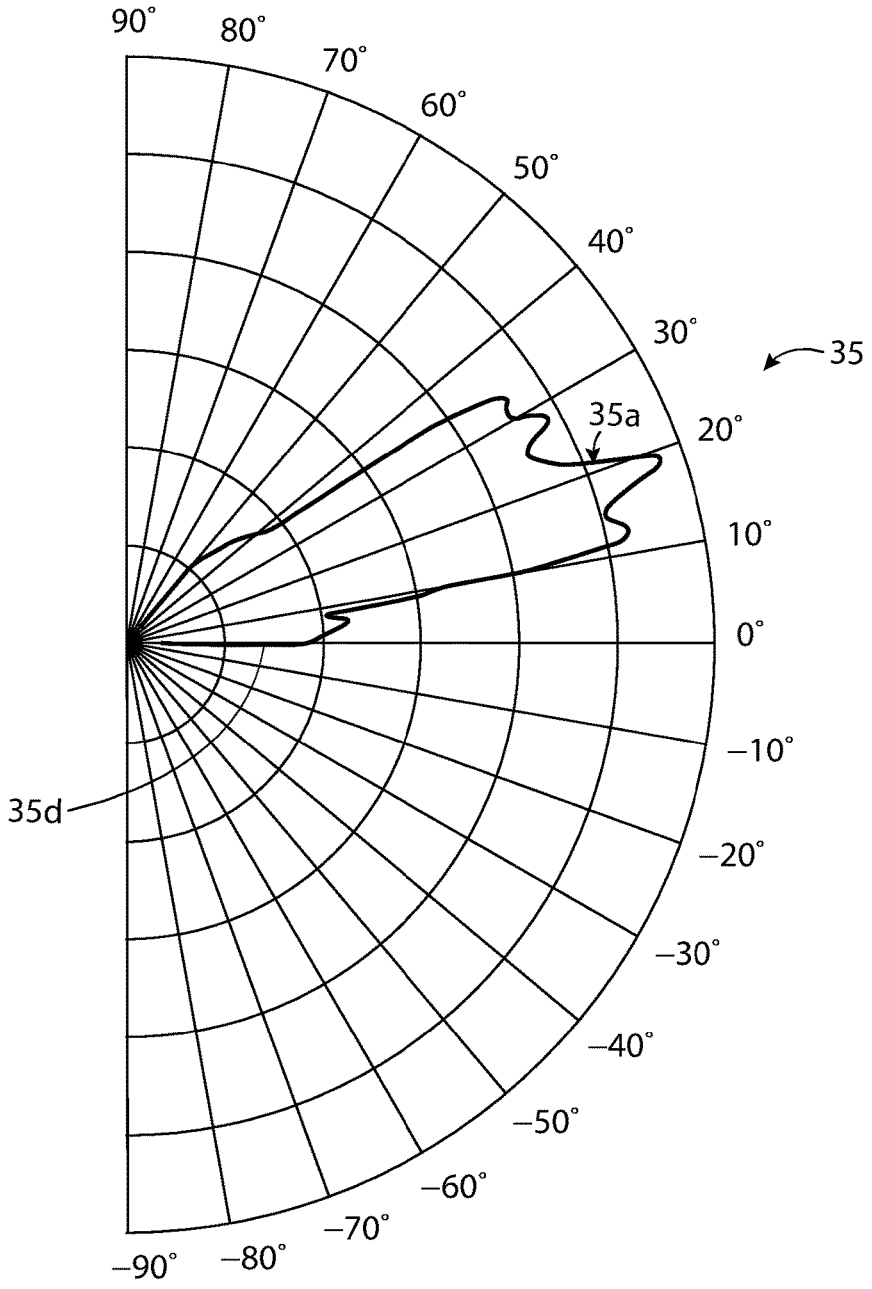
FIG. 42 illustrates a resulting exitance photometric plot for FIG. 41.

The construction of collection optic 14 of the third embodiment is discussed in FIGS. 35-42. FIG. 35 shows the collection optic 14. The corresponding distribution optic is shown in FIG. 15. FIG. 36 shows an exitance photometric plot 35 representing incidence angles with respect to the horizon from 5°-85° for the third embodiment. FIGS. 37, 39, and 41 illustrate simplified ray-trace diagrams with incidence angles with respect to the horizon of 25°, 50°, and 75° respectively. FIGS. 38, 40, and 42 are exitance photometric plots 35 corresponding to FIGS. 37, 39, and 41, respectively.

Figure 4:
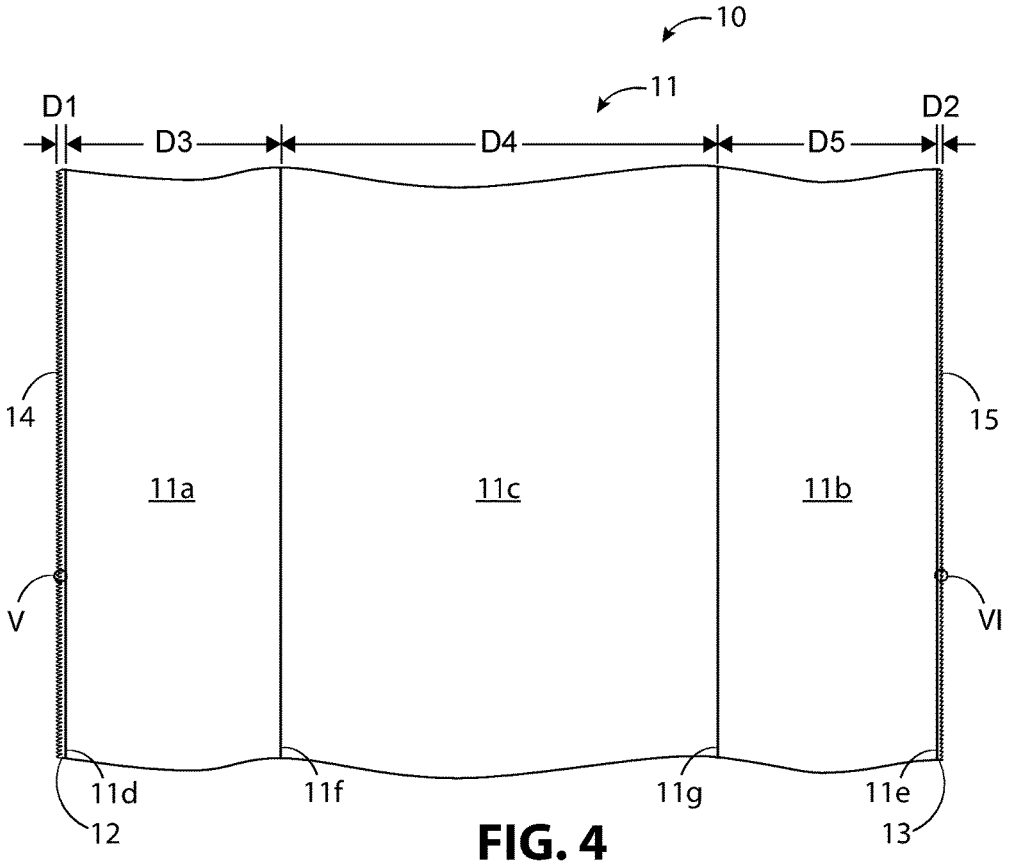
FIG. 4 illustrates a portion of an insulated glass unit with light-redirecting optical films of the present disclosure applied to the two outside surfaces.

The light-redirecting optical system can be etched, cut, molded, embossed or otherwise formed on glazing surfaces such as glass or acrylic. This can be as either a microstructure, for example, one to hundreds of micrometers (μm) in depth or alternatively, a larger structure, for example, one or more centimeters (cm). Alternatively, the light-redirecting optical surfaces can be fabricated on a film or flexible substrate. FIG. 4 illustrates a vertical section of a portion of the light-redirecting optical system 10 implemented using light-redirecting optical films applied to the two outside surfaces of an IGU 11. The IGU 11 as illustrated includes a first glass panel 11*a*, a second glass panel 11*b*, and an insulating space 11*c* separating the first glass panel 11*a* from the second glass panel 11*b*. A first light-redirecting optical film 12 is applied to the outside surface 11*d* of a first glass panel 11*a*. A second light-redirecting optical film 13 is applied to the outside surface 11*e* of the second glass panel 11*b*. The width of the first light-redirecting optical film 12 is designated by width D1. The width of the second light-redirecting optical film 13 is designated by width D2. The widths D1, D2 are each illustrated as approximately 180 μm. By contrast the width of a standard dual-glass panel IGU can typically be in the range of 25.4 mm (1 inch). In FIG. 4, for example, the first glass panel 11*a* and the second glass panel 11*b* each are illustrated with widths D3, D5 as 6.35 mm. The insulating space is illustrated with width D4 of 12.7 mm. The sum of D3+D4+D5=25.4 mm (1 inch). Note that the widths of D1-D5 are typical widths for illustrative purposes. Other widths and proportions are within the scope of the light-redirecting optical system 10.

Figure 5:
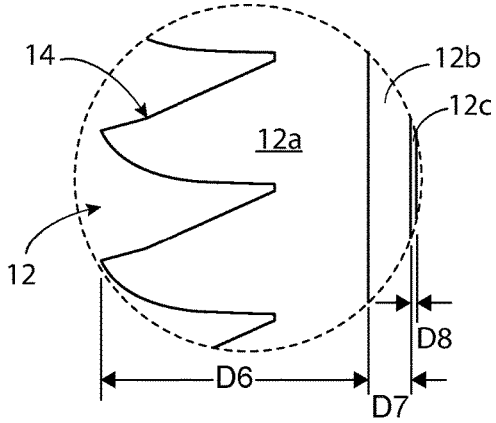
FIG. 5 illustrates a portion of the collection optic of FIG. 4 taken at detail V.
Figure 6:
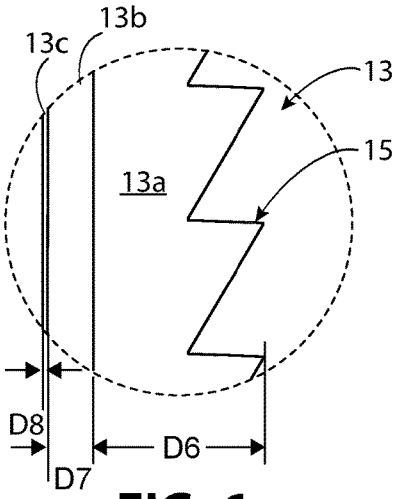
FIG. 6 illustrates a portion of the distribution optic of FIG. 4 taken at detail VI.

Now referring to the first light-redirecting optical film 12 and the second light-redirecting optical film 13 in more detail, FIG. 5 illustrates a portion of the collection optic 14 of FIG. 4 taken at detail V and FIG. 6 illustrates a portion of the distribution optic 15 of FIG. 4 taken at detail VI. Referring to FIGS. 5 and 6, the first light-redirecting optical film 12 and the second light-redirecting optical film 13 include a lacquer layer 12*a*, 13*a*; a film layer 12*b*, 13*b*; and an adhesive layer 12*c*, 13*c*. The collection optic 14 can be cut, etched, embossed, or otherwise formed in the lacquer layer 12*a* of the first light-redirecting optical film 12. The distribution optic 15 can be cut, etched, embossed, or otherwise formed in the lacquer layer 13*a* of the second light-redirecting optical film 13. The lacquer layers 12*a*, 13*a* can be a transparent acrylate lacquer. For example, this can be an ultraviolet (UV) curable acylate lacquer, air curable lacquer, or other types of transparent lacquer. For the lacquer layer 12*a* which forms the collection optic 14, the lacquer should be weather durable. It should be resistant to rain, dirt, temperature variations, and other environmental factors associated with the external environment. The film layer 12*b*, 13*b* is typically made of a transparent flexible material that holds its characteristics over time and over the normal temperature and UV exposure from daylight exposure, for example PET or PMMA. The PET or PMMA substrate can be applied to a glass or an acrylic glazing panel by the adhesive layer 12*c*, 13*c*. For example, a pressure sensitive transparent adhesive or water activated transparent adhesive. The lacquer layers 12*a*, 13*a*, film layers 12*b*, 13*b*, and adhesive layers 12*c*, 13*c*, should retain their light transmissivity and transparency over time. The first light-redirecting optical film 12 and the second light-redirecting optical film 13 can be sufficiently light weight and thin to be easily rolled and shipped. For example, in FIGS. 5 and 6, the lacquer layers 12*a*, 13*a*, the film layer 12*b*, 13*b*, and the adhesive layers 12*c*, 13*c* typically can be D6=200 μm, D7=50 μm, and D8=5 μm respectively.

The reader will note that the structure of FIGS. 5 and 6 are one example of how the light-redirecting optical system 10 can be implemented. The inventors envision, as previously mentioned, other ways the light-redirecting optical system 10 can be implemented in a glazing system. For example, the collection optic 14 and the distribution optic 15 can be etched, molded, embossed or otherwise formed directly into the surface of the first glass panel 11*a* and the second glass panel 11*b* respectively. Alternatively, the lacquer layers 12*a*, 13*a* can be sprayed, rolled, extruded, or otherwise distributed directly on the surfaces of the first glass panel 11*a* and the second glass panel 11*b* respectively. The collection optic 14 and the distribution optic 15 can be cut, etched, embossed or otherwise formed into the lacquer layers 12*a*, 13*a* respectively. In an alternative example, the collection optic 14 and/or distribution optic 15 can be etched, molded, embossed or otherwise formed on a suspended film separate from the first glass panel 11*a* and the second glass panel 11*b*.

Figure 7:
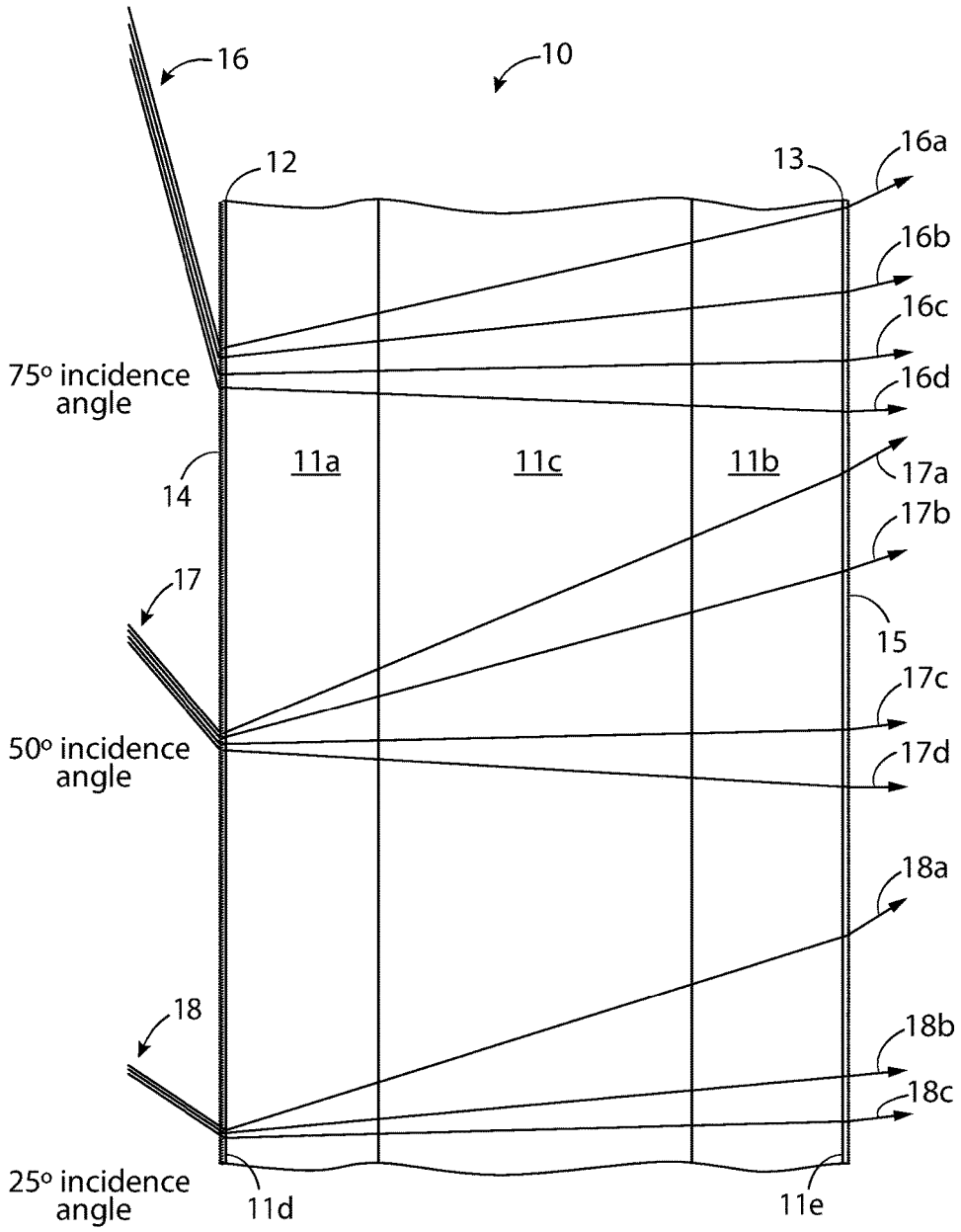
FIG. 7 illustrates a portion of the light-redirecting optical system of FIG. 4 with daylight engaging the collection optic at 75°, 50°, and 25° incidence angles with respect to the horizon.

To illustrate how the light-redirecting optical system 10 diverts incoming daylight for different times of day or seasons of the year, FIG. 7 illustrates a greatly simplified ray-trace diagram applied to a portion of the light-redirecting optical system 10 with daylight engaging the collection optic with 75°, 50°, and 25° incidence angles with respect to the horizon. When the sun is at a 75° with respect to the horizon, incoming specular daylight 16 represented by specular rays 16*a*, 16*b*, 16*c*, 16*d*, are redirected in according to where they engage both the collection optic 14 and the distribution optic 15. When the sun is at a 50° with respect to the horizon, incoming specular daylight 17 represented by specular rays 17*a*, 17*b*, 17*c*, 17*d*, are redirected in according to where they engage both the collection optic 14 and the distribution optic 15. Similarly, when the sun is at a 25° with respect to the horizon, incoming specular daylight 18 represented by specular rays 18*a*, 18*b*, 18*c*, 18*d*, are redirected in according to where they engage both the collection optic 14 and the distribution optic 15. For these incoming angles, the specular rays exit the distribution optic 15 above the horizon and typically less than 50°. This angular distribution can keep glare out of the eyes of the occupants within the interior environment while at the same time redirecting light deep within the building interior.

FIGS. 8-12 show several typical applications of the light-redirecting optical system 10. Each of FIGS. 8-12 show an exterior environment 19, an interior environment 20, and a person 21 of approximately average height within the interior environment 20 to show context. Each of FIGS. 8-12 show the collection optic 14 and the distribution optic 15 applied to an IGU 11 in different portions of the building 22 with specular daylight 23 from the sun 24 at an incidence angle A2 with respect to the horizon H. For example, the incidence angle A2 shown in FIGS. 8-12 ranges from 5°-85°. An exitance specular ray 23*a* that can be typical is shown in each figure.

Figure 8:
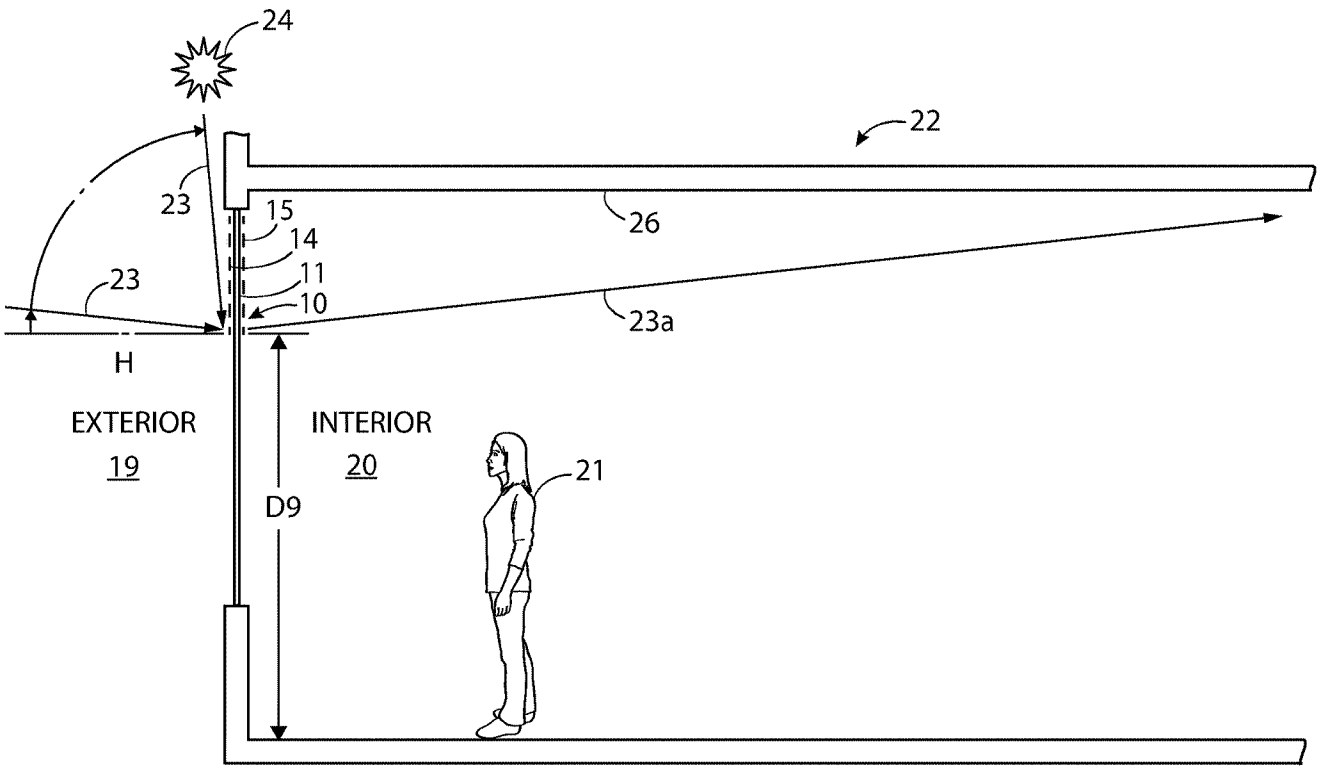
FIG. 8 illustrates a typical application of the light-redirecting optical system of this disclosure showing a window with the light-redirecting optical system applied to the upper portion of the window.
Figure 9:
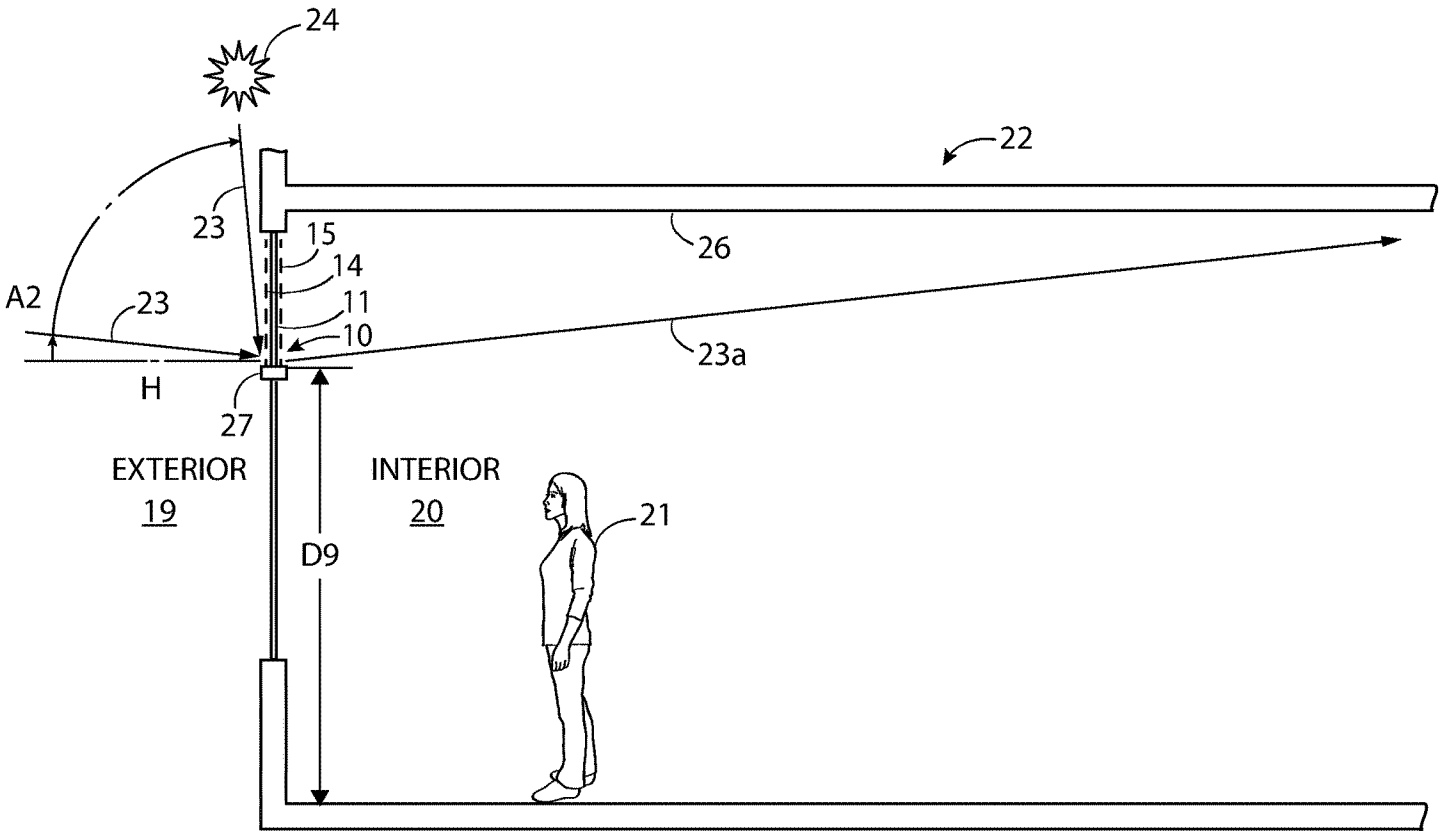
FIG. 9 illustrates an alternative typical application of the light-redirecting optical system of this disclosure showing a vertically divided window system with a lower window and upper window with the light-redirecting optical system applied to the upper daylight window.

FIGS. 8 and 9 shows a building 22 with a flat ceiling 26 (i.e. horizontal ceiling) and a IGU 11 extending close to the ceiling, for example, in a store front or office building. The portion of the IGU 11 at eye-level and below can be treated with movable blinds or fabric shades. The portion above eye-level, typically 2.13 m (7.0 feet) or higher is shown treated with the light-redirecting optical system 10. This is represented by distance D9. In FIG. 8, the IGU 11 is continuous. In FIG. 9, the light-redirecting optical system 10 is applied above the mullion 27 that divides the opening into two separate IGU 11 units.

Figure 10:
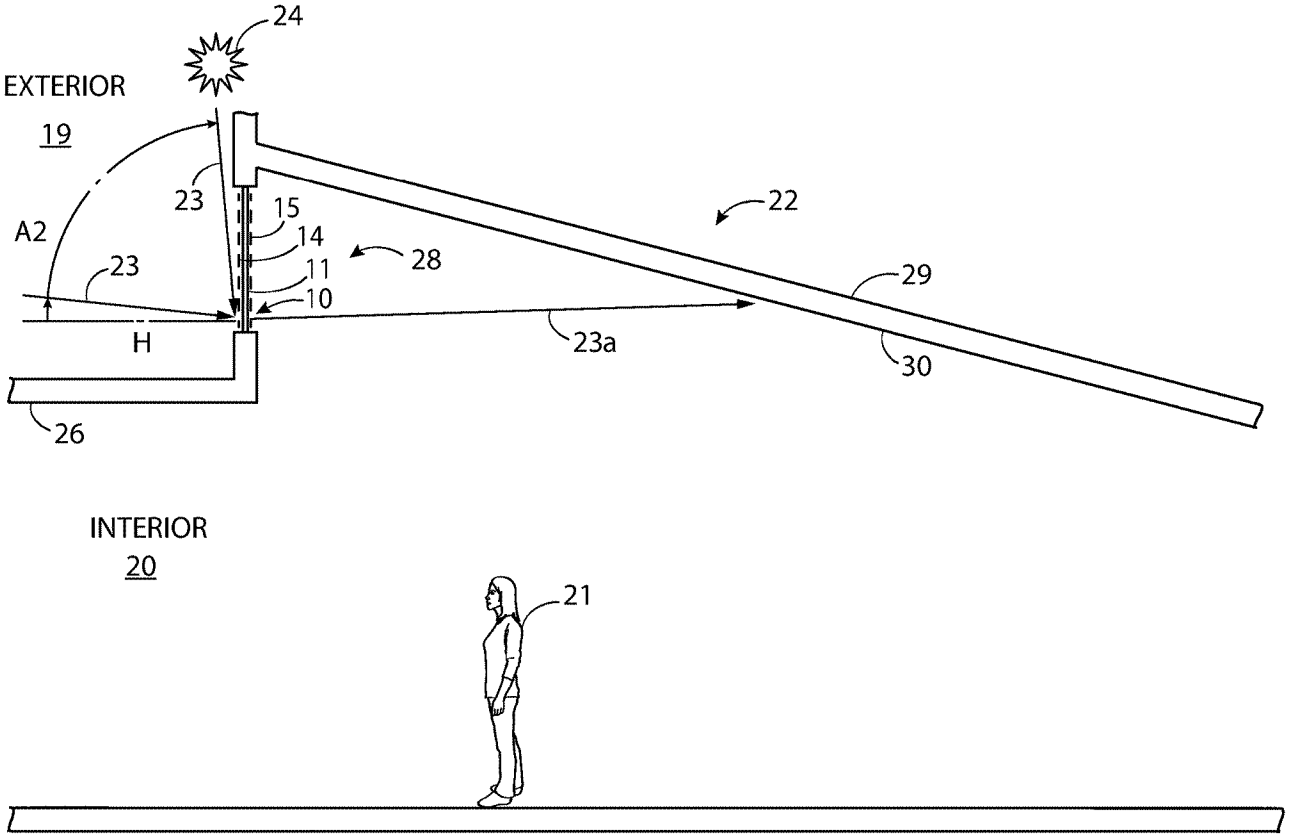
FIG. 10 illustrates an alternative typical application of the light-redirecting optical system of this disclosure showing the light-redirecting optical system applied to the clerestory window and a downward-sloping ceiling.
Figure 11:
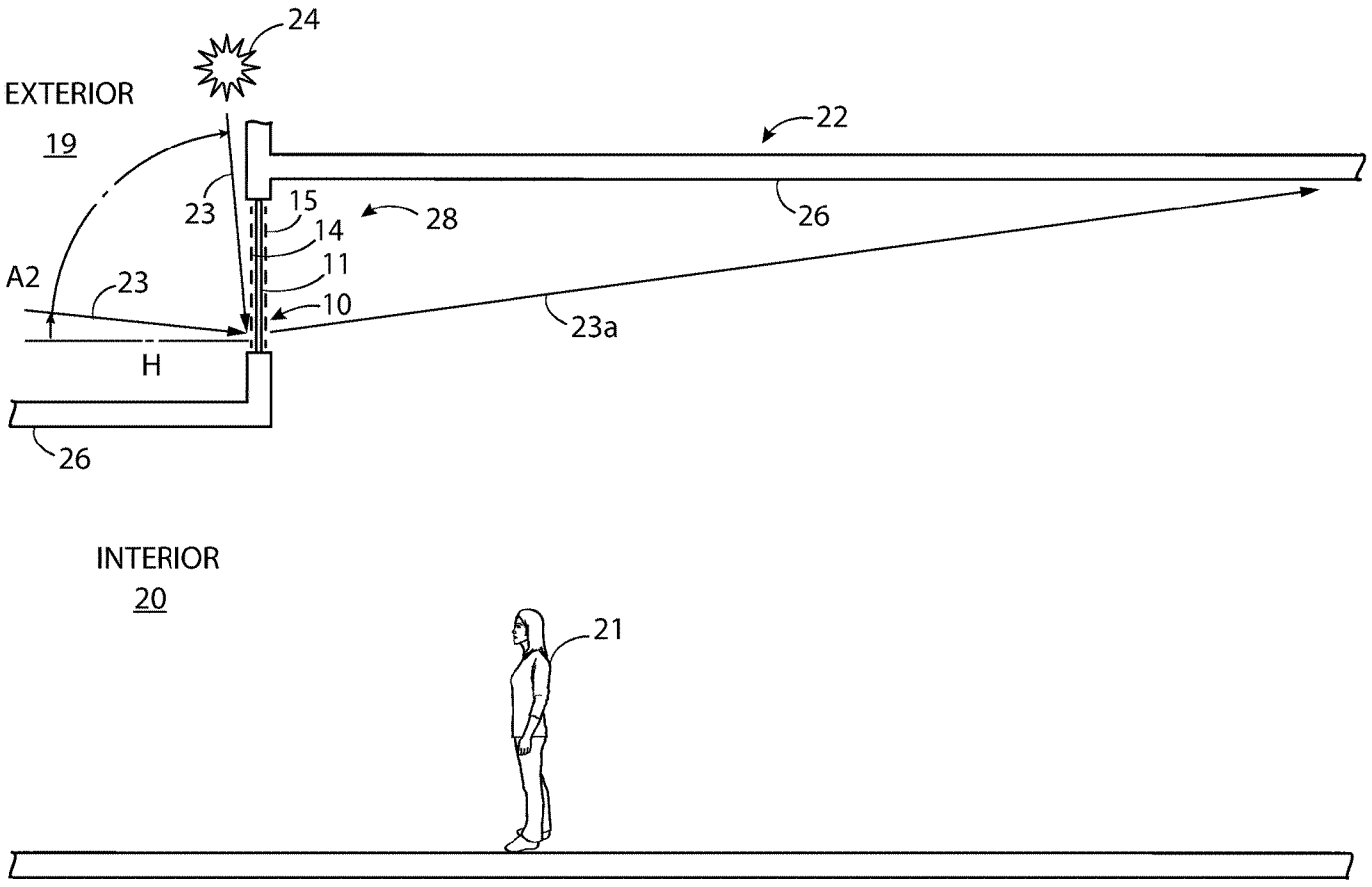
FIG. 11 illustrates an alternative typical application of the light-redirecting optical system of this disclosure showing the light-redirecting optical system applied to the clerestory window and a horizontal ceiling.
Figure 12:
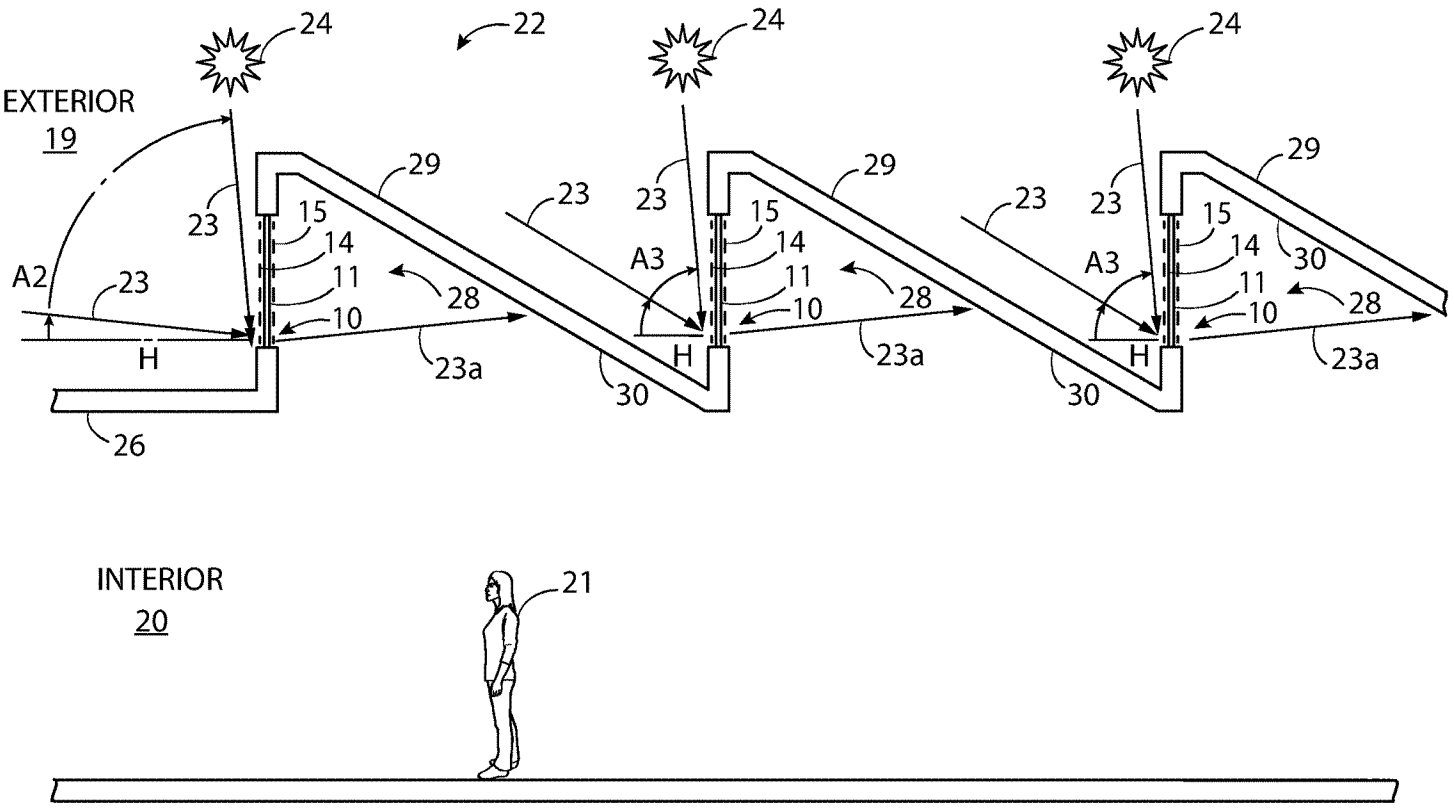
FIG. 12 illustrates an alternative typical application of the light-redirecting optical system of this disclosure showing the light-redirecting optical system applied to a series of clerestory windows each with a downward-sloping ceiling.

FIGS. 10-12 show the light-redirecting optical system 10 applied to clerestory windows 28. FIG. 10 illustrates a flat ceiling 26 before the clerestory window 28 with a sloped roof 29 and corresponding sloped ceiling 30 after the clerestory window 28. FIG. 11 illustrates a flat ceiling 26 both before and after the clerestory window 28. Comparing FIGS. 10 and 11, the light projects deeper into the interior environment in FIG. 11 because of the flat ceiling 26. FIG. 12 illustrates a building 22 with a series of clerestory windows 28 followed by a series of sloped roofs 29 and corresponding series of sloped ceilings 30. In FIG. 12, the specular daylight 23 from the sun 24 projects across each of the sloped ceilings 30 lighting up the interior environment without creating glare because the light reaching the person 21 is indirect. The lower limit of the angle range of the incidence angle A3 with respect to the horizon H is determined by pitch of the sloped roof. For example, for a pitch of 30°, the lower limit for the specular daylight 23 would be 30° making the range of A3 from 30° to 85° for specular daylight. However, the reflected diffuse daylight would still exist, reflecting off of the roof and into the system.

Figure 13A:
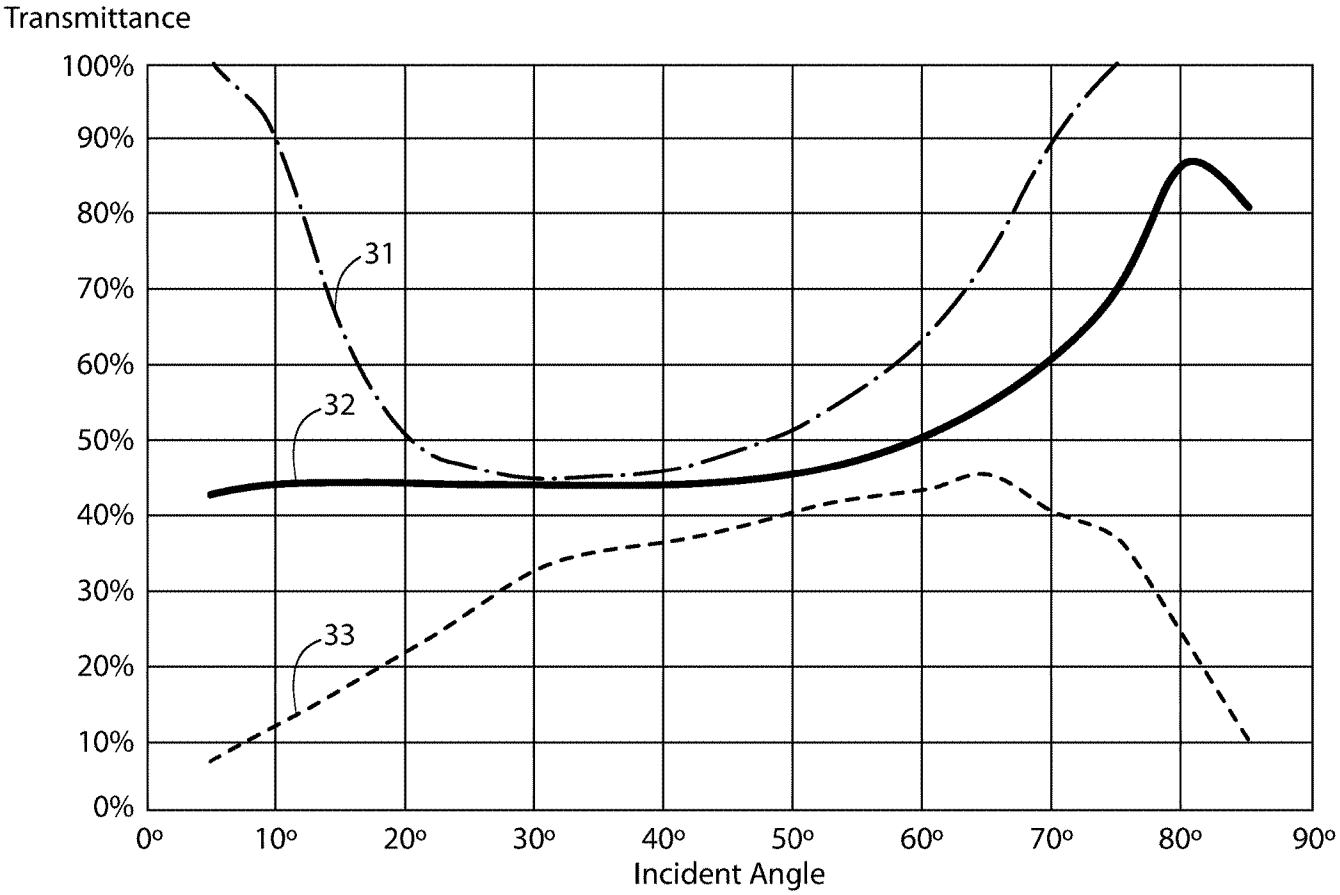
FIG. 13A illustrates a comparison of the angular transmittance of a typical light-redirecting system of this disclosure as compared with the mini-optical light shelf system of FIG. 1.
Figure 13B:
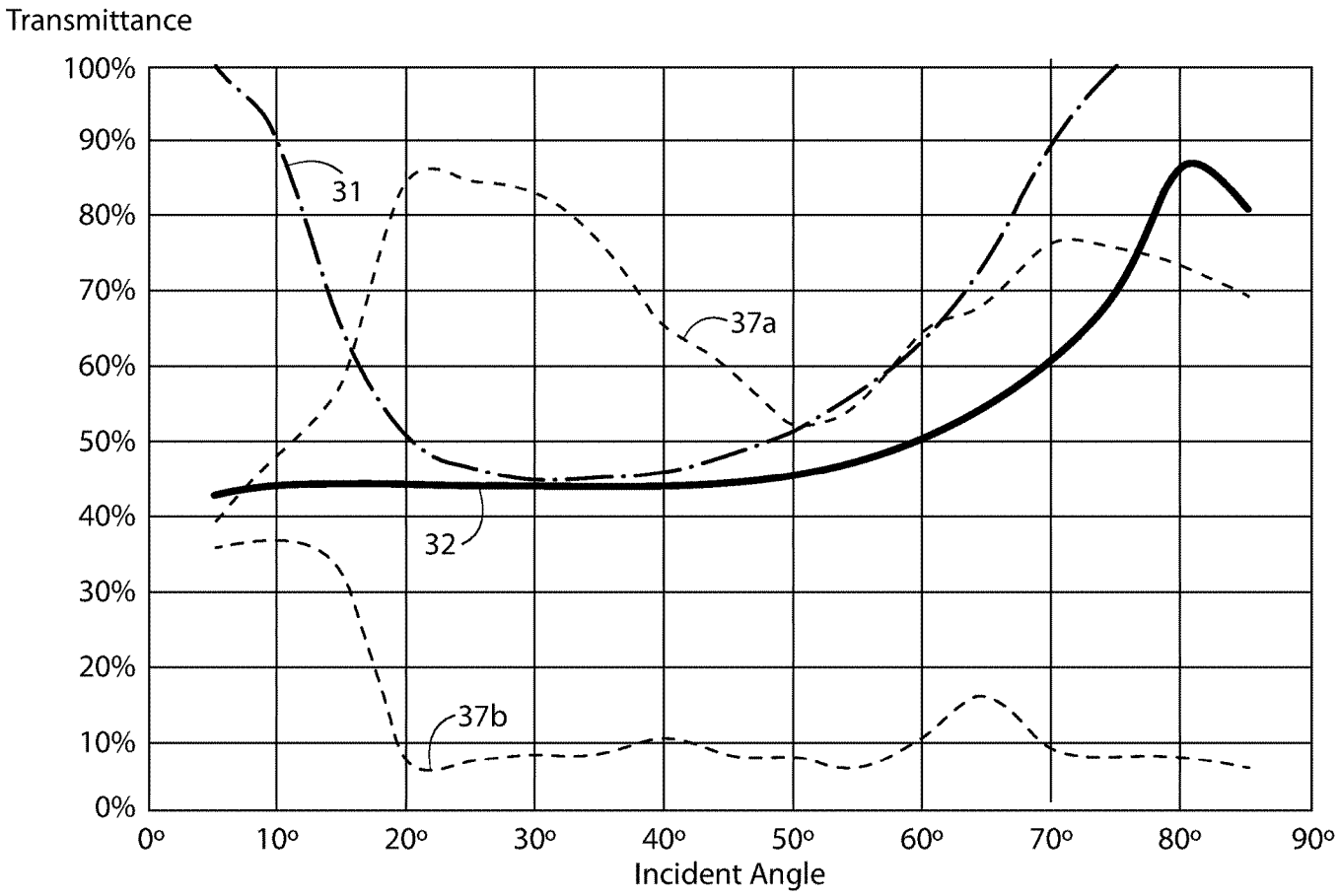
FIG. 13B illustrates a comparison of the angular transmittance of a typical light-redirecting system of this disclosure as compared with the light-redirecting optical film of FIG. 3.

FIGS. 13A and 13B illustrates some of the benefits of the light-redirecting optical system 10 over other systems. FIGS. 13A and 13B illustrate a comparison of the percent transmittance of light as a function of incidence angle with respect to the horizon. In FIG. 13A, an ideal transmittance curve 31 is compared against a light-redirecting optical system transmittance curve 32, and a mini-optical light shelf system transmittance curve 33. In FIG. 13B, an ideal transmittance curve 31 is compared against a light-redirecting optical system transmittance curve 32, and the light-redirecting optical film of FIG. 3. FIG. 13B shows an upward transmittance curve 37*a* and a downward transmittance curve 37*b* for the light-redirecting optical film of FIG. 3 because the light-redirecting optical film of FIG. 3, in the prior art, directs specular light both above and below the horizon. As shown by the downward transmittance curve 37*b*, at angles greater than 20° approximately 10% transmittance is below the horizon. At angles between 5° and 10°, approximately 35% transmittance is below the horizon.

Referring to FIGS. 13A and 13B, the ideal transmittance curve 31 accounts for the light loss at low angles due to atmospheric disturbances as the sun moves closer to the horizon and accounts for light loss at high angles as much of the sun's light is not striking a vertical surface as the sun's rays become close to vertical. The light-redirecting optical system transmittance curve 32 represents the percent transmittance as a function of incidence angle for the light-redirecting optical system 10 of FIGS. 4-7. In FIG. 13A, the mini-optical light shelf system transmittance curve 33 represents the percent transmittance as a function of incidence angle for the mini-optical light shelf daylighting system 1 of FIG. 1 including the IGU 2 and the reflective slats 3 in the interior environment. The mini-optical light shelf system transmittance curve 33 shows losses at the angles below 20° in part, caused by shading effects of design of the mini-optical light shelf daylighting system 1 discussed for FIG. 1. Referring to both FIGS. 1 and 13A, the mini-optical light shelf system transmittance curve 33 shows losses at the angles above 70° in part caused by reflection of the specular rays off the outside surface 2*d* of the first glass panel 2*a* and the inside surface 2*e* of the second glass panel 2*b*. This is the incidence angle modifier effect previously discussed. Referring to FIG. 13B, the upward transmittance curve 37*a* of the light-redirecting optical film of FIG. 3 in the prior art also suffers from the incidence angle modifier effect.

Referring to FIG. 13A, the light-redirecting optical system transmittance curve 32 tracks more closely with the ideal transmittance curve 31 because the light-redirecting optical system 10 does not exhibit the incidence angle modifier effect when applied to the outside surfaces 11*d*, 11*e* of the first glass panel 11*a* and the second glass panel 11*b* respectively as shown in FIG. 4. In addition, the light-redirecting optical system transmittance curve 32 has much better transmittance at 20° or less than the mini-optical light shelf system transmittance curve 33. At 5° the light-redirecting optical system transmittance curve 32 has more than four times the transmittance as the mini-optical light shelf system transmittance curve 33.

Figure 14:
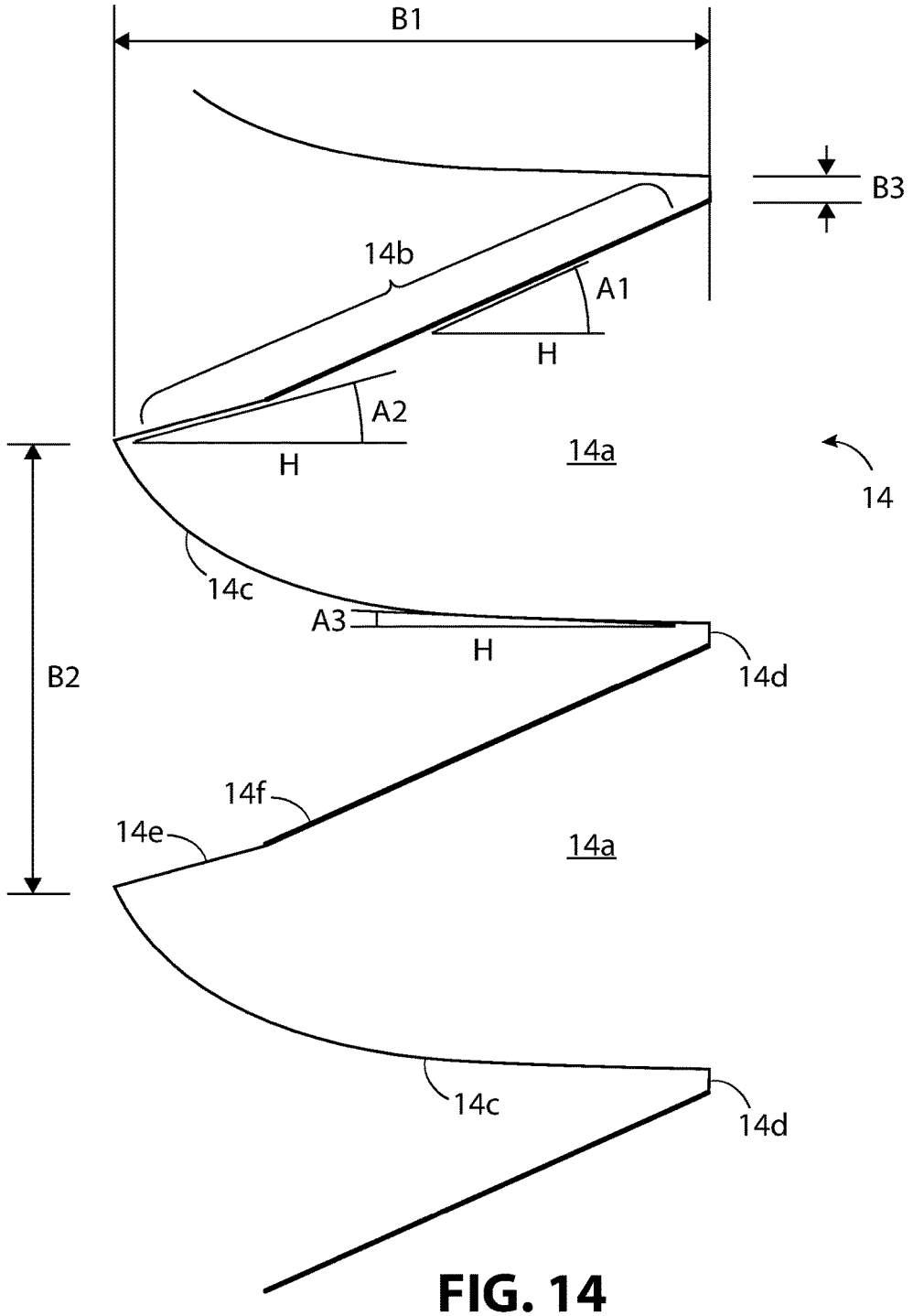
FIG. 14 illustrates the geometry of a typical collection optic used in the light-redirecting optical system.

FIGS. 14, 24, and 35 show examples of a collection optics 14 that can be used in a light-redirecting optical system 10. Referring to FIGS. 14, 24, and 35, the collection optics include a series of projections 14*a*. The projections 14*a* within each of the collection optics 14 are typically identical, as illustrated, however, they can be a series of collection optic patterns combined in sections. For example, a section of the collection optic 14 of FIG. 14 could be combined with a section of the collection optic 14 of FIG. 24. Similarly, the section of the collection optic 14 of FIG. 14 could be combined with a section of the collection optic of FIG. 35. A section of the collection optic of FIG. 24 could be combined with a section of the collection optic 14 of FIG. 35. A section of the collection optic 14 if FIG. 14 could be combined with a section of the collection optic 14 of FIG. 24 and a section of the collection optic 14 of FIG. 35.

Each of the projections 14*a* of FIGS. 14, 24, and 35 include an upward-facing portion 14*b* and an arcuate shaped portion 14*c*. The upward-facing portion 14*b* projects downward at an acute angle away from the vertical surface 14*d* of collection optic 14. The upward-facing portion 14*b* includes a transparent portion 14*e* and a translucent portion 14*f*. The translucent portion 14*f* is shown projecting directly away from vertical surface 14*d* of the collection optic 14. The transparent portion 14*e* is shown projecting directly away from the translucent portion 14*f* and terminating at the arcuate shaped portion 14*c*. The transparent portion 14*e* typically has an optically smooth surface finish defined as an arithmetical mean of surface roughness of $R_a$<0.03 μm. The translucent portion typically has an $R_a$>0.75 μm. The arcuate shaped portion 14*c* projects directly away from the transparent portion 14*e* and terminates at the vertical surface 14*d* of the collection optic 14. Both the arcuate shaped portion 14*c* and the transparent portion 14*e* are optically transparent in the visible light range. They can optionally be optically reflective of infrared and/or ultraviolet (UV) light. The translucent portion 14*f* can be diffused by roughening the surface mechanically, molding, chemically, or otherwise forming a roughened surface. The diffusion can follow an ideal Lambertian curve or alternatively have uniform diffusion in as little as a 5° spread. The illustrated embodiments were analyzed with uniform diffusion within a 5° spread.

The slope of the translucent portion 14*f* with respect to the vertical surface 14*d* can vary and still be within the scope of the light-redirecting optical system 10. In FIGS. 14, 24, and 35, angle A1 represents the angle of the translucent portion 14*f* with respect to the horizon H (i.e. the complementary angle of the translucent portion 14*f* with the vertical surface 14*d*). In FIG. 14 the angle A1=24.3°. In FIG. 24, the angle A1=20°. In FIG. 35, A1=14°. These figures show examples of the angles A1 in combination with the other structure element, that are within the scope of the light-redirecting optical system 10 however, the inventors envision other ranges of angles that may be within the scope of light-redirecting optical system 10.

As demonstrated by FIGS. 14, 24, and 35, the angular relationship between the translucent portion 14*f* and the transparent portion 14*e* can range from an acute angle to an obtuse angle. While not shown, the translucent portion 14*f* and the transparent portion 14*e* can also lie in the same plane (i.e. have a planar relationship). Angle A2 represents the angle between the transparent portion 14*e* and the horizon H. The angle A2=15° for FIG. 14, A2=18° for FIG. 24, and 20° for FIG. 35. The angle between the translucent portion 14*f* and the transparent portion 14*e*, angle A1−A2=24.3°−15°=9.3° in FIG. 14 (i.e. an acute angle 9.3°). In FIG. 24, the angle between the translucent portion 14*f* and the transparent portion 14*e*, angle A1−A2=20°−18°=2° (i.e. an acute angle of 2°). In FIG. 35, the angle between the translucent portion 14*f* and the transparent portion 14*e*, angle A1−A2=14°−20°=−6° (i.e. an obtuse angle of 6°).

The angle A3 between the intersection of the arcuate shaped portion 14*c* and the horizon H as the arcuate shaped portion intersects the vertical surface can be 0°. In FIGS. 14, 24, and 35, A3 is shown as approximately 2° for manufacturing purposes. This should have little or no effect on the optical performance.

As discussed, the collection optic 14 of FIGS. 14, 24, and 35 can be implemented on a light-redirecting optical film, such as the first light-redirecting optical film 12 of FIGS. 4, 5, and 7. The collection optic 14 can alternatively be implemented directly on a glazing surface such as a glass or acrylic panel. When implemented on light-redirecting optical film, the collection optic typically would be implemented in the sub-millimeter range. For example, in FIGS. 14, 24, and 25 the dimension B1, the horizontal width of the collection optic, can typically be 100 μm. The dimension B2, which represents the vertical distance between each projection 14*a* at their maximum, is illustrated in FIG. 14 as B2=63 μm, in FIG. 24 as B2=76 μm, and in FIG. 35 as B2=50 μm. The dimension B3, represents the vertical distance between each projection at their minimum is typically 5 μm are manufacturing purposes, however, this dimension can be smaller or larger if practical.

Referring to FIGS. 18, 20, 22, 26, 28, 30, 32, 33, 34, 37, 39, and 41, the arcuate shaped portion 14*c* is so shaped as to reflect most of the specular daylight 34 entering the transparent portion 14*e* in an upward direction via internal reflection. FIGS. 18, 20, and 22 illustrate typical ray traces for the collection optic of FIG. 14 in combination with the distribution optic 15 of FIG. 16 with specular daylight 34 incidence angles with respect to the horizon of 25°, 50°, and 75° respectively. FIGS. 26, 28, and 30 show the collection optic 14 of FIG. 24 in combination with the distribution optic 15 of FIG. 15 with specular daylight 34 incidence angles with respect to the horizon of 25°, 50°, and 75° respectively. FIGS. 37, 39, and 41 show the collection optic 14 of FIG. 35 in combination with the distribution optic 15 of FIG. 15 with specular daylight 34 incidence angles with respect to the horizon of 25°, 50°, and 75° respectively. For the specular ray 34*a* that exit the collection optic 14 below the horizon, as shown in FIGS. 18, 20, 22, 28, 30, 33, 34, 37, 39, and 41, ultimately the specular rays 34*a* will refract through transparent portion 15*a* of the distribution optic 15 and exit the system in an upward direction.

The shape of the arcuate shaped portion 14*c* illustrated in FIGS. 14, 24, 35 illustrate typical shapes for the arcuate shaped portion 14*c* that in combination with the transparent portion can reflect, by internal reflection, nearly all the specular rays at or above the horizon. The shape of the arcuate shaped portion 14*c* illustrated in FIG. 14 is similar in shape to the reflecting curve 3*a* of the mini-optical light shelf daylighting system 1 and described in U.S. Pat. No. 6,714,352 where the arcuate shaped portion 14*c* is constructed from a continuous series of arcs and the arcs have the same slope at their intersection so to form a smooth curve. Since this curve was constructed originally as a reflective surface it was unexpected that this shape would yield desired results as the bottom interior surface of a refractive element, such the arcuate shaped portion 14*c* of the collection optic 14 of FIG. 14. In FIGS. 24 and 35, the shapes are variations of portions and scales of elliptical and parabolic curves chosen to closely match the original shape, respectively. Referring to FIGS. 14, 25, and 35, the inventors found that they could control the entry of the specular daylight into the collection optic 14 through a combination the relationship between transparent portion 14*e*, translucent portion 14*f*, and their angular relation to both the vertical surfaces 14*d* and the arcuate shaped portion 14*c*. For example, in FIGS. 18, 20, 26, 28, 32, 33, 37, and 39 a specular ray 34*b* that could potentially miss the arcuate shaped portion 14*c* and project downward through the transparent portion 15*a* of the distribution optic, will be intercepted by the translucent portion 14*f* and become scattered as diffused light. Similarly, structural relationship between the projections 14*a* assures that a specular ray 34*c* reflecting off the downward-facing surface of an arcuate shaped portion 14*c* will either engage either the transparent portion 14*e* or the translucent portion 14*f* of the projection 14*a* below the arcuate shaped portion 14*c* as illustrated in FIGS. 18, 26, 32, and 37.

FIGS. 15 and 16 show the distribution optics 15 that can typically be used in the light-redirecting optical system 10. As previously discussed, the distribution optic 15 of FIG. 16 is shown in combination with collection optic 14 of FIG. 14 in FIGS. 18, 20, and 22. The distribution optic 15 of FIG. 15 is shown in combination with the collection optic 14 of FIG. 24 in FIGS. 26, 28, 30, 32, 33 and 34. The distribution optic 15 of FIG. 15 is shown in combination with the collection optic 14 of FIG. 35 in FIGS. 37, 39, and 41. Both the distribution optic 15 of FIGS. 15 and 16 include a saw tooth pattern. Each of the distribution optics 15 of FIGS. 15 and 16 includes a transparent portion 15*a* and a translucent portion 15*b*. The transparent portion 15*a* projects at angle C1 in relation to the horizon H. In FIG. 15 the angle C1=65°. In FIG. 16 the angle C1=60°. The translucent portion 15*b* is shown as a planar surface that projects at nearly a horizontal angle. Angle C2 represents the angle the translucent portion in relationship to the horizon H. In both FIGS. 15 and 16, angle C2 is 2° and is chosen for manufacturing purposes. Other angles for C2, including C2=0° are well within the scope of the light-redirecting optical system 10. As with the collection optic 14 of FIGS. 14, 24, and 25, the transparent portion 15*a* of the distribution optic 15 typically has an arithmetical mean of surface roughness of $R_a$<0.03 μm. The translucent portion 15*b* of the distribution optic typically has an $R_a$>0.75 μm.

As discussed for the collection optic 14 of FIGS. 14, 24, and 35, the distribution optic 15 of FIGS. 15 and 16 can be implemented on sub-millimeter scale to apply it to an optical film such as the second light-redirecting optical film 13 discussed in FIGS. 4 and 6. The dimension E1, which is the horizontal width of the distribution optic extending from the vertical surface 15*c* is shown as E1=34 μm in FIG. 15 and E1=42 μm. The dimension E2, which is the vertical height of each projection 15*d* is shown as E2=75 μm for both the distribution optic 15 of FIGS. 15 and 16. These dimensions are typical. The distribution optic 15 can be scaled according to implementation requirements. For example, for direct molding, etching, or otherwise forming directly on the glazing surface, the dimensions of E1 and E2 may be scaled up to the millimeter or even centimeter range.

One of the functions of the translucent portion 15*b* is to prevent specular light from exiting the light-redirecting optical system 10 at a high angle or specularly reflecting off the translucent portion 15*b* and exiting the system in a downward angle. Referring to FIG. 28, specular ray 34*e* reflects off the transparent portion 15*a* by internal reflection and has the potential to exit the system at a high angle, for example 75° or greater. The specular ray 34*e* is intersected and diffused by the translucent portion 15*b* before it exits the system. Some of the specular rays at lower angles, for example, the specular rays 34*d* of FIGS. 18, 20, 28, and 33, and specular rays 34*f* of FIGS. 32 and 33, also intersect the translucent portion 15*b* resulting in scattering of the specular rays 34*e*, 34*f*.

To help illustrate the system performance, FIGS. 17, 19, 21, 23, 25, 27, 29, 31, 36, 38, 40, and 42 show the exitance photometric plots 35 of the light-redirecting optical system 10. The exitance photometric plots 35 shows relative luminous intensity versus exitance angle with respect to the horizon for solar incidence angles with respect to the horizon averaged between 5°-85° in FIGS. 17, 25, and 36 and for specific incidence angles with respect to the horizon in FIGS. 19, 21, 23, 27, 29, 31, 38, 40, and 42.

FIG. 17 illustrates a exitance photometric plot 35 of the collection optic 14 of FIG. 14 and the distribution optic 15 of FIG. 16 with incidence angles with respect to the horizon between 5°-85°. FIGS. 19, 21, and 23 illustrate a exitance photometric plot 35 of the collection optic 14 of FIG. 14 and the distribution optic 15 of FIG. 16 with incidence angles of 25°, 50°, and 75° respectively. FIG. 25 illustrates a exitance photometric plot 35 of FIG. 24 and the distribution optic of FIG. 15 with incidence angles with respect to the horizon of between 5°-85°. FIGS. 27, 29, and 31 illustrate a exitance photometric plot 35 of the collection optic 14 of FIG. 24 and the distribution optic 15 of FIG. 15 with incidence angles of 25°, 50°, and 75° respectively. FIG. 36 illustrates a exitance photometric plot 35 of the collection optic 14 of FIG. 35 and the distribution optic 15 of FIG. 15 with incidence angles with respect to the horizon averaged between 5°-85°. FIGS. 38, 40, and 42 illustrate a exitance photometric plot 35 of the collection optic 14 of FIG. 35 and the distribution optic 15 of FIG. 15 with incidence angles with respect to the horizon of 25°, 50°, and 75° respectively.

Referring to FIGS. 17, 19, 21, 25, 27, 29, 31, 36, 38, 40, and 42, there are no specular rays below horizon. The luminous intensity plots 35*a* of FIGS. 17, 23, 36, and 42 shows a small contribution of light 35*d* below the horizon. This light is all diffused, relatively low intensity and within 2° of the horizon. Therefore, the effect on the building occupant is negligible.

As demonstrated in FIGS. 8-12, one of the advantages of the light-redirecting optical system 10 is that it can be tailored to different building structures. For example, the exitance photometric plot 35 of FIG. 17 has a narrower initial system exitance angle as compared with the exitance photometric plots 35 of FIGS. 25 and 36. However, FIGS. 25 and 35 shows that most of their luminous intensity plots 35*a* falls at a shallower angle, with more than half the light projecting between approximately 7-35°. This would imply that the combination of the collection optic 14 of FIG. 24 or FIG. 35 with the distribution optic 15 of FIG. 15 may be more suitable to throw light across longer spaces than the collection optic 14 of FIG. 14 and the distribution optic 15 of FIG. 16. For example, buildings shown in FIGS. 8-11. On the other hand, the collection optic 14 of FIG. 14 and the distribution optic 15 of FIG. 16 may be more suitable for narrower spaces such as building 22 with the series of clerestory windows 28 of FIG. 12

Figure 43:
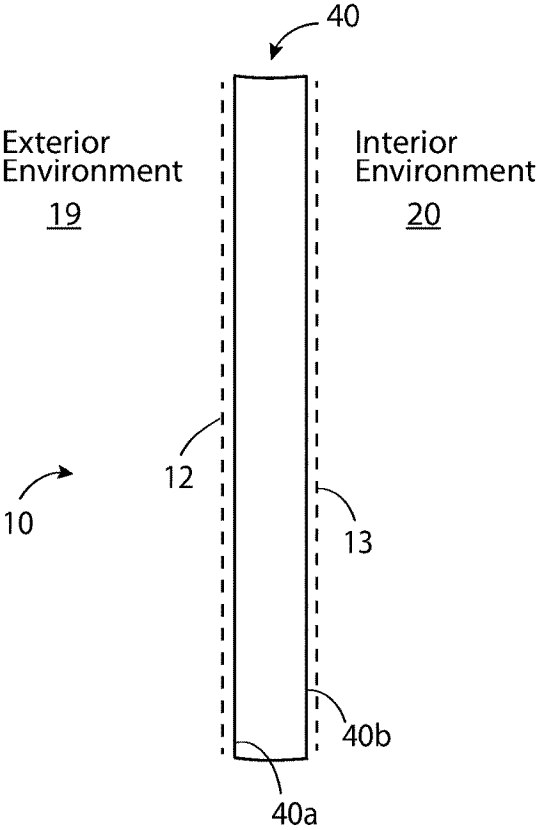
FIG. 43 illustrates a portion of a single pane of glass showing the light-redirecting optical surfaces applied to the two surfaces of the glass panel.

In the examples discussed for FIGS. 4-42, the collection optic 14 and the distribution optic 15 are applied to the outside surfaces 11*d*, 11*e* of the first glass panel 11*a* and the second glass panel 11*b*, respectively, of the IGU 11 as illustrated in FIGS. 4 & 7. This configuration has several advantages. First, the incidence angle modifier effect is minimized. Second, if the light-redirecting optical system uses light-redirecting optical films, the light-redirecting optical film can be applied after the IGU is manufactured and/or installed. While these advantages are often desirable, the inventors envision additional applications for that do not require one or either of these advantages. FIGS. 43-46 show five such examples. In some environments, such as moderate climates, an IGU may not be required. FIG. 43 illustrates a portion of a glass pane 40 showing the first light-redirecting optical film 12, applied to the outside surface 40*a* of the glass pane 40 facing the exterior environment 19 and the second light-redirecting optical film 13 applied to the outside surface 40*b* of the glass pane 40 facing the interior environment. One of the benefits and unexpected results of the light-redirecting optical system 10 is that placing the first light-redirecting optical film 12 and the second light-redirecting optical film 13 a closer distance together appears to only slightly improve performance by removing interreflection from any interlayers. For example, the performance of the light-redirecting optical system 10 of FIG. 43 is similar to the light-redirecting optical system 10 of FIG. 6. The distance between the first light-redirecting optical film 12 and the second light-redirecting optical film 13 is nearly four times the distance in FIG. 4 as compared with FIG. 43.

Figure 44:
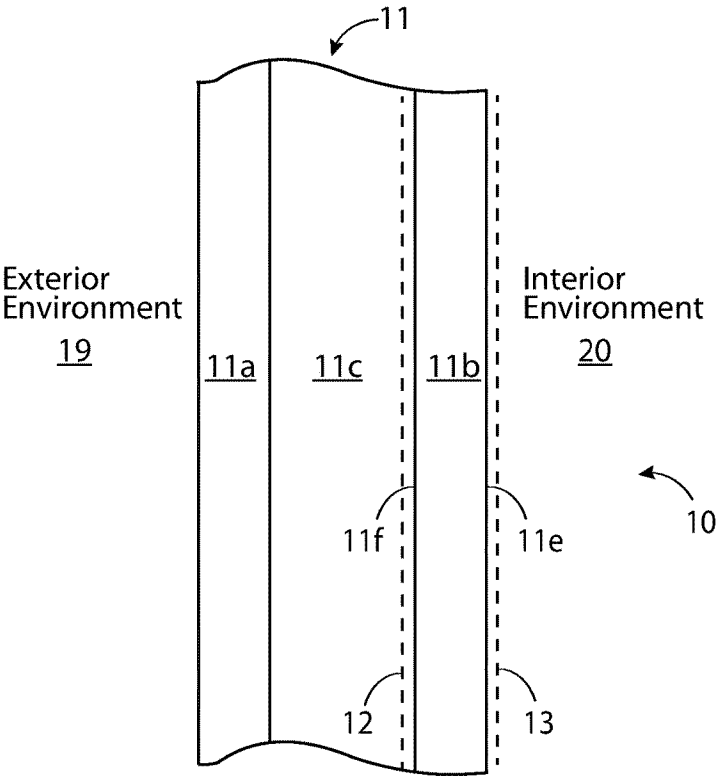
FIG. 44 illustrates a portion of a double-pane insulated glass unit showing the light-redirecting optical surfaces applied to the two surfaces of the glass panel facing the inside environment.

Under some circumstances, such as harsh environments and where the incidence angle modifier effect is not important or critical. FIG. 44 shows a typical section of an IGU 11 of a light-redirecting optical system 10 with a first glass panel 11*a* facing the exterior environment 19, a second glass panel 11*b* facing the interior environment 20, and an insulating space 11*c* between the first glass panel 11*a* and the second glass panel 11*b* the first light-redirecting optical film 12, where the first light-redirecting optical film 12 is applied to the inside surface 11*f* of the second glass panel 11*b*. The second light-redirecting optical film 13 is applied to the outside surface 11*e* of second glass panel 11*b*.

Figure 45:
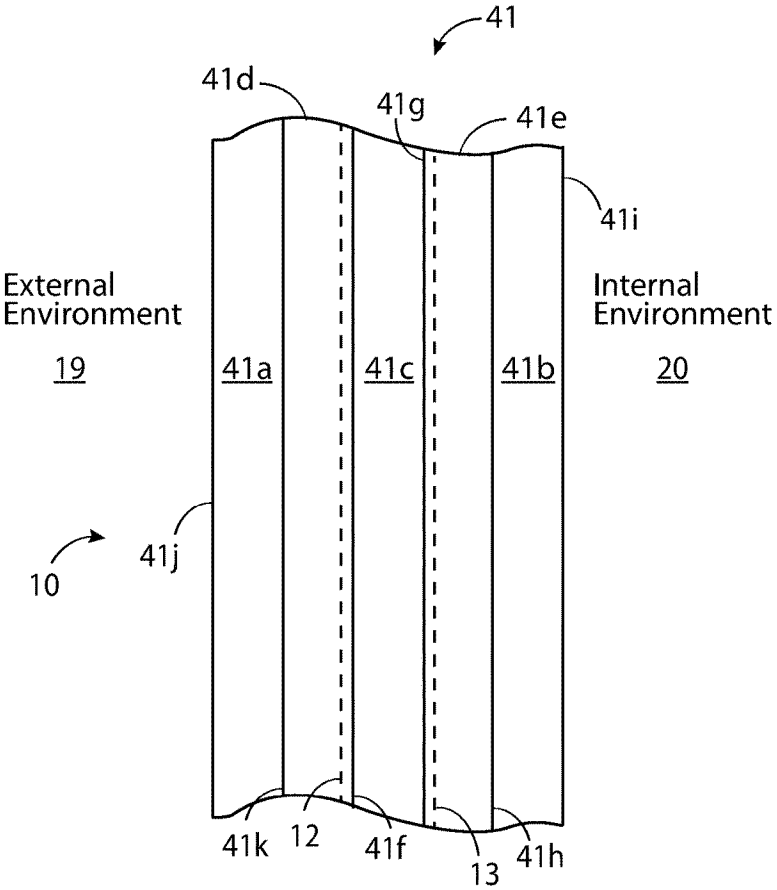
FIG. 45 illustrates a portion of a triple-pane insulated glass unit showing the light-redirecting optical surfaces applied to the two surfaces of the center glass panel.

Similarly, the light-redirecting optical films can be applied to the interior pane of a triple-pane IGU or the center pane or suspended film of a triple-pane IGU, for example, when the benefits of taking the collection optic away from the outside environment outweigh the disadvantages associated with the incidence angle modifier effect. FIG. 45 illustrates a light-redirecting optical system 10 that includes a portion of a triple-pane IGU 41 with a first glass panel 41*a* facing the exterior environment 19, a second glass panel 41*b* facing the interior environment 20, and a third glass panel 41*c* between the first glass panel 41*a* and the second glass panel 41*b* and separated from them by insulating spaces 41*d*, 41*e*. FIG. 45 shows the first light-redirecting optical film 12 applied to the first surface 41*f* (i.e. the surface facing the exterior environment 19) of the third glass panel 41*c* (i.e. the center glass panel) and the second light-redirecting optical film 13 applied to the second surface 41*g* (i.e. the surface facing the interior environment 20) of the third glass panel 41*c*. The first and second light-redirecting optical films can be applied to the other glass panels within the triple-pane IGU 41. For example, the first light-redirecting optical film 12 can be applied to the outside surface 41*j* and the second light-redirecting optical film 13 can be applied to the inside surface 41*k* of the first glass panel 41*a*. Alternatively, the first light-redirecting optical film 12 can be applied to the inside surface 41*h* and the second light-redirecting optical film 13 can be applied to the outside surface 41*i* of the second glass panel 41*b*.

To achieve the same advantages of light-redirecting optical system 10 of FIG. 4, in FIG. 45, the first light-redirecting optical film 12 applied to the outside surface 41*j* (i.e. the surface facing the exterior environment) of the first glass panel 41*a* (i.e. the outer-most glass panel) and the second light-redirecting optical film 13 can be applied to the outside surface 41*i* (i.e. the surface facing the interior environment) of the second glass panel 41*b* (i.e. the inner-most glass panel).

Figure 46:
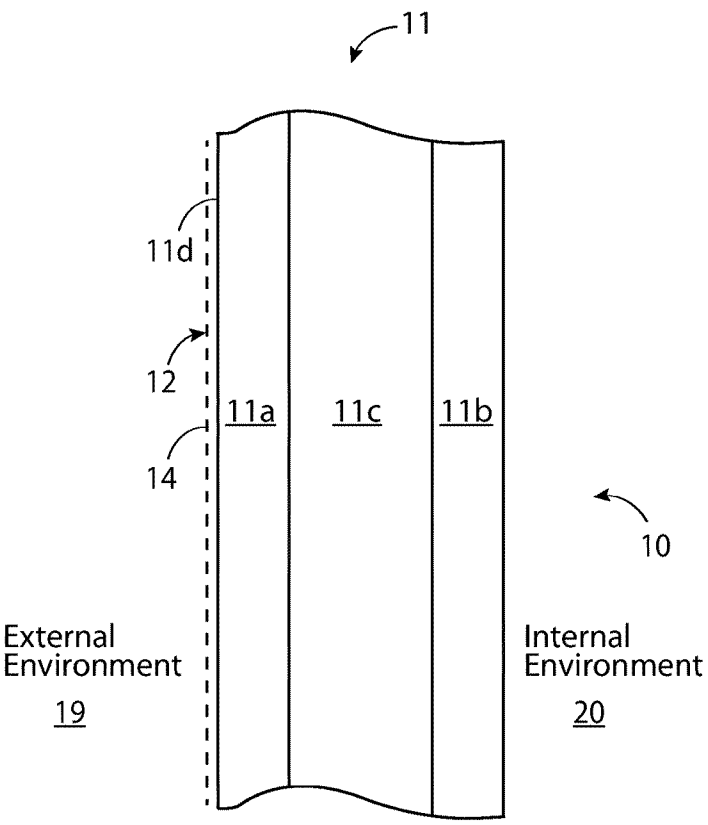
FIG. 46 illustrates a portion of a double-pane insulated glass unit showing the collection optic of the light-redirecting optical surfaces applied to outside surface that faces the outside environment.

There are some circumstances where directing most, but not all, the specular rays above the horizon is acceptable, but control over how specular rays are projected into the interior environment is important. For example, in a high clerestory window, depending on the depth of the interior environment, a collection optic 14 alone may provide adequate control to keep glare out of the eyes of the building occupants. FIG. 46 illustrates a portion of a light-redirecting optical system 10 that includes an IGU 11 where the first light-redirecting optical film 12, that includes a collection optic 14, is applied to outside surface 11*d* of the first glass panel 11*a*. The IGU 11 is double paned and includes a first glass panel 11*a* facing the exterior environment 19, a second glass panel 11*b* facing the interior environment 20, and an insulating space 11*c* separating the glass panels as previously described. In this embodiment, the incidence angle modifier problem is eliminated because the collection optic 14 prevents the reflection of sunlight from its surface, as previously described.

Note that in FIGS. 43-46, the first light-redirecting optical film 12 includes a collection optic, such as the collection optic 14 described for FIGS. 4 and 5. The collection optic 14 can be, for example, the collection optic 14 of FIG. 14, 24, 35 or any collection optic 14 that falls within the spirit of the inventive concept. Similarly, the distribution optic 15 can be a distribution optic 15 such as the distribution optic 15 of FIG. 14 or 16 or any other distribution optic that falls within the spirit of the inventive concept.

The inventors envision the following additional embodiments, labeled below as examples, are also within the scope of the light-redirecting optical system 10.

Example 1

A light-redirecting optical system for a glazing, including: an outward-facing light-redirecting optical surface including a collection optic; an inward-facing optical redirecting surface including a distribution optic; and the collection optic and the distribution optic are shaped and positioned so that for all incidence angles of light between 5° and 85° with respect to a horizon striking the outward-facing light-redirecting optical surface, the distribution optic has a corresponding exitance angle for specular rays at or above the horizon.

Example 2

The light-redirecting optical system of Example 1, wherein: the collection optic and the distribution optic are shaped and positioned so that for all incidence angles of light above the horizon striking the outward-facing light-redirecting optical surface, the distribution optic has the corresponding exitance angle for specular rays at or above the horizon.

Example 3

The light-redirecting optical system of Example 2, wherein: the collection optic is shaped so that for all incidence angles of light above the horizon striking the outward-facing light-redirecting optical surface, the collection optic is without specular back reflection.

Example 4

The light-redirecting optical system of Example 1, wherein: the collection optic is so shaped that for all incidence angles of light between 5° and 85° with respect to a horizon striking the outward-facing light-redirecting optical surface, the collection optic is without specular back reflection.

Example 5

The light-redirecting optical system of Example 1, wherein: the collection optic includes an upward-facing portion that includes a translucent portion and a first transparent portion; and the distribution optic includes an upward-facing translucent portion and a second transparent portion extending acutely inward from the translucent portion.

Example 6

The light-redirecting optical system of Example 1, wherein: the collection optic includes an arcuate shaped portion facing convexly downward and a upward-facing portion extending at an acute angle inwardly away from a vertex of the arcuate shaped portion; and the upward-facing portion includes a transparent portion extending directly away from the vertex of the arcuate shaped portion and a translucent portion extending directly and inwardly away from the transparent portion toward an outward-facing vertical surface of the glazing.

Example 7

The light-redirecting optical system of Example 6, wherein: the distribution optic includes sawtooth shaped projections with an upward-facing translucent portion extending away from an inward-facing vertical surface of the glazing and a diagonal transparent portion extending away directly away from a vertex edge of the upward-facing translucent portion acutely toward the inward-facing vertical surface of the glazing.

Example 8

The light-redirecting optical system of Example 1, wherein: the distribution optic includes sawtooth shaped projections with an upward-facing translucent portion extending away from an inward-facing vertical surface of the glazing and a diagonal transparent portion extending away directly away from a vertex edge of the upward-facing translucent portion at an acute angle toward the inward-facing vertical surface of the glazing.

Example 9

The light-redirecting optical system of Example 1, further including: a first light-redirecting optical film including the collection optic as a first microstructure; and a second light-redirecting optical film including the distribution optic as a second microstructure.

Example 10

A light-redirecting optical system for a glazing, including: an outward-facing light-redirecting optical surface including a collection optic; an inward-facing optical redirecting surface including a distribution optic; the collection optic includes an arcuate shaped portion facing convexly downward and a upward-facing portion extending at an acute angle inwardly away from a vertex of the arcuate shaped portion; the upward-facing portion includes a transparent portion extending directly away from the vertex of the arcuate shaped portion and a translucent portion extending directly and inwardly away from the transparent portion toward an outward-facing vertical surface of the glazing; and the distribution optic includes sawtooth shaped projections with an upward-facing translucent portion extending away from an inward-facing vertical surface of the glazing and a diagonal transparent portion extending away directly away from a vertex edge of the upward-facing translucent portion acutely toward the inward-facing vertical surface of the glazing.

Example 11

The light-redirecting optical system of Example 10 further including: a light-redirecting optical film; a first light-redirecting optical film including the collection optic as a first microstructure; and a second light-redirecting optical film including the distribution optic as a second microstructure.

Example 12

The light-redirecting optical system of Example 10, further including: the first light-redirecting optical film is applied to a first outward-facing surface of the glazing that faces an exterior environment; and the second light-redirecting optical film is applied to a second outward-facing surface of the glazing that faces an interior environment.

Example 13

The light-redirecting optical system of Example 10, wherein: the collection optic is shaped and positioned so that for a collection optic incidence angle between 5° and 85° with respect to a horizon, the collection optic is without back reflection.

Example 14

The light-redirecting optical system of Example 10, wherein: the translucent portion includes a planar surface spanning an entire length and width of the translucent portion.

Example 15

The light-redirecting optical system of Example 10, wherein: the translucent portion is planar; and the transparent portion is planar.

Example 16

The light-redirecting optical system of Example 10, wherein: the translucent portion projects from the transparent portion at an oblique angle.

Example 17

A light-redirecting optical system for a glazing, including: an outward-facing light-redirecting optical surface including a collection optic; the collection optic includes an arcuate shaped portion facing convexly downward and a upward-facing portion extending at an acute angle inwardly away from a vertex of the arcuate shaped portion; and the upward-facing portion includes a transparent portion extending directly away from the vertex of the arcuate shaped portion and a translucent portion extending directly and inwardly away from the transparent portion toward an outward-facing vertical surface of the glazing.

Example 18

The light-redirecting optical system of Example 17, wherein: the collection optic is shaped and positioned so that for a collection optic incidence angle between 5° and 85° with respect to a horizon, the collection optic is without back reflection.

Example 19

The light-redirecting optical system of Example 17, wherein: the translucent portion is planar.

Example 20

The light-redirecting optical system of Example 17, wherein: the translucent portion is planar; and the transparent portion is planar.

Example 21

The light-redirecting optical system of Example 17, wherein: the translucent portion projects from the transparent portion at an oblique angle.

Example 22

The light-redirecting optical system of Example 17 further including: a light-redirecting optical film; the light-redirecting optical film includes the collection optic as a microstructure.

Example 23

A light-redirecting optical system for a glazing, including: an outward-facing light-redirecting optical surface; an inward-facing optical redirecting surface; and the outward-facing light-redirecting optical surface and inward-facing optical redirecting surface are shaped and positioned so that for all incidence angles striking the outward-facing light-redirecting optical surface between 5° and 85° with respect to a horizon, the inward-facing light-redirecting optical surface has a corresponding exitance angle at or above the horizon.

Example 24

The light-redirecting optical system of Example 23, wherein: the outward-facing light-redirecting optical surface and inward-facing optical redirecting surface are shaped and positioned so that for all incidence angles striking the outward-facing optical redirecting surface, the inward-facing optical redirecting surface has the corresponding exitance angle for specular rays at or above the horizon.

Example 25

The light-redirecting optical system of Example 24, wherein: the outward-facing light-redirecting optical surface is shaped so that for all incidence angles of light above the horizon striking the outward-facing light-redirecting optical surface, the collection optic is without specular back reflection.

Example 26

The light-redirecting optical system of Example 23, wherein: the outward-facing light-redirecting optical surface is so shaped that for all incidence angles of light between 5° and 85° with respect to a horizon striking the outward-facing light-redirecting optical surface, the collection optic is without specular back reflection.

Example 27

The light-redirecting optical system of Example 23, wherein: the outward-facing light-redirecting optical surface includes an upward-facing portion that includes a translucent portion and a first transparent portion; and the inward-facing light-redirecting optical surface includes an upward-facing translucent portion and a second transparent portion extending acutely inward from the translucent portion.

Example 28

The light-redirecting optical system of Example 23, wherein: the outward-facing light-redirecting optical surface includes an arcuate shaped portion facing convexly downward and a upward-facing portion extending at an acute angle inwardly away from a vertex of the arcuate shaped portion; and the upward-facing portion includes a transparent portion extending directly away from the vertex of the arcuate shaped portion and a translucent portion extending directly and inwardly away from the transparent portion toward an outward-facing vertical surface of the glazing.

Example 29

The light-redirecting optical system of Example 28, wherein: the inward-facing light-redirecting optical surface includes sawtooth shaped projections with an upward-facing translucent portion extending away from an inward-facing vertical surface of the glazing and a diagonal transparent portion extending away directly away from a vertex edge of the upward-facing translucent portion acutely toward the inward-facing vertical surface of the glazing.

Example 30

The light-redirecting optical system of Example 23, wherein: the inward-facing light-redirecting optical surface includes sawtooth shaped projections with an upward-facing translucent portion extending away from an inward-facing vertical surface of the glazing and a diagonal transparent portion extending away directly away from a vertex edge of the upward-facing translucent portion at an acute angle toward the inward-facing vertical surface of the glazing.

Example 31

The light-redirecting optical system of Example 23, further including: a first light-redirecting optical film including the outward-facing light-redirecting optical surface as a first microstructure; and a second light-redirecting optical film including the inward-facing light-redirecting optical surface as a second microstructure.

Example 32

A light-redirecting optical system for a glazing, including: an outward-facing light-redirecting optical surface including an outward-facing light-redirecting optical surface; an inward-facing optical redirecting surface including an inward-facing light-redirecting optical surface; the outward-facing light-redirecting optical surface includes an arcuate shaped portion facing convexly downward and a upward-facing portion extending at an acute angle inwardly away from a vertex of the arcuate shaped portion; the upward-facing portion includes a transparent portion extending directly away from the vertex of the arcuate shaped portion and a translucent portion extending directly and inwardly away from the transparent portion toward an outward-facing vertical surface of the glazing; and the inward-facing light-redirecting optical surface includes sawtooth shaped projections with an upward-facing translucent portion extending away from an inward-facing vertical surface of the glazing and a diagonal transparent portion extending away directly away from a vertex edge of the upward-facing translucent portion acutely toward the inward-facing vertical surface of the glazing.

Example 33

The light-redirecting optical system of Example 32 further including: a light-redirecting optical film; a first light-redirecting optical film including the outward-facing light-redirecting optical surface as a first microstructure; and a second light-redirecting optical film including the inward-facing light-redirecting optical surface as a second microstructure.

Example 34

The light-redirecting optical system of Example 33, further including: the first light-redirecting optical film is applied to a first outward-facing surface of the glazing that faces an exterior environment; and the second light-redirecting optical film is applied to a second outward-facing surface of the glazing that faces an interior environment.

Example 35

The light-redirecting optical system of Example 32, wherein: the outward-facing light-redirecting optical surface is shaped and positioned so that for all outward-facing light-redirecting optical surface incidence angles between 5° and 85° with respect to a horizon, the outward-facing light-redirecting optical surface is without back reflection.

Example 36

The light-redirecting optical system of Example 32, wherein: the translucent portion includes a planar surface spanning an entire length and width of the translucent portion.

Example 37

The light-redirecting optical system of Example 32, wherein: the translucent portion is planar; and the transparent portion is planar.

Example 38

The light-redirecting optical system of Example 32, wherein: the translucent portion projects from the transparent portion at an oblique angle.

Example 39

A light-redirecting optical system for a glazing, including: an outward-facing light-redirecting optical surface including an outward-facing light-redirecting optical surface; the outward-facing light-redirecting optical surface includes an arcuate shaped portion facing convexly downward and a upward-facing portion extending at an acute angle inwardly away from a vertex of the arcuate shaped portion; and the upward-facing portion includes a transparent portion extending directly away from the vertex of the arcuate shaped portion and a translucent portion extending directly and inwardly away from the transparent portion toward an outward-facing vertical surface of the glazing.

Example 40

The light-redirecting optical system of Example 39, wherein: the outward-facing light-redirecting optical surface is shaped and positioned so that for all outward-facing light-redirecting optical surface incidence angles between 5° and 85° with respect to a horizon, the outward-facing light-redirecting optical surface is without back reflection.

Example 41

The light-redirecting optical system of Example 39, wherein: the translucent portion is planar.

Example 42

The light-redirecting optical system of Example 39, wherein: the translucent portion is planar; and the transparent portion is planar.

Example 43

The light-redirecting optical system of Example 39, wherein: the translucent portion projects from the transparent portion at an oblique angle.

Example 44

The light-redirecting optical system of Example 39 further including: a light-redirecting optical film; the light-redirecting optical film includes the outward-facing light-redirecting optical surface as a microstructure.

A light-redirecting optical system 10, in several variations and examples, has been described. It is not the intent of this disclosure to limit the claimed invention to the examples and variations described in the specification. Those skilled in the art will recognize that variations will occur when embodying the claimed invention in specific implementations and environments. For example, while the light-redirecting optical system 10 of FIGS. 4-42 has been discussed for an IGU 11 with two panes of glass, as shown in FIGS. 43 and 45, the light-redirecting optical system can be implemented on a single pane of glass (FIG. 43) or a triple-pane IGU 41 and still maintain the advantages and unexpected results of the light-redirecting optical system 10 of FIG. 4.

While the light-redirecting optical system 10 has been shown primarily applied using light-redirecting optical films on glass panels, the inventors envisions that the light-redirecting optical system 10 can be readily applied to glass, acrylic, clear fiberglass, polycarbonate, copolyester, aluminum oxynitride (ALON), and other glazing material. A light-redirecting optical film, such as the first light-redirecting optical film 12 (with associated the collection optic 14) and the second light-redirecting optical film 13 (with associated the distribution optic 15) can be applied to the glazing material as described in FIG. 4. Alternatively, the collection optic 14 and the distribution optic 15 can be etched, cut, molded, extruded, embossed, cold cast, or otherwise formed on the surface of glazing material. While the light-redirecting optical system has been demonstrated in a scale suitable for implementation on light-redirecting optical film, the inventors envision that the light-redirecting optical system 10 can readily scaled to millimeter or even centimeter scale if applied directly to the glazing surface.

It is often desirable to add low emissivity coating (i.e. low-E coating) to reflect away the heat producing invisible infrared light. It is also often desirable to add ultraviolet (UV) reflective coatings to reflect away UV light. Low-E coatings and UV reflective coatings can co-exist with light-redirecting optical system. For example, referring to FIG. 5, these coatings could be formulated in the lacquer layers 12*a* or applied either on top of or beneath the film layer 12*b* of the first light-redirecting optical film 12. Referring to FIG. 6, similarly, the coatings could be formulated in the lacquer layers 13*a* or applied either on top of or beneath the film layer 13*b* of the second light-redirecting optical film 13. Alternatively, these coatings could be applied to the inside surface 11*f*, 11*g* of one or both the first glass panel 11*a* and the second glass panel 11*b* respectively. The inventors envision that such optional coatings in combination with the light-redirecting optical system 10 is within the scope of the inventive concept.

It is possible to implement certain features described in separate examples in combination within a single example. Similarly, it is possible to implement certain features described in a single example either separately or in combination in multiple examples. For example, the distribution optic 15 of FIG. 16 is shown in combination with the collection optic 14 of FIG. 14 for FIGS. 17-23. The distribution optic 15 of FIG. 15 is shown in combination with the collection optic 14 of FIG. 24 for FIGS. 25-34 and in combination with the collection optic 14 of FIG. 35 for FIGS. 36-42. The inventors envision that the distribution optics 15 of FIGS. 15 and 16 can be interchanged and still fall within the scope of the claimed invention.

A light-redirecting optical system 10 has been demonstrated that has no collection optic back reflection and has a distribution optic exitance angle above the horizon for all incidence angles striking the collection optic. Ray-trace diagrams and photometric plots have been discussed that show incidence angles between 5° and 85°. However, the inventors envision that it may be within the scope of the light-redirecting optical system 10 to have a narrower range of performance that is not taught in the art.

While the exemplary examples and variations are helpful to those skilled in the art in understanding the claimed invention, the scope of the claimed invention is defined solely by the following claims and their equivalents.

What is claimed is:

1. A light-redirecting optical system for a vertical glazing, including:

an outward-facing light-redirecting optical surface including a collection optic;

the collection optic includes a series of projections projecting into an exterior environment;

a projection of the series of projections includes an upward-facing portion that includes a translucent portion projecting acutely away from the vertical glazing and a transparent portion projecting directly away from the translucent portion; and the series of projections are shaped and positioned so that the series of projections mitigates an incident angle modifier effect of the vertical glazing by redirection and diffusion of specular rays into an interior environment.

2. The light-redirecting optical system of claim 1, wherein:

the transparent portion projects from the translucent portion at an oblique angle.

3. The light-redirecting optical system of claim 1, wherein:

the transparent portion is planar with the translucent portion.

4. The light-redirecting optical system of claim 1 wherein:

the projection includes an arcuate shaped portion facing convexly downward and extending at an acute angle inwardly away from a vertex of the transparent portion.

5. The light-redirecting optical system of claim 4, wherein:

the arcuate shaped portion so positioned with respect to the transparent portion that specular light passing through the transparent portion and striking an interior surface of the arcuate shaped portion reflects off the interior surface by total internal reflection.

6. The light-redirecting optical system of claim 1, further including:

a light-redirecting optical film including the collection optic as a microstructure.

7. A light-redirecting optical system for a vertical glazing, including:

an outward-facing light-redirecting optical surface including a collection optic;

the collection optic includes a series of projections projecting into an exterior environment;

a projection of the series of projections includes an arcuate shaped portion, a transparent portion, and a translucent portion that are so shaped and positioned that specular light passing through the transparent portion and striking an interior surface of the arcuate shaped portion reflects off the interior surface by total internal reflection; and the series of projections are shaped and positioned so that the series of projections mitigates an incident angle modifier effect of the vertical glazing by redirection and diffusion of specular rays into an interior environment.

8. The light-redirecting optical system of claim 7, wherein:

the arcuate shaped portion is convexly downward.

9. The light-redirecting optical system of claim 8, wherein:

the transparent portion and the translucent portion are each planar.

10. A light-redirecting optical system for a vertical glazing, including:

an outward-facing light-redirecting optical surface including a collection optic positioned on an exterior surface of the vertical glazing;

the collection optic includes a series of projections projecting into an exterior environment and stationary with respect to the vertical glazing;

a projection of the series of projections includes an upward-facing portion that includes a translucent portion projecting acutely away from the vertical glazing and a transparent portion projecting directly away from the translucent portion; and the series of projections are shaped and positioned so that the collection optic mitigates an incident angle modifier effect of the vertical glazing by redirection and diffusion of specular rays into an interior environment.

11. The light-redirecting optical system of claim 10, wherein:

the transparent portion projects from the translucent portion at an oblique angle.

12. The light-redirecting optical system of claim 10, wherein:

the transparent portion is planar with the translucent portion.

13. The light-redirecting optical system of claim 10 wherein:

the projection includes an arcuate shaped portion facing convexly downward and extending at an acute angle inwardly away from a vertex of the transparent portion.

14. The light-redirecting optical system of claim 13, wherein:

the arcuate shaped portion so positioned with respect to the transparent portion that specular light passing through the transparent portion and striking an interior surface of the arcuate shaped portion reflects off the interior surface by total internal reflection.

15. The light-redirecting optical system of claim 10, wherein:

the projection includes an arcuate shaped portion facing convexly downward.

16. The light-redirecting optical system of claim 15, wherein:

the transparent portion and the translucent portion are each planar.

17. The light-redirecting optical system of claim 10, further including:

a light-redirecting optical film including the collection optic as a microstructure.

* * * * *